US008651654B2

(12) United States Patent
Bailey et al.

(10) Patent No.: US 8,651,654 B2
(45) **Date of Patent: *Feb. 18, 2014**

(54) PINCH ROLLER APPARATUS FOR PRINTER

(75) Inventors: John Bailey, San Diego, CA (US); Bob Yraceburu, San Diego, CA (US)

(73) Assignee: Zamtec Ltd, Dublin (IE)

( * ) Notice: Subject to any disclaimer, the term of this patent is extended or adjusted under 35 U.S.C. 154(b) by 295 days.

This patent is subject to a terminal disclaimer.

(21) Appl. No.: 13/108,000

(22) Filed: May 16, 2011

(65) Prior Publication Data

US 2011/0279616 A1 Nov. 17, 2011

Related U.S. Application Data

(60) Provisional application No. 61/345,572, filed on May 17, 2010.

(51) Int. Cl.
*B41J 2/01* (2006.01)
*B41J 29/13* (2006.01)

(52) U.S. Cl.
USPC ..... 347/104; 347/108

(58) Field of Classification Search
USPC ..... 347/104, 101, 108
See application file for complete search history.

(56) References Cited

U.S. PATENT DOCUMENTS

| | | | | |
|---|---|---|---|---|
| 6,196,739 | B1 * | 3/2001 | Silverbrook | 400/582 |
| 2003/0043248 | A1 * | 3/2003 | Samoto et al. | 347/104 |
| 2005/0271443 | A1 * | 12/2005 | Takahashi et al. | 400/613 |
| 2007/0052782 | A1 | 3/2007 | Lee | |
| 2007/0126828 | A1 * | 6/2007 | Knight et al. | 347/87 |
| 2008/0297546 | A1 | 12/2008 | Lee et al. | |
| 2011/0312455 | A1 | 12/2011 | Lannutti et al. | |

* cited by examiner

*Primary Examiner* — Stephen Meier
*Assistant Examiner* — Sarah Al Hashimi
(74) *Attorney, Agent, or Firm* — Cooley LLP

(57) ABSTRACT

A pinch roller apparatus for a printer is provided having a support plate securely mounted to a housing of the printer, a pinch housing movably supported by the support plate, and a series of pinch rollers rotatably held within the pinch housing. The pinch housing has alignment pins for engagement with the housing of the printer through movement of the pinch housing relative to the support plate. The engagement aligns the pinch rollers with a driven roller rotatably mounted to the housing to provide pinched contact for media being transported through the printer.

11 Claims, 56 Drawing Sheets

PINCH ROLLER APPARATUS FOR PRINTER

FIELD OF INVENTION

The invention relates to printing systems, printing apparatus and methods for printing on continuous web media, and in particular continuous label web media, and to the configuration and arrangement of the components of such systems and apparatus. The related printing systems, apparatus and methods include those which distribute fluid within a printing environment. In particular, the fluid is a printing fluid, such as ink or ink fixing agent, as is distributed to and from a fluid ejection printhead, such as an inkjet printhead. More particularly, fluid distribution to an inkjet media width printhead is provided. The related printing systems, apparatus and methods also include those which maintain such a printhead and which handle the media before and after the media is printed on by the printhead.

CO-PENDING APPLICATIONS

The following applications have been filed by the Applicant which relate to the present application:

| | | | | | | |
|---|---|---|---|---|---|---|
| 13/107,961 | 13/107,963 | 13/107,964 | 13/107,965 | 13/107,967 | 13/107,968 | 13/107,970 |
| 13/107,972 | 13/107,976 | 13/107,979 | 13/107,988 | 13/107,990 | 13/107,992 | 13/107,995 |
| 13/107,998 | 13/108,002 | 13/108,575 | 13/108,594 | 13/108,611 | 13/108,618 | 13/108,640 |
| 13/108,647 | 13/108,667 | 13/108,673 | 13/108,692 | 13/108,695 | 13/108,695 | 13/108,714 |
| 13/108,724 | 13/108,728 | 13/108,741 | 13/108,745 | 13/108,760 | 13/108,763 | 13/108,778 |
| 13/108,781 | 13/108,797 | 13/108,800 | 13/108,804 | 13/108,810 | 13/108,814 | 13/108,818 |
| 13/108,827 | 13/108,830 | 13/108,840 | 13/108,842 | 13/108,849 | 13/108,851 | 13/108,861 |
| 13/108,866 | 13/108,790 | 13/108,799 | 13/108,802 | 13/108,812 | 13/108,815 | 13/108,823 |
| 13/108,832 | 13/108,809 | 13/108,816 | 13/108,816 | 13/108,825 | 13/108,834 | 13/108,841 |
| 13/108,846 | 13/108,853 | 13/108,839 | 13/108,845 | 13/108,863 | 13/108,862 | 13/108,862 |
| 13/108,870 | 13/107,971 | 13/107,978 | 13/107,980 | 13/107,982 | 13/107,984 | 13/107,985 |
| 13/107,989 | 13/107,993 | 13/107,996 | 13/107,977 | 13/107,981 | 13/107,983 | 13/107,987 |
| 13/107,991 | 13/107,994 | 13/107,997 | 13/108,001 | | | |

The disclosures of these co-pending applications are incorporated herein by reference.

CROSS REFERENCES

The following patents or patent applications filed by the applicant or assignee of the present invention are hereby incorporated by cross-reference.

| | | | | | | |
|---|---|---|---|---|---|---|
| 6,276,850 | 6,443,555 | 7,215,441 | 6,906,778 | 6,688,528 | 6,641,317 | 7,155,395 |
| 7,118,481 | 6,750,901 | 6,496,654 | 7,021,745 | 6,712,453 | 6,428,147 | 6,416,170 |
| 6,402,300 | 6,464,340 | 6,612,687 | 6,412,912 | 6,447,099 | 6,505,913 | 7,249,108 |
| 6,566,858 | 6,442,525 | 09/517,384 | 09/505,951 | 6,374,354 | 7,246,098 | 6,816,968 |
| 6,757,832 | 6,334,190 | 6,745,331 | 7,249,109 | 10/940,653 | 10/942,858 | 7,286,169 |
| 6,985,207 | 6,878,299 | 10/780,625 | 10/831,234 | 10/831,233 | 7,246,897 | 7,077,515 |
| 10/831,235 | 10/853,336 | 6,913,875 | 11/012,024 | 11/011,925 | 6,710,457 | 6,530,339 |
| 6,238,044 | 11/003,786 | 11/003,463 | 11/003,701 | 11/003,683 | 11/003,464 | 7,284,820 |
| 11/293,800 | 11/482,975 | 11/482,970 | 11/482,968 | 11/482,972 | 11/482,971 | 11/482,969 |
| 6,431,577 | 6,471,331 | 11/097,266 | 11/685,084 | 11/740,925 | 11/763,444 | 7,206,654 |
| 6,786,420 | 6,948,661 | 7,073,713 | 11/518,238 | 7,032,899 | 11/084,237 | 6,350,023 |
| 11/246,676 | 11/246,707 | 11/482,958 | 11/482,955 | 11/482,962 | 11/482,963 | 11/482,956 |
| 11/482,954 | 11/482,974 | 11/482,957 | 11/482,987 | 11/482,959 | 11/482,960 | 11/482,961 |
| 11/482,964 | 11/482,965 | 11/482,976 | 11/482,973 | 11/495,815 | 10/803,074 | 10/922,970 |
| 10/922,836 | 10/922,842 | 10/922,848 | 10/922,843 | 7,125,185 | 7,229,226 | 10/815,621 |
| 7,243,835 | 10/815,630 | 10/815,638 | 10/815,635 | 10/815,647 | 10/815,636 | 11/041,650 |
| 11/041,556 | 10/815,609 | 6,227,652 | 6,588,882 | 6,742,873 | 6,918,655 | 6,547,371 |
| 6,938,989 | 6,598,964 | 6,923,526 | 6,273,544 | 6,425,654 | 6,623,101 | 6,406,129 |
| 6,505,916 | 6,457,809 | 6,550,895 | 6,457,812 | 7,152,962 | 6,428,133 | 11/607,976 |
| 11/685,074 | 11/696,650 | 11/763,446 | 6,224,780 | 6,665,094 | 7,072,076 | 6,851,782 |
| 10/636,211 | 11/305,274 | 6,231,148 | 7,006,143 | 6,412,993 | 7,204,941 | 7,278,727 |
| 7,148,345 | 11/172,816 | 11/831,961 | 10/407,212 | 11/482,980 | 11/482,967 | 11/124,158 |
| 11/124,197 | 11/124,163 | 7,236,271 | 11/124,201 | 11/124,188 | 11/124,170 | 11/124,187 |
| 11/124,189 | 11/124,190 | 11/124,180 | 11/124,178 | 11/124,148 | 11/124,168 | 11/124,167 |
| 11/124,179 | 11/187,976 | 11/188,011 | 11/188,014 | 11/482,979 | 11/228,540 | 11/228,502 |
| 11/228,484 | 11/228,489 | 11/228,518 | 11/228,488 | 11/228,523 | 11/228,520 | 11/228,498 |
| 11/228,479 | 6,238,115 | 6,087,638 | 10/868,866 | 11/242,916 | 11/198,235 | 11/861,282 |
| 7,152,972 | D529952 | 6,390,605 | 6,322,195 | 6,426,014 | 6,340,453 | 6,317,399 |
| 6,595,624 | 6,417,757 | 7,095,309 | 6,817,700 | 6,425,971 | 6,383,833 | 6,746,105 |
| 6,412,904 | 6,398,343 | 6,652,074 | 6,682,174 | 6,648,453 | 6,682,176 | 6,755,509 |
| 7,222,943 | 7,188,419 | 7,168,166 | 7,086,719 | 11/763,440 | 11/246,687 | 11/829,957 |
| 11/829,962 | 11/829,966 | 11/829,967 | 7,156,508 | 11/246,684 | 7,246,886 | 7,128,400 |
| 7,108,355 | 6,991,322 | 7,287,836 | 7,118,197 | 10/728,784 | 10/728,783 | 7,077,493 |
| 6,962,402 | 10/728,803 | 7,147,308 | 7,118,198 | 7,168,790 | 7,172,270 | 7,229,155 |
| 6,830,318 | 7,195,342 | 7,175,261 | 10/773,183 | 7,108,356 | 7,118,202 | 10/773,186 |
| 7,134,744 | 7,134,743 | 7,182,439 | 7,210,768 | 10/773,187 | 7,134,745 | 7,156,484 |

-continued

| | | | | | | |
|---|---|---|---|---|---|---|
| 7,118,201 | 7,111,926 | 10/773,184 | 11/060,751 | 11/060,805 | 11/744,885 | 11/097,308 |
| 11/210,687 | 11/097,212 | 7,147,306 | 11/482,953 | 11/482,977 | 11/544,778 | 11/764,808 |
| 7,156,289 | 7,178,718 | 7,225,979 | 11/084,796 | 09/575,197 | 09/722,174 | 7,175,079 |
| 7,162,259 | 11/520,170 | 11/830,848 | 11/830,849 | 7,068,382 | 10/743,671 | 7,094,910 |
| 7,091,344 | 7,122,685 | 7,038,066 | 7,099,019 | 7,062,651 | 6,644,642 | 7,064,851 |
| 6,965,439 | 7,093,991 | 7,190,491 | 10/932,044 | 10/965,733 | 10/965,933 | 10/982,974 |
| 7,180,609 | 11/653,219 | 6,982,798 | 6,870,966 | 6,792,165 | 7,015,901 | 7,289,882 |
| 10/919,379 | 11/193,481 | 11/255,941 | 11/495,814 | 11/495,822 | 7,055,739 | 7,182,247 |
| 7,082,562 | 6,766,944 | 10/409,864 | 7,108,192 | 7,111,791 | 10/683,171 | 6,957,768 |
| 6,786,397 | 11/856,061 | 11/672,522 | 11/672,950 | 11/672,947 | 11/672,891 | 11/672,954 |
| 11/754,310 | 11/754,321 | 11/754,320 | 11/754,319 | 11/754,318 | 11/754,315 | 11/754,317 |
| 11/754,317 | 11/754,314 | 11/754,313 | 11/754,312 | 11/754,311 | 7,132,679 | 6,755,513 |
| 6,904,678 | 7,097,273 | 6,824,245 | 7,222,947 | 6,860,581 | 6,929,351 | 7,063,404 |
| 11/066,161 | 11/066,160 | 6,804,030 | 10/727,181 | 10/754,536 | 10/754,938 | 10/934,720 |
| 6,795,215 | 11/482,981 | 7,195,328 | 10/854,521 | 10/934,628 | 11/601,757 | 11/014,731 |
| D529081 | D528597 | 6,924,907 | 10/636,234 | 10/636,233 | 7,301,567 | 10/636,216 |
| 7,274,485 | 7,139,084 | 7,173,735 | 7,068,394 | 7,286,182 | 7,086,644 | 7,250,977 |
| 7,146,281 | 7,023,567 | 7,134,683 | 7,083,254 | 6,796,651 | 7,061,643 | 7,057,758 |
| 6,894,810 | 6,995,871 | 7,085,010 | 7,092,126 | 7,123,382 | 7,061,650 | 10/853,143 |
| 11/225,158 | 11/544,764 | 11/293,804 | 11/293,794 | 11/293,828 | 11/482,978 | 11/640,356 |
| 11/679,786 | 10/760,254 | 11/014,764 | 11/014,763 | 11/014,748 | 11/014,747 | 11/014,761 |
| 11/014,760 | 11/014,757 | 11/014,714 | 7,249,822 | 11/014,762 | 11/014,724 | 11/014,723 |
| 11/014,756 | 11/014,736 | 11/014,759 | 11/014,758 | 11/014,725 | 11/014,739 | 11/014,738 |
| 11/014,737 | 11/014,726 | 11/014,745 | 11/014,712 | 7,270,405 | 11/014,751 | 11/014,735 |
| 11/014,734 | 11/014,719 | 11/014,750 | 11/014,749 | 7,249,833 | 11/014,769 | 11/014,729 |
| 11/014,743 | 11/014,733 | 11/014,754 | 11/014,755 | 11/014,765 | 11/014,766 | 11/014,740 |
| 7,284,816 | 7,284,845 | 7,255,430 | 11/014,744 | 11/014,741 | 11/014,768 | 11/014,767 |
| 11/014,718 | 11/014,717 | 11/014,716 | 11/014,732 | 11/014,742 | 11/097,268 | 11/097,185 |
| 11/097,184 | 11/293,820 | 11/688,863 | 11/688,864 | 11/688,865 | 11/688,866 | 11/741,766 |
| 11/482,982 | 11/495,819 | 11/677,049 | 11/014,722 | D528156 | 10/760,180 | 6,340,451 |
| 7,093,494 | 6,454,482 | 11/014,728 | 11/014,727 | D536031 | 7,237,888 | 10/760,214 |
| 10/962,413 | 10/962,427 | 7,261,477 | 7,225,739 | 10/962,402 | 10/962,425 | 10/962,428 |
| 7,191,978 | 10/962,426 | 10/962,409 | 10/962,417 | 10/962,403 | 7,163,287 | 7,258,415 |
| 10/962,523 | 7,258,424 | 10/962,410 | 11/223,262 | 10/853,270 | 6,485,123 | 6,378,990 |
| 6,425,658 | 6,488,346 | 6,814,429 | 6,471,336 | 6,457,813 | 6,540,331 | 6,454,396 |
| 6,464,325 | 6,443,559 | 6,435,664 | 6,412,914 | 6,488,360 | 6,550,896 | 6,439,695 |
| 6,447,100 | 09/900,160 | 6,488,344 | 7,044,589 | 6,416,154 | 6,547,340 | 6,644,771 |
| 6,565,181 | 6,857,719 | 6,702,417 | 6,918,654 | 6,652,078 | 6,623,108 | 6,625,874 |
| 6,921,153 | 6,536,874 | 6,425,651 | 6,435,667 | 6,527,374 | 6,582,059 | 6,513,908 |
| 6,540,332 | 6,547,368 | 6,679,584 | 6,857,724 | 6,652,052 | 6,672,706 | 6,588,886 |
| 7,207,654 | 6,934,224 | 6,927,786 | 6,916,082 | 6,978,990 | 7,285,170 | 7,066,580 |
| 6,984,023 | 7,059,706 | 7,185,971 | 7,090,335 | 6,739,701 | 7,008,503 | 10/636,274 |
| 6,792,754 | 6,860,107 | 6,786,043 | 6,866,369 | 6,886,918 | 6,827,427 | 6,918,542 |
| 7,007,852 | 6,988,840 | 6,984,080 | 6,863,365 | 7,524,016 | 12/014,772 | 11/246,687 |
| 12/062,514 | 12/062,517 | 12/062,518 | 7,819,515 | 7,891,794 | 12/062,522 | 7,891,788 |
| 12/062,524 | 7,878,635 | 12/062,526 | 7,874,662 | 12/062,528 | 7,878,639 | 7,891,795 |
| 7,878,640 | 12/192,116 | 7,883,189 | 12/192,118 | 12/192,119 | 7,887,148 | 7,887,170 |

BACKGROUND OF INVENTION

Most inkjet printers have a scanning or reciprocating printhead that is repeatedly scanned or reciprocated across the printing width as the media incrementally advances along the media feed path. This allows a compact and low cost printer arrangement. However, scanning printhead based printing systems are mechanically complex and slow in light of accurate control of the scanning motion and time delays from the incremental stopping and starting of the media with each scan.

Media width printheads resolve this issue by providing a stationary printhead spanning the media. Such media width printers offer high performance but larger printheads require a higher ink supply flow rate and the pressure drop in the ink from the ink inlet on the printhead to nozzles remote from the inlet can change the drop ejection characteristics. Large supply flow rates necessitate large ink tanks which exhibit a large pressure drop when the ink level in low compared to the hydrostatic pressure generated when the ink tank is full. Individual pressure regulators integrated into each printhead is unwieldy and expensive for multi-color printheads, particularly those carrying four or more inks. For example, a system with five inks would require 25 regulators.

Inkjet printers that can prime, deprime and purge air bubbles from the printhead offer the user distinct advantages. Removing a depleted printhead can cause inadvertent spillage of residual ink if it has not been de-primed before decoupling from the printer.

Air bubbles trapped in printheads are a perennial problem and a common cause of print artifacts. Actively and rapidly removing air bubbles from the printhead allows the user to rectify print problems without replacing the printhead. Active priming, de-priming and air purging typically use a lot of ink, particularly if the ink is drawn through the nozzles by vacuum or the like. This is exacerbated by large arrays of nozzles as more ink is lost as the number of nozzles increases.

Thus, there is a need to have a fluid distribution solution that is simpler, more reliable and more effective for media wide printing systems.

Further, such media width printheads having a large array of inkjet nozzles are difficult to maintain. For example, there is a need to maintain the printheads which becomes exceptionally difficult when the array of nozzles is as long as the media is wide. Further, the maintenance stations typically need to be located offset from the printheads so as not to interfere with media transport.

Some previous systems move the printheads to the servicing stations when not printing. However, when a printhead is returned to its operative position its alignment for correct printing is prone to drift until eventually visible artifacts demand hardware and/or software mechanisms to realign the printhead. In other previous systems, the service stations translate from their offset position to service the printheads while the printheads are raised sufficiently above the media path. Both of these system designs suffer from drawbacks of large printer width dimensions, complicated design and control, and difficulty in maintaining printhead alignment. Further, these systems add size to the printer. Thus, there is a need to have a media wide printhead maintenance solution that is simpler, more compact and more effective for media wide printing systems.

Further, the high media transport speeds used in such media width printers, particularly those which print on continuous web media, have typically lead to more complex media transport systems in the printers, due to the need to minimize media feed errors. Thus, there is a need to have a media transport solution that is simpler and more reliable for media wide printing systems.

SUMMARY OF INVENTION

In one aspect the present invention provides a system for distributing fluid and gas within a printer, comprising:

a fluid container having three fluid ports;

a first fluid path connecting the first fluid port to a printhead of the printer;

a second fluid path connecting the second fluid port to the printhead; and a third fluid path connecting the third fluid port to a gas vent, wherein the first and second fluid ports are configured so that fluid from the fluid container flows between the first and second fluid paths via the printhead and the third fluid port is configured so that gas flows between the fluid container and gas vent.

Optionally, the system further comprises a valve connecting the first path to the printhead.

Optionally, the first and second paths, printhead and fluid container form a closed fluid flow loop in which fluid flows to and from the fluid container in either direction of the loop.

Optionally, the system further comprises a bi-directional pump on the first or second paths for driving said fluid flows to and from the fluid container in either direction of the loop.

Optionally, each of the first, second and third fluid ports of the fluid container incorporate a septum into which a septum needle of tubing of the corresponding first, second and third fluid paths is sealingly inserted.

Optionally, each septum comprises a first septum having a membrane which is piercable by the septum needle and a slit septum having a slit through which the septum needle passes.

In another aspect, the present invention provides a fluid container for a printing system, the fluid container comprising:

a body defining a fluid reservoir;

a first fluid port for connecting the fluid reservoir to a first fluid path of a printhead of the printing system;

a second fluid port for connecting the fluid reservoir to a second fluid path of the printhead; and a third fluid port for connecting the fluid reservoir to a third fluid path to a gas vent.

Optionally, each of the first, second and third fluid ports incorporate a septum into which a septum needle of tubing of the corresponding first, second and third fluid paths is sealingly inserted.

Optionally, each septum comprises a first septum having a membrane which is piercable by the septum needle and a slit septum having a slit through which the septum needle passes.

Optionally, the first and second septa are adjacently disposed within each of the first, second and third fluid ports so that the septum needle passes through the slit of the second septum before piercing the first septum.

Optionally, the first and second septa are formed of resilient material.

Optionally, the resilient material of the first septum is compatible with the fluid contained in the fluid reservoir.

Optionally, the resilient material of the first septum is low elongation nitrile rubber and the fluid contained in the fluid reservoir is ink.

Optionally, the resilient material of the second septum is not compatible with the fluid contained in the fluid reservoir.

Optionally, the resilient material of the second septum is isoprene and the fluid contained in the fluid reservoir is ink.

In another aspect the present invention provides a septum assembly for a fluid container, the assembly comprising:

a first septum having a membrane which is piercable by a septum needle sealingly located within a fluid port of the fluid container which communicates with a fluid reservoir of the fluid container; and a second septum having a slit through which the septum needle passes sealingly located within the fluid port of the fluid container adjacent the first septum so that the septum needle passes through the slit of the second septum before piercing the first septum.

Optionally, the first and second septa are formed of resilient material.

Optionally, the resilient material of the first septum is compatible with the fluid contained in the fluid reservoir.

Optionally, the resilient material of the first septum is low elongation nitrile rubber and the fluid contained in the fluid reservoir is ink.

Optionally, the resilient material of the second septum is not compatible with the fluid contained in the fluid reservoir.

Optionally, the resilient material of the second septum is isoprene and the fluid contained in the fluid reservoir is ink.

Optionally, the first septum is circular in form with an annular seal formed at the circumferential edge which is configured to be pressed and deformed against the inner wall of the fluid port.

Optionally, the first septum has a frustoconical surface connecting the annular seal to a central portion of the first septum.

Optionally, the central portion is formed as a thin membrane which is pierceable by the septum needle.

Optionally, the thin membrane has radial score lines.

Optionally, the thin membrane has stress concentration geometry formed as a groove concentric with a central point of the membrane.

Optionally, the second septum is circular in form with two annular seals formed at the circumferential edge which are configured to be pressed and deformed against the inner wall of the fluid port.

Optionally, the first septum has an annular detent between the annular seals which connects the annular seals to a central portion of the second septum.

Optionally, the central portion has a slit through which the septum needle is able to sealingly pass.

In another aspect the present invention provides a system for reducing ink color mixing effects in a printer, the system comprising:

a printhead having multiple ink color channels mounted to a housing of the printer at a first level; and a plurality of ink supply cartridges mounted to the printer housing so as to be fluidically connected to the printhead and stacked in an array having a plurality of rows defining a plurality of levels which are lower than the first level, wherein the plurality of ink supply cartridges include at least one black ink supply cartridge which supplies black colored ink to a black ink color channel of the printhead, the black ink supply cartridge being disposed at the lowest level defined by the array.

Optionally, the plurality of ink supply cartridges include two black ink supply cartridges which supplies black colored ink to the black ink color channel of the printhead, a cyan ink supply cartridge which supplies cyan colored ink to a cyan ink color channel of the printhead, a magenta ink supply cartridge which supplies magenta colored ink to a magenta ink color channel of the printhead and a yellow ink supply cartridge which supplies yellow colored ink to a yellow ink color channel of the printhead.

Optionally, the array has three rows and three columns, the black ink supply cartridges being disposed at the lowest row in the first and third columns of the array, the magenta and cyan ink supply cartridges being disposed at the middle row in the first and third columns of the array and the yellow ink supply cartridge being disposed at the highest row in the second column of the array.

In another aspect the present invention provides a system for venting gas at ink containers which supply inks to a multi-channel inkjet printhead, the system comprising:

a plurality of ink containers for supplying fluids to a printhead having a plurality of ink channels, each ink container having an ink port connected to a corresponding one of the ink channels of the printhead and a gas port;

a gas vent assembly having a plurality of gas vents, each gas vent being connected to a corresponding one of the gas ports of the ink containers, wherein the gas vents of the gas vent assembly are in fluid communication with the external atmosphere.

Optionally, each gas vent comprises a tortuous path from an interior of that gas vent to the external atmosphere.

Optionally, the tortuous path is a serpentine path.

Optionally, the gas vent assembly comprises a body having an interior surface which defines a plurality of discrete chambers on one side of the body and a plurality of compartments on the opposite side of the body, the chambers and compartments being sealed within the body.

Optionally, the interior surface in each chamber has a recess in which apertures connect the chambers with one of the compartments through the interior surface.

Optionally, the recess of each chamber sealingly seats a filter.

Optionally, the filters comprise hydrophobic material.

Optionally, the hydrophobic material is expanded polytetrafluoroethylene.

Optionally, each chamber has a transfer port connected to the gas port of a corresponding one of the ink containers.

Optionally, each chamber is connected to a series of the compartments via the corresponding aperture in the interior surface.

Optionally, each compartment of each series of the compartments is linked by a tortuous path to an adjacent compartment of that series.

Optionally, the ultimate compartment of each series of the compartments which is furthest from the connecting aperture is fluidically open to the external atmosphere via a tortuous path.

Optionally, the each chamber has an overflow port connected to overflow tubing through which ink in that chamber can overflow.

Optionally, the each overflow port has a check valve so that back flow of ink from the connected overflow tubing is prevented.

Optionally, the check valves are elastomeric duckbill check valves.

In another aspect the present invention provides a multi-channel gas vent apparatus for venting gas at ink containers which supply inks to a multi-channel printhead, the apparatus comprising:

a body having a plurality of sidewalls and an interior surface;

a plurality of discrete chambers defined on one side of the interior surface by internal sidewalls and being sealed within the body, each chamber for connection to a gas port of a corresponding one of a plurality of ink containers, each ink container having an ink port connected to a corresponding one of the ink channels of the printhead; and a plurality of compartments defined on the opposite side of the interior surface by internal sidewalls and being sealed within the body, each compartment being in fluid communication with the external atmosphere, wherein the interior surface in each chamber has a recess in which apertures connect the chambers with one of the compartments through the interior surface.

Optionally, the recess of each chamber sealingly seats a filter.

Optionally, the filters comprise hydrophobic material.

Optionally, the hydrophobic material is expanded polytetrafluoroethylene.

Optionally, each chamber has a transfer port connected to the gas port of a corresponding one of the ink containers.

Optionally, each chamber is connected to a series of the compartments via the corresponding aperture in the interior surface.

Optionally, each compartment of each series of the compartments is linked by a tortuous path to an adjacent compartment of that series.

Optionally, the ultimate compartment of each series of the compartments which is furthest from the connecting aperture is fluidically open to the external atmosphere via a tortuous path.

Optionally, the each chamber has an overflow port connected to overflow tubing through which ink in that chamber can overflow.

Optionally, the each overflow port has a check valve so that back flow of ink from the connected overflow tubing is prevented.

Optionally, the check valves are elastomeric duckbill check valves.

In another aspect the present invention provides a printing system comprising:

a media width printhead;

a plurality of ink containers fluidically interconnected with the printhead via a respective plurality of ink tubes;

a plurality of gas vents fluidically interconnected with the printhead via a respective plurality of gas tubes;

a multi-channel valve arrangement for selectively moving a first pinch element into and out of pinching contact with the ink tubes so as to respectively block and allow fluid flow through the ink tubes and selectively moving a second pinch element into and out of pinching contact with the gas tubes so as to respectively block and allow fluid flow through the gas tubes.

Optionally, the multi-channel valve arrangement comprises:

a body;

a plurality of ink ports defined through the body, each ink port being configured to receive a respective one of the ink tubes therethrough;

a plurality of gas ports defined through the body, each gas port being configured to receive a respective one of the gas tubes therethrough; and a pinch drive arrangement for selectively moving the first and second pinch elements.

Optionally, the pinch drive arrangement comprises a shaft rotatably mounted to the body, eccentric cams fixedly mounted on the shaft, and springs interconnecting the first and second pinch elements to the shaft so that the eccentric cams contact the first and second pinch elements.

Optionally, each spring is formed as a bent spring having one spring portion connected to the first pinch element, a second spring portion connected to the second pinch element, and a central portion mounted about one end of the shaft.

Optionally, the first and second spring portions of each spring are configured to bias the first and second pinch elements toward the shaft, respectively.

Optionally, the springs are compression springs.

Optionally, the eccentric cams are configured so that rotation of the shaft causes said selective movement of the first and second pinch elements with or against the bias of the springs.

Optionally, the multi-channel valve arrangement further comprises a plurality of plurality of check valves, each check valve being located on a respective one of the gas tubes.

Optionally, the check valves are elastomeric duckbill check valves.

Optionally, each gas vent comprises a filter disposed at one end of the corresponding gas tube, the opposite end of the gas tube being connected to the printhead.

Optionally, the filters comprise expanded polytetrafluoroethylene

In another aspect the present invention provides a multi-channel valve apparatus for a multi-channel printhead, the apparatus comprising a plurality of ink ports defined through the body, each ink port being configured to receive therethrough a respective one of a plurality of ink tubes interconnecting a plurality of ink containers with the printhead;

a plurality of gas ports defined through the body, each gas port being configured to receive therethrough a respective one of a plurality of gas tubes interconnecting a plurality of gas vents with the printhead;

a first pinch element arranged to be moved into and out of pinching contact with the ink tubes so as to respectively block and allow fluid flow through the ink tubes;

a second pinch element arranged to be moved into and out of pinching contact with the gas tubes so as to respectively block and allow fluid flow through the gas tubes; and a pinch drive arrangement for selectively moving the first and second pinch elements.

Optionally, the pinch drive arrangement comprises a shaft rotatably mounted to the body, eccentric cams fixedly mounted on the shaft, and springs interconnecting the first and second pinch elements to the shaft so that the eccentric cams contact the first and second pinch elements.

Optionally, each spring is formed as a bent spring having one spring portion connected to the first pinch element, a second spring portion connected to the second pinch element, and a central portion mounted about one end of the shaft.

Optionally, the first and second spring portions of each spring are configured to bias the first and second pinch elements toward the shaft, respectively.

Optionally, the springs are compression springs.

Optionally, the eccentric cams are configured so that rotation of the shaft causes said selective movement of the first and second pinch elements with or against the bias of the springs.

Optionally, the multi-channel valve arrangement further comprises a plurality of plurality of check valves, each check valve being located on a respective one of the gas tubes.

Optionally, the check valves are elastomeric duckbill check valves.

Optionally, each gas vent comprises a filter disposed at one end of the corresponding gas tube, the opposite end of the gas tube being connected to the printhead.

Optionally, the filters comprise expanded polytetrafluoroethylene.

In another aspect the present invention provides a maintenance system for a printhead, the system comprising:

a support frame;

a wiper module supported by the support frame, the wiper module comprising a wiper roller on a rotatable shaft and a porous material about the shaft, and a transfer roller in rotatable contact with the wiper roller;

a lift mechanism for lifting the wiper module from the support frame to position the porous material of the wiper roller against the printhead; and a rotation mechanism for rotating the wiper and transfer rollers so that the porous material of the wiper roller rotates against the printhead, the porous material being configured to absorb fluid from the printhead during said rotation, and so that the fluid absorbed by the porous material of the wiper roller is transferred to the transfer roller.

Optionally, the wiper module further comprises a compressible core mounted to the shaft, the porous material being provided over the core; and the lift mechanism is configured to position the porous material against the printhead so as to compress the compressible core.

Optionally, the core is formed of extruded closed-cell foam.

Optionally, the transfer roller comprises a smooth hard cylinder which contacts the wiper roller so as to compress the compressible core.

Optionally, the porous material is formed of non-woven microfiber.

Optionally, the non-woven microfiber is wrapped about the core by a spiralling technique so that at least two layers of the microfiber are present about the core with an adhesive between the layers.

In another aspect the present invention provides an apparatus for maintaining a printhead, the apparatus comprising:

a rotatable wiper roller comprising a shaft and a porous material about the shaft;

a rotatable transfer roller in rotatable contact with the wiper roller; and a mechanism for rotating the wiper roller so that the porous material rotates against the printhead, the porous material being configured to absorb fluid from the printhead during said rotation, and for rotating the transfer roller against the wiper roller so that the fluid absorbed by the porous material is transferred to the transfer roller.

Optionally, the printhead is a media width printhead, and the wiper and transfer rollers are elongate with a longitudinal length of at least the media width.

Optionally, the wiper and transfer rollers are rotatably mounted to a wiper module supported by a sled.

Optionally, the transfer roller is mounted to the wiper module so that the transfer roller contacts the wiper roller on a vertical circumferential region of the wiper roller below the upper circumferential region of the wiper roller which contacts the printhead.

Optionally, the wiper roller comprises a compressible core mounted to the shaft, the porous material being provided over the core.

Optionally, the porous material is formed of non-woven microfiber.

Optionally, the non-woven microfiber is wrapped about the core by a spiralling technique so that at least two layers of the microfiber are present about the core with an adhesive between the layers.

Optionally, the transfer roller comprises a smooth hard cylinder.

Optionally, the smooth hard cylinder is mounted to the wiper module so that contact pressure is exerted on the compressible core of the wiper roller.

In another aspect the present invention provides a maintenance system for a printhead, the system comprising:

a support frame;

a wiper module supported by the support frame, the wiper module comprising a porous roller for rotatably contacting the printhead to absorb fluid and particulates from the printhead, a non-porous roller in rotatable contact with the porous roller to transfer the absorb fluid and particulates from the porous roller, and a scraper in contact with the non-porous roller to remove the transferred fluid and particulates from the non-porous roller during said rotation;

a lift mechanism for lifting the wiper module from the support frame to position the porous roller against the printhead; and a rotation mechanism for rotating the porous and non-porous rollers so that the porous roller rotates against the printhead and the non-porous roller is rotated against the porous roller and the scraper.

Optionally, the porous roller comprises porous material over a compressible core; and the lift mechanism is configured to position the porous material against the printhead so as to compress the compressible core.

Optionally, the core is formed of extruded closed-cell foam.

Optionally, the non-porous roller comprises a smooth hard cylinder which contacts the porous roller so as to compress the compressible core.

Optionally, the porous material is formed of non-woven microfiber.

Optionally, the scraper is resiliently flexible.

In another aspect the present invention provides an apparatus for maintaining a printhead, the apparatus comprising:

a rotatable porous roller;

a rotatable non-porous roller in rotatable contact with the porous roller;

a scraper in contact with the non-porous roller; and a mechanism for rotating the porous and non-porous rollers so that the porous roller rotates against the printhead and the non-porous roller is rotated against the porous roller and the scraper, the porous roller being configured to absorb fluid and particulates from the printhead during said rotation, the non-porous roller being configured to transfer the absorbed fluid and particulates from the porous roller, and the scraper being configured to clean the transferred fluid and particulates from the non-porous roller during said rotation.

Optionally, the printhead is a media width printhead, and the porous and non-porous rollers and scraper are elongate with a longitudinal length of at least the media width.

Optionally, the porous and non-porous rollers are rotatably mounted to a wiper module supported by a sled.

Optionally, the non-porous roller is mounted to the wiper module so that the non-porous roller contacts the porous roller on a vertical circumferential region of the porous roller below the upper circumferential region of the porous roller which contacts the printhead.

Optionally, the porous roller comprises porous material over a compressible core.

Optionally, the porous material is formed of non-woven microfiber.

Optionally, the non-porous roller comprises a smooth hard cylinder.

Optionally, the smooth hard cylinder is mounted to the wiper module so that contact pressure is exerted on the compressible core of the porous roller.

Optionally, the scraper is mounted to the wiper module so that the scraper contacts the non-porous roller on a vertical circumferential region of the non-porous roller below the upper circumferential region of the non-porous roller which contacts the porous roller.

Optionally, the scraper is resiliently flexible.

In another aspect the present invention provides a wiping device for maintaining a printhead, the wiping device comprising:

a body supported within a maintenance unit of the printer;

a porous roller rotatably mounted to the body, the body being configured to be lifted from the maintenance unit so as bring the porous roller into contact with a printhead of the printer; and a mechanism mounted to the body for rotating the porous roller so that the porous roller rotates against the printhead wiping the printhead clean, the mechanism being connectable to a power supply of the printer and being configured to be lifted from the maintenance unit together with the body whilst connected to the power supply.

Optionally, the printhead is a media width printhead, and the porous roller is elongate with a longitudinal length of at least the media width.

Optionally, the mechanism comprises a motor and a gear train connected between a gear of the motor and a gear of the porous roller, the motor and gear train being mounted within the body.

Optionally, the motor is powered through a flexible connection with the power supply of the printer.

Optionally, the device further comprises a non-porous roller rotatably mounted to the body in contact with the porous roller, wherein the mechanism rotates the non-porous roller so that the non-porous roller rotates against the porous roller cleaning the porous roller.

Optionally, the mechanism comprises a motor and a gear train connected between a gear of the motor and gears of the porous and non-porous rollers, the motor and gear train being mounted within the body.

Optionally, the motor is powered through a flexible connection with the power supply of the printer.

Optionally, the porous roller comprises porous material over a compressible core.

Optionally, the non-porous roller comprises a smooth hard cylinder.

Optionally, the smooth hard cylinder is mounted to the body so that contact pressure is exerted on the compressible core of the porous roller.

In another aspect the present invention provides a maintenance system for a printhead, the system comprising:

a sled;

a wiper module supported by the sled, the wiper module comprising rotatable porous and non-porous rollers in contact with one another;

a lift mechanism for lifting the wiper module from the sled to position the porous roller against the printhead;

a rotation mechanism for rotating the porous and non-porous rollers so that the porous roller of the lifted wiper module rotates against the printhead and the non-porous roller rotates against the porous roller, the porous roller being configured to absorb fluid from the printhead during said rotation and the non-porous roller being configured to clean the absorbed fluid from the porous roller; and a sliding mechanism for sliding the sled relative to the printhead so that the rotating porous roller is wiped across the printhead.

Optionally, the rotation mechanism is mounted to the wiper module and is connectable to a power supply of the printhead such that the rotation mechanism is lifted from the sled together with the wiper module whilst connected to the power supply.

Optionally, the mechanism comprises a motor and a gear train connected between a gear of the motor and gears of the porous and non-porous rollers, the motor and gear train being mounted on the wiper module.

Optionally, the motor is powered through a flexible connection with the power supply of the printhead.

Optionally, the sliding mechanism comprises a rack on each end of the sled corresponding to each end of the wiper module, and a pinion gear on each end of a shaft so as to each couple with a corresponding one of the racks and a motor.

Optionally, the porous roller comprises porous material over a compressible core; and the lift mechanism is configured to position the porous material against the printhead so as to compress the compressible core.

Optionally, the non-porous roller comprises a smooth hard cylinder.

Optionally, the smooth hard cylinder is mounted to the wiper module so that contact pressure is exerted on the compressible core of the porous roller.

In another aspect the present invention provides a system for transporting media in a printer, the system comprising:

a housing of the printer;

at least one roller rotatably mounted to the housing for transporting media through the printer;

a motor mounted to the housing;

a drive belt looped about a drive shaft of the motor and the roller so as to impart rotational driving force of the motor to the roller;

a tensioning member pivotally mounted to the housing for contacting and thereby tensioning the drive belt about the motor drive shaft and roller, the pivoted position of the tensioning member relative to the housing determining the amount of tension imparted on the drive belt;

a brace member mounted to the housing about a slotted arm of the tensioning member; and a locking screw fixed to the housing through the brace member and slotted arm to lock the pivoted position of the tensioning member, the brace member being fixedly mounted to the housing so that rotation of the locking screw is not imparted to the slotted arm during fixing of the locking screw to the housing.

Optionally, the system further comprises a spring for biasing a bushing of the tensioning member against the drive belt thereby imparting the tension on the drive belt.

Optionally, the brace member is elongate and has pins at either end which are snugly received within respective holes of the housing such that the brace member is unable to rotate relative to the housing.

Optionally, the slotted arm has a curved slot through which a screw hole of the housing is exposed through plural pivoted positions of the tensioning member.

Optionally, the brace member has a hole which is aligned with the exposed screw hole in the housing.

Optionally, the locking screw is fixed within the exposed screw hole via the hole in the brace member.

Optionally, the system comprises a plurality of rollers rotatably mounted to the housing for transporting media through the printer, wherein the drive belt is looped about each of the rollers so as to impart rotational driving force of the motor to the rollers.

In another aspect the present invention provides a drive belt tensioning apparatus for a printer, the apparatus comprising:

a tensioning member pivotally mounted to a housing of the printer so as to contact and thereby tension a drive belt about a drive shaft of a motor and at least one roller so as to impart rotational driving force of the motor to the roller for transporting media through the printer, the pivoted position of the tensioning member relative to the housing determining the amount of tension imparted on the drive belt;

a brace member mounted to the housing about a slotted arm of the tensioning member; and a locking screw fixed to the housing through the brace member and slotted arm to lock the pivoted position of the tensioning member, the brace member being fixedly mounted to the housing so that rotation of the locking screw is not imparted to the slotted arm during fixing of the locking screw to the housing Optionally, the apparatus further comprises a spring for biasing a bushing of the tensioning member against the drive belt thereby imparting the tension on the drive belt.

Optionally, the brace member is elongate and has pins at either end which are snugly received within respective holes of the housing such that the brace member is unable to rotate relative to the housing.

Optionally, the slotted arm has a curved slot through which a screw hole of the housing is exposed through plural pivoted positions of the tensioning member.

Optionally, the brace member has a hole which is aligned with the exposed screw hole in the housing.

Optionally, the locking screw is fixed within the exposed screw hole via the hole in the brace member.

In another aspect the present invention provides a system for aligning driven and idler rollers in a printer, the system comprising:

a housing of the printer, the housing having a first housing portion hingedly mounted to a second housing portion such that the second housing portion is movable with respect to the first housing portion between open and closed positions;

at least one driven roller rotatably mounted to the first housing portion for transporting media through the printer;

at least one idler roller rotatably supported within the second housing portion for contact with the driven roller so as to provide pinched contact on the transported media; and an alignment adjustment mechanism for aligning the idler roller with the driven roller as the second housing portion is hinged into the closed position with the first housing portion.

Optionally, the driven roller is rotatably mounted to the first housing portion by bearing members which are fixedly mounted to the first housing portion.

Optionally, the idler roller is rotatably supported by a pinch housing constrained within the pinch roller assembly mounted to the second housing portion, the pinch housing being movable with respect to the second housing portion.

Optionally, the alignment adjustment mechanism comprises slots defined in the bearing members and alignment pins defined on the pinch housing, the alignment pins being configured to engage with the slots as the second housing portion is hinged to the closed position with the first housing portion, said engagement causing said movement of the pinch housing relative to the second housing portion thereby aligning the idler and driven rollers.

Optionally, the slots of the bearing members have sloped outer surfaces which funnel the alignment pins into the slots as the second housing portion is hinged to the closed position with the first housing portion.

In another aspect the present invention provides a pinch roller apparatus for a printer, the apparatus comprising:

a support plate securely mounted to a housing of the printer;

a pinch housing movably supported by the support plate; and a series of pinch rollers rotatably held within the pinch housing, wherein the pinch housing has alignment pins for engagement with the housing of the printer through said movement of the pinch housing relative to the support plate, said engagement aligning the pinch rollers with a driven roller rotatably mounted to the housing to provide pinched contact for media being transported through the printer.

Optionally, the printhead is a media width printhead, and the support plate and pinch housing are elongate with a longitudinal length of at least the media width such that the series of pinch rollers extends along the media width.

Optionally, the pinch housing is linked to the support plate by springs at either longitudinal end of the pinch housing and support plate.

Optionally, the apparatus further comprises a mounting plate securely mounted to the housing of the printer, the support plate being securely mounted to the mounting plate, the mounting plate having tabs on which the pinch housing is held.

Optionally, the housing of the printer has a first housing portion hingedly mounted to a second housing portion, the support plate being securely mounted to the second housing portion and the driven roller being rotatably mounted to the first housing portion.

Optionally, the alignment pins of the pinch housing engage with the housing of the printer as the second housing portion is hinged into a closed position with the first housing portion.

Optionally, the driven roller is rotatably mounted to the first housing portion by bearing members which are fixedly mounted to the first housing portion, the alignment pins being configured to engage with slots in the bearing members as the second housing portion is hinged to the closed position with the first housing portion, said engagement causing said movement of the pinch housing relative to the second housing portion thereby aligning the pinch and driven rollers.

Optionally, an axle of each pinch roller is rotatably held within a corresponding slot of the pinch housing by a respective lever member, the lever members being pivotally supported by the support plate and movably supported by the pinch housing.

Optionally, the apparatus further comprises springs between the lever members and the mounting plate, the springs being configured so that the lever members are biased away from the mounting plate thereby urging the pinch rollers toward the driven roller.

In another aspect the present invention provides a pinch roller assembly for a printer having a media width printhead, the assembly comprising:

an elongate support plate securely mounted to a housing of the printer so as to extend along the media width;

two elongate pinch housings movably supported on either side the support plate so as to extend along the media width; and a series of pinch rollers rotatably held within each pinch housing so as to extend along the media width, wherein the pinch housings have alignment pins for engagement with the housing of the printer through said movement of the pinch housings relative to the support plate, said engagement aligning the series of pinch rollers with a respective driven roller rotatably mounted to the housing to provide pinched contact for media being transported through the printer.

Optionally, the pinch housings are linked to the support plate by springs at either longitudinal end of the pinch housings and support plate.

Optionally, the assembly further comprises a mounting plate securely mounted to the housing of the printer, the support plate being securely mounted to the mounting plate, the mounting plate having tabs on which the pinch housings are held.

Optionally, the housing of the printer has a first housing portion hingedly mounted to a second housing portion, the support plate being securely mounted to the second housing portion and the driven rollers being rotatably mounted to the first housing portion.

Optionally, the alignment pins of the pinch housings engage with the housing of the printer as the second housing portion is hinged into a closed position with the first housing portion.

Optionally, the driven rollers are rotatably mounted to the first housing portion by bearing members which are fixedly mounted to the first housing portion, the alignment pins being configured to engage with slots in the bearing members as the second housing portion is hinged to the closed position with the first housing portion, said engagement causing said movement of the pinch housings relative to the second housing portion thereby aligning the pinch and driven rollers.

Optionally, an axle of each pinch roller is rotatably held within a corresponding slot of the corresponding pinch housing by a respective lever member, the lever members being pivotally supported by the support plate and movably supported by the pinch housings.

Optionally, the assembly further comprises springs between the lever members and the mounting plate, the springs being configured so that the lever members are biased away from the mounting plate thereby urging the pinch rollers toward the driven rollers.

BRIEF DESCRIPTION OF DRAWINGS

The exemplary features, best mode and advantages of the invention will be understood by the description herein with reference to accompanying drawings, in which.

One of ordinary skill in the art will appreciate that the invention is not limited in its application to the details of construction, the arrangements of components, and the arrangement of steps set forth in the following detailed description and/or illustrated in the accompanying drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF EMBODIMENTS

Figure 1:
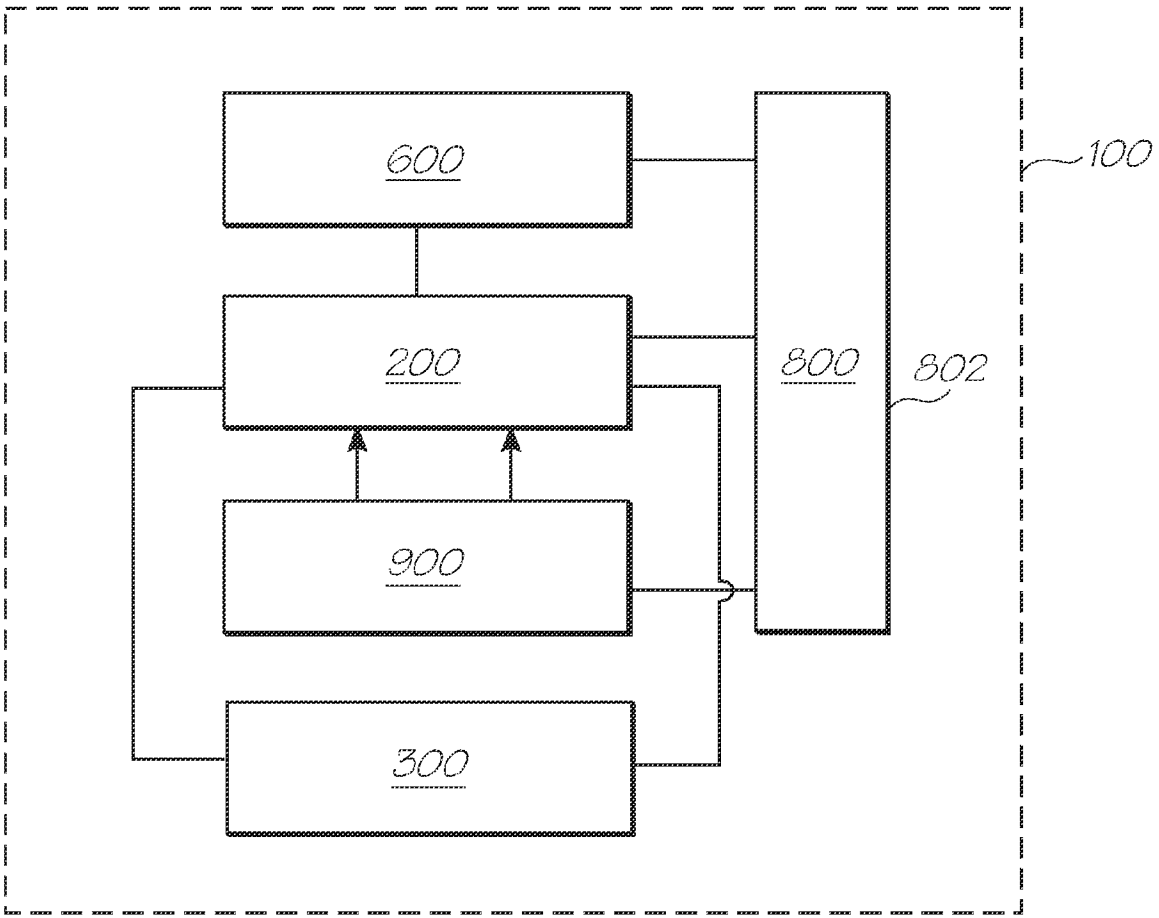
FIG. 1 is a block diagram of the main system components of a printer.
Figure 2:
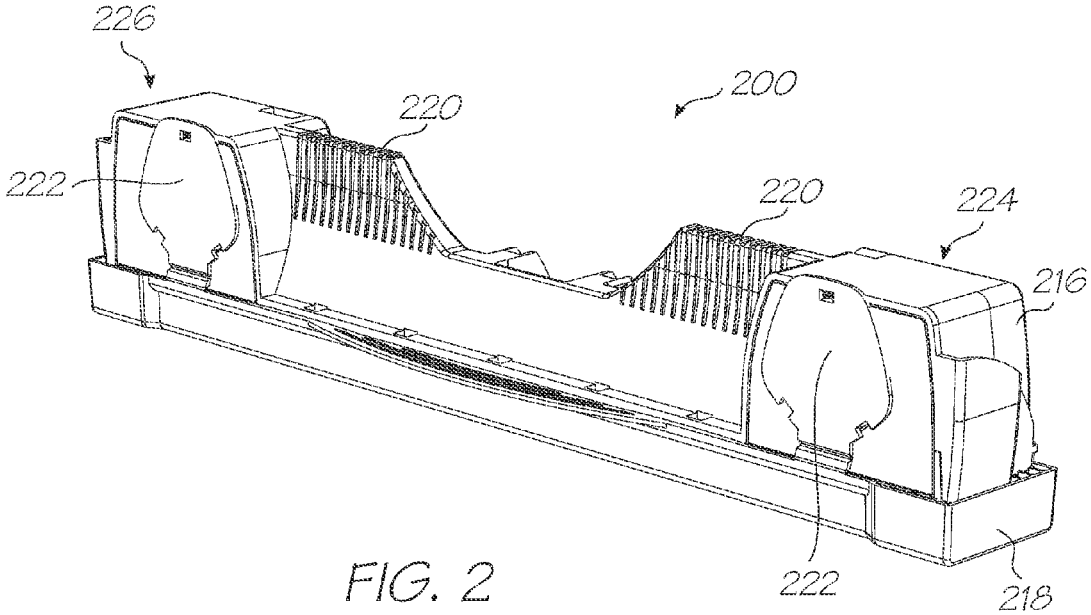
FIG. 2 is a perspective view of a printhead of the printer.

An exemplary block diagram of the main system components of a printer 100 is illustrated in FIG. 1. The printer 100 has a printhead 200, fluid distribution system 300, maintenance system 600, electronics 800 and media handling system 900.

The printhead 200 has fluid ejection nozzles for ejecting printing fluid, such as ink, onto passing print media. The fluid distribution system 300 distributes ink and other fluids for ejection by the nozzles of the printhead 200. The maintenance system 600 maintains the printhead 200 so that reliable and accurate fluid ejection is provided from the ejection nozzles. The media handling system 900 provides transport and guidance of media past the printhead 200 for printing.

The electronics 800 operatively interconnects the electrical components of the printer 100 to one another and to external components/systems. The electronics 800 has control electronics 802 for controlling operation of the connected components. An exemplary configuration of the control electronics 802 is described in US Patent Application Publication No. 20050157040, the contents of which are hereby incorporated by reference.

The printhead 200 may be provided as a media width printhead cartridge removable from the printer 100, as described in US Patent Application Publication No. 20090179940, the contents of which are hereby incorporated by reference. This exemplary printhead cartridge includes a liquid crystal polymer (LCP) molding 202 supporting a series of printhead ICs 204, as illustrated in FIGS. 2-5, which extends the width of media substrate to be printed. When mounted to the printer 100, the printhead 200 therefore constitutes a stationary, full media width printhead.

The printhead ICs 204 each comprise ejection nozzles for ejecting drops of ink and other printing fluids onto the passing media substrate. The nozzles may be MEMS (micro electromechanical) structures printing at true 1600 dpi resolution (that is, a nozzle pitch of 1600 nozzles per inch), or greater. The fabrication and structure of suitable printhead ICs 204 are described in detail in US Patent Application Publication No. 20070081032, the contents of which are hereby incorporated by reference.

The LCP molding 202 has main channels 206 extending the length of the LCP molding 202 between associated inlet ports 208 and outlet ports 210. Each main channel 206 feeds a series of fine channels (not shown) extending to the other side of the LCP molding 202. The fine channels supply ink to the printhead ICs 204 through laser ablated holes in the die attach film via which the printhead ICs are mounted to the LCP molding, as discussed below.

Above the main channel 206 is a series of non-priming air cavities 214. These cavities 214 are designed to trap a pocket of air during printhead priming. The air pockets give the system some compliance to absorb and damp pressure spikes or hydraulic shocks in the printing fluid. The printers are high speed pagewidth or media width printers with a large number of nozzles firing rapidly. This consumes ink at a fast rate and suddenly ending a print job, or even just the end of a page, means that a column of ink moving towards (and through) the printhead 200 must be brought to rest almost instantaneously. Without the compliance provided by the air cavities 214, the momentum of the ink would flood the nozzles in the printhead ICs 204. Furthermore, the subsequent 'reflected wave' could otherwise generate sufficient negative pressure to erroneously deprime the nozzles.

The printhead cartridge has a top molding 216 and a removable protective cover 218. The top molding 216 has a central web for structural stiffness and to provide textured grip surfaces 220 for manipulating the printhead cartridge during insertion and removal with respect to the printer 100. Movable caps 222 are provided at a base of the cover and are movable to cover an inlet printhead coupling 224 and an outlet printhead coupling 226 of the printhead 200 prior to installation in the printer. The terms "inlet" and "outlet" are used to specify the usual direction of fluid flow through the printhead 200 during printing. However, the printhead 200 is configured so that fluid entry and exit can be achieved in either direction along the printhead 200.

Figure 3:
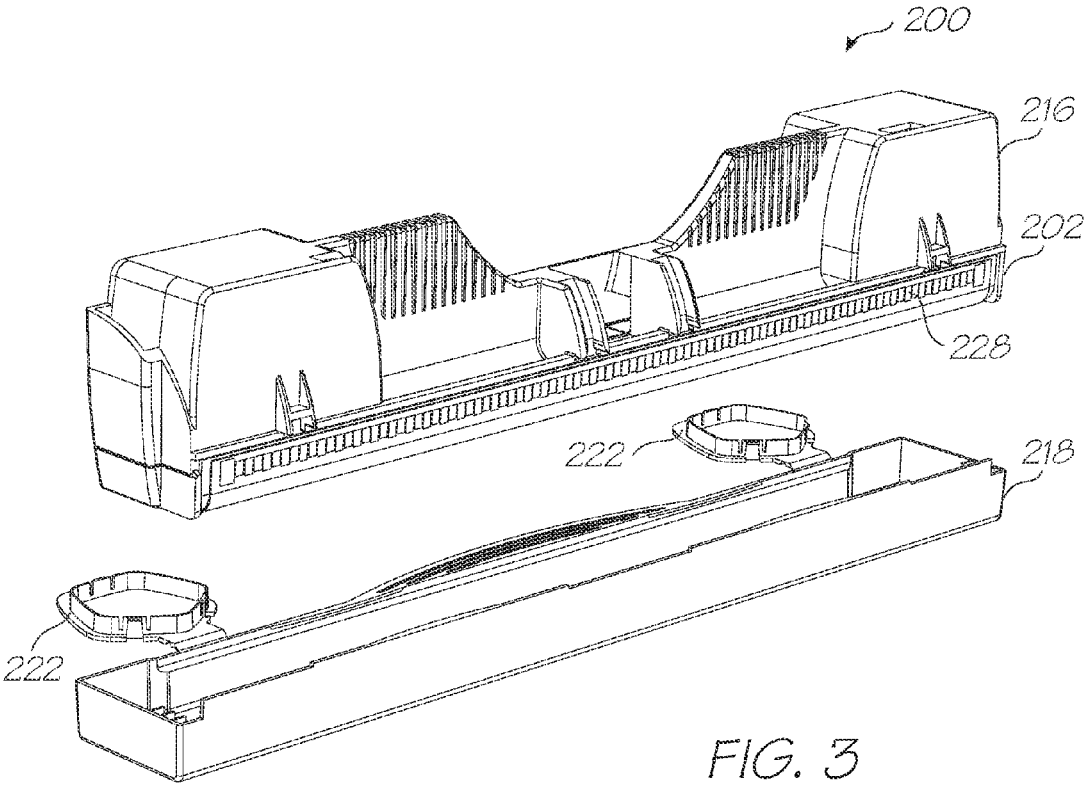
FIG. 3 illustrates the printhead with a cover removed.

The base of the cover 218 protects the printhead ICs 204 and electrical contacts 228 of the printhead prior to installation in the printer and is removable, as illustrated in FIG. 3, to expose the printhead ICs 204 and the contacts 228 for installation. The protective cover may be discarded or fitted to a printhead cartridge being replaced to contain leakage from residual ink therein.

Figure 4:
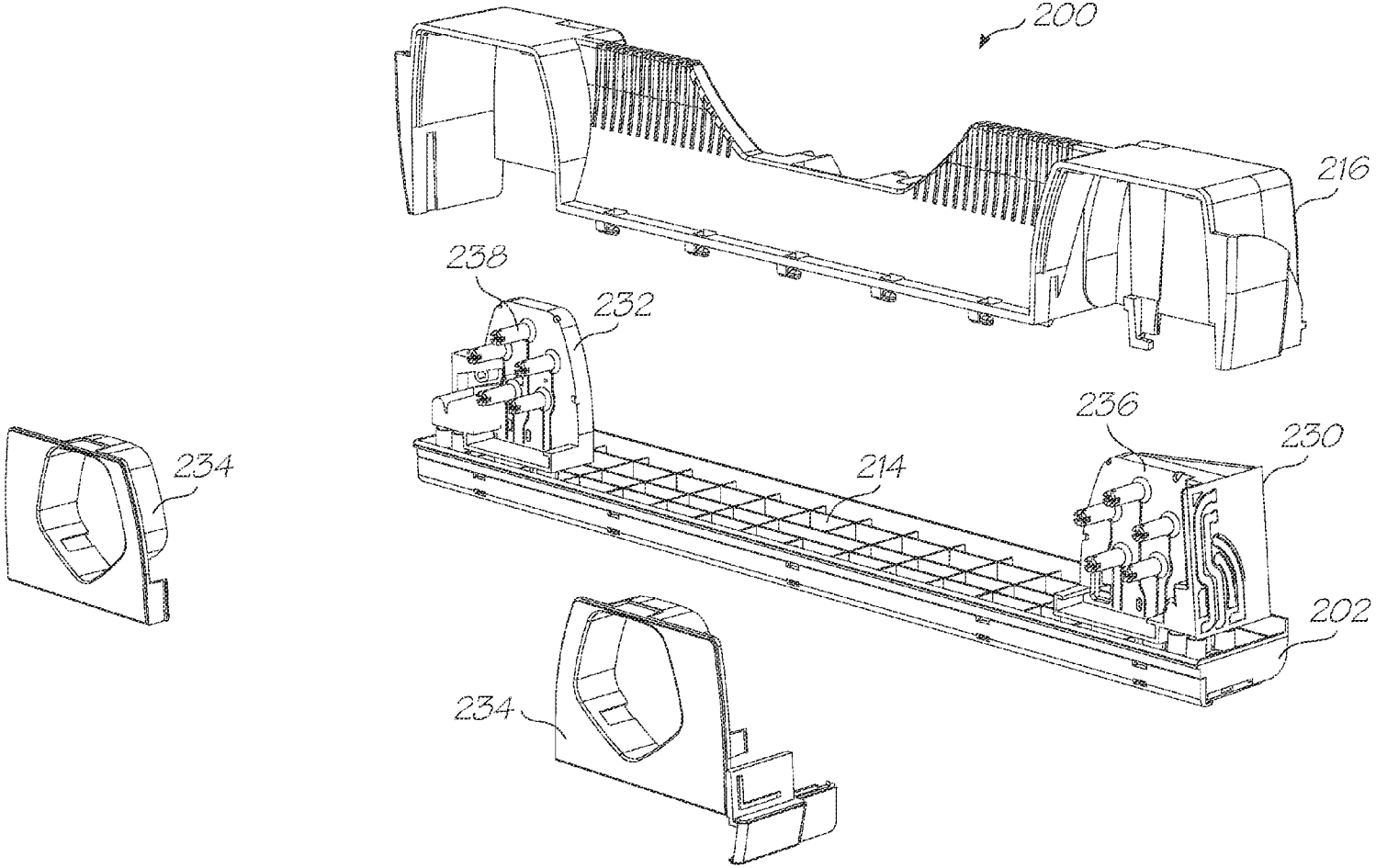
FIG. 4 is an exploded view of the printhead.

The top molding 216 covers an inlet manifold 230 of the inlet coupling 224 and an outlet manifold 232 of the outlet coupling 226 together with shrouds 234, as illustrated in FIG. 4. The inlet and outlet manifolds 230,232 respectively have inlet and outlet spouts 236,238. Five each of the inlet and outlet ports or spouts 236,238 are shown in the illustrated embodiment of the printhead 200, which provide for five ink channels, e.g., CYMKK or CYMKIR. Other arrangements and numbers of the spouts are possible to provide different printing fluid channel configurations. For example, instead of a multi-channel printhead printing multiple ink colors, several printheads could be provided each printing one or more ink colors.

Each inlet spout 236 is fluidically connected to a corresponding one of the inlet ports 208 of the LCP molding 202. Each outlet spout 238 is fluidically connected to a corresponding one of the outlet ports 210 of the LCP molding 202. Thus, for each ink color, supplied ink is distributed between one of the inlet spouts 236 and a corresponding one of the outlet spouts 238 via a corresponding one of the main channels 206.

Figure 5:
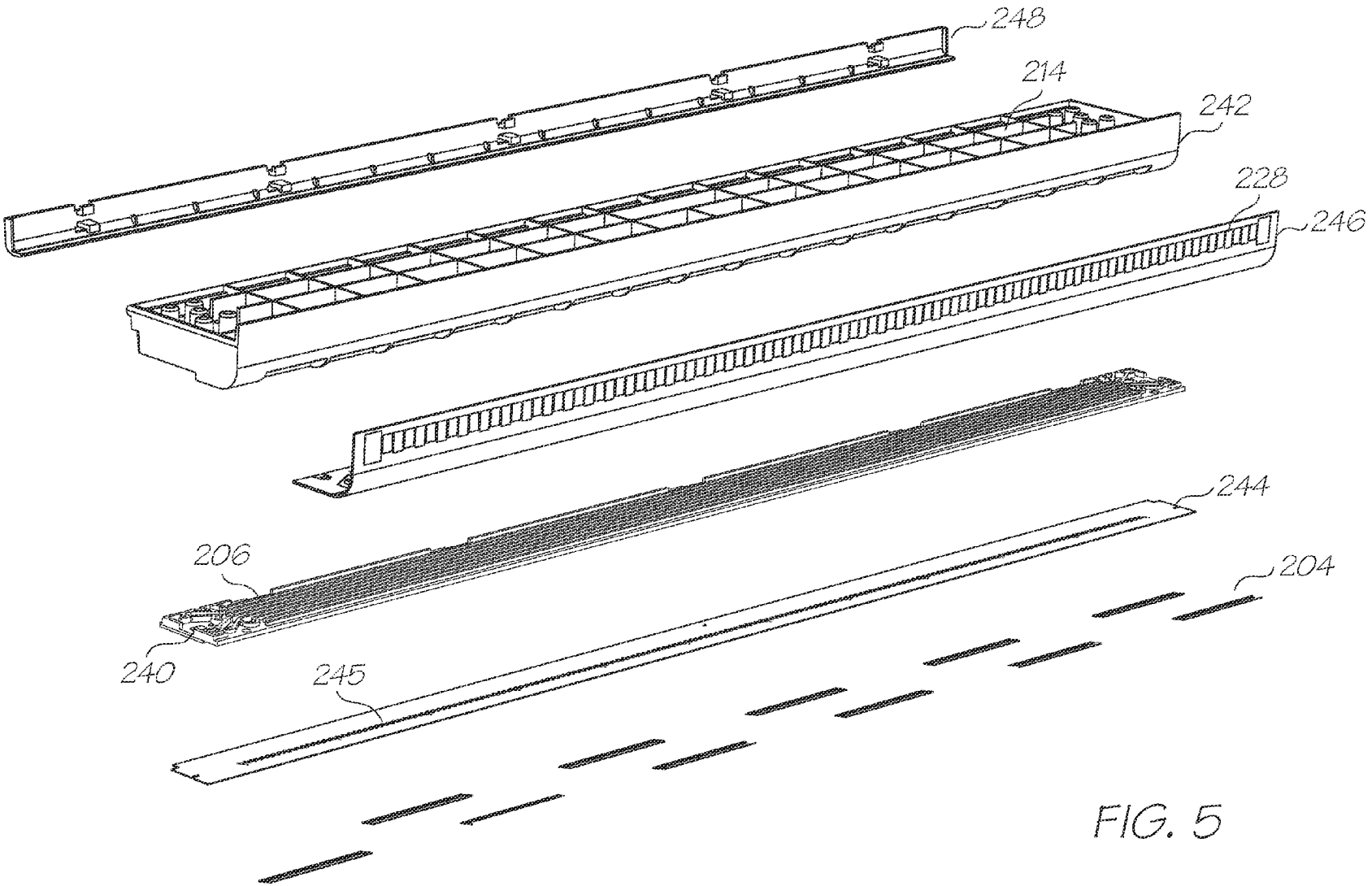
FIG. 5 is an exploded view of the printhead without inlet or outlet couplings.

From FIG. 5 it can be seen that the main channels 206 are formed in a channel molding 240 and the associated air cavities 214 are formed in a cavity molding 242. Adhered to the channel molding 240 is a die attach film 244. The die attach film 244 mounts the printhead ICs 204 to the channel molding 240 such that the fine channels, which are formed within the channel molding 240, are in fluid communication with the printhead ICs 204 via small laser ablated holes 245 through the film 244.

The channel and cavity moldings 240,244 are mounted together with a contact molding 246 containing the electrical contacts 228 for the printhead ICs and a clip molding 248 in order to form the LCP molding 202. The clip molding 248 is used to securely clip the LCP molding 202 to the top molding 216.

LCP is the preferred material of the molding 202 because of its stiffness, which retains structural integrity along the media width length of the molding, and its coefficient of thermal expansion which closely matches that of silicon used in the printhead ICs, which ensures good registration between the fine channels of the LCP molding 202 and the nozzles of the printhead ICs 204 throughout operation of the printhead 200. However, other materials are possible so long as these criteria are met.

Figure 6:
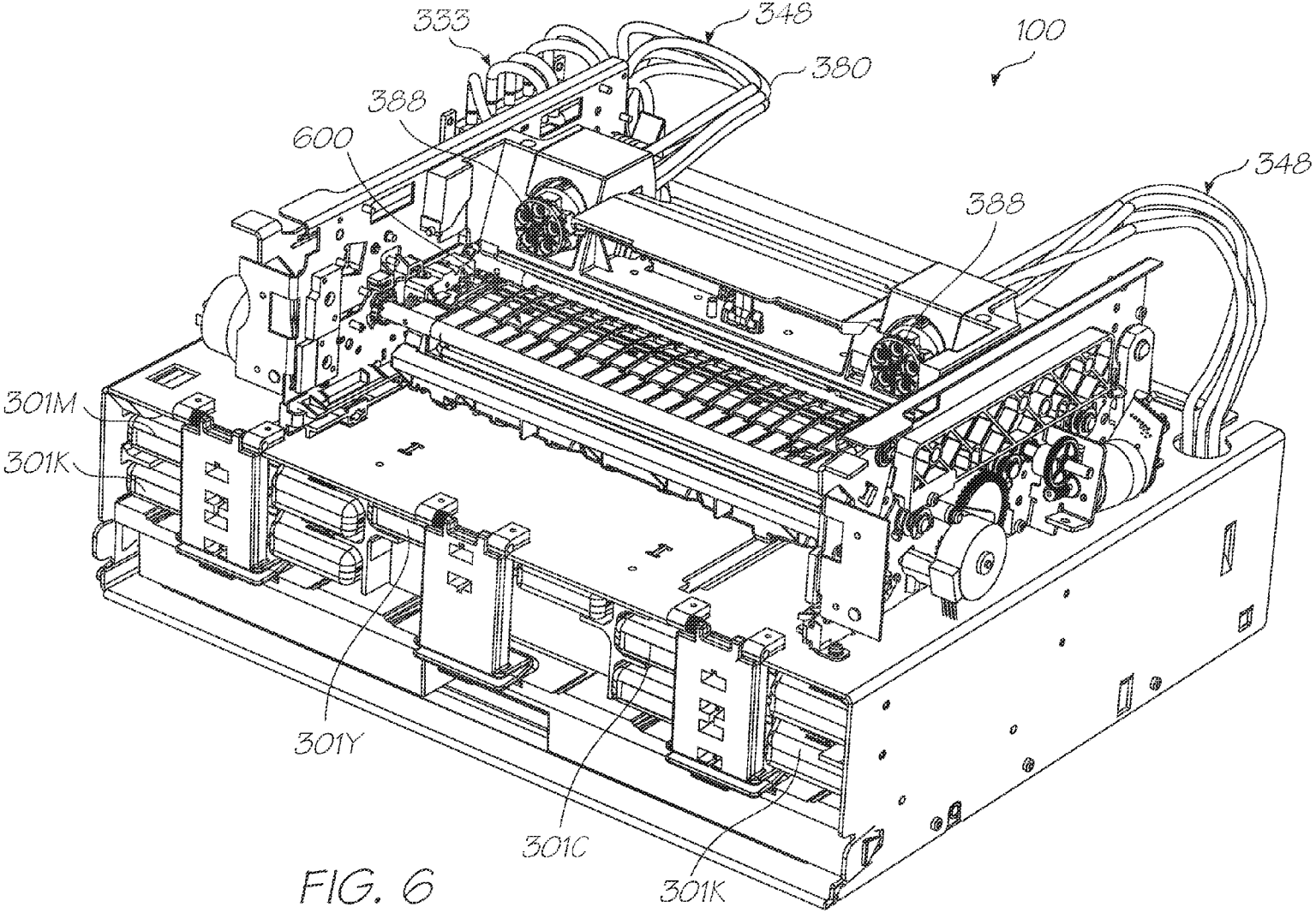
FIG. 6 illustrates an exemplary embodiment of the printer with most components other than those of fluid distribution, maintenance and media handling systems for the printer omitted.
Figure 7:
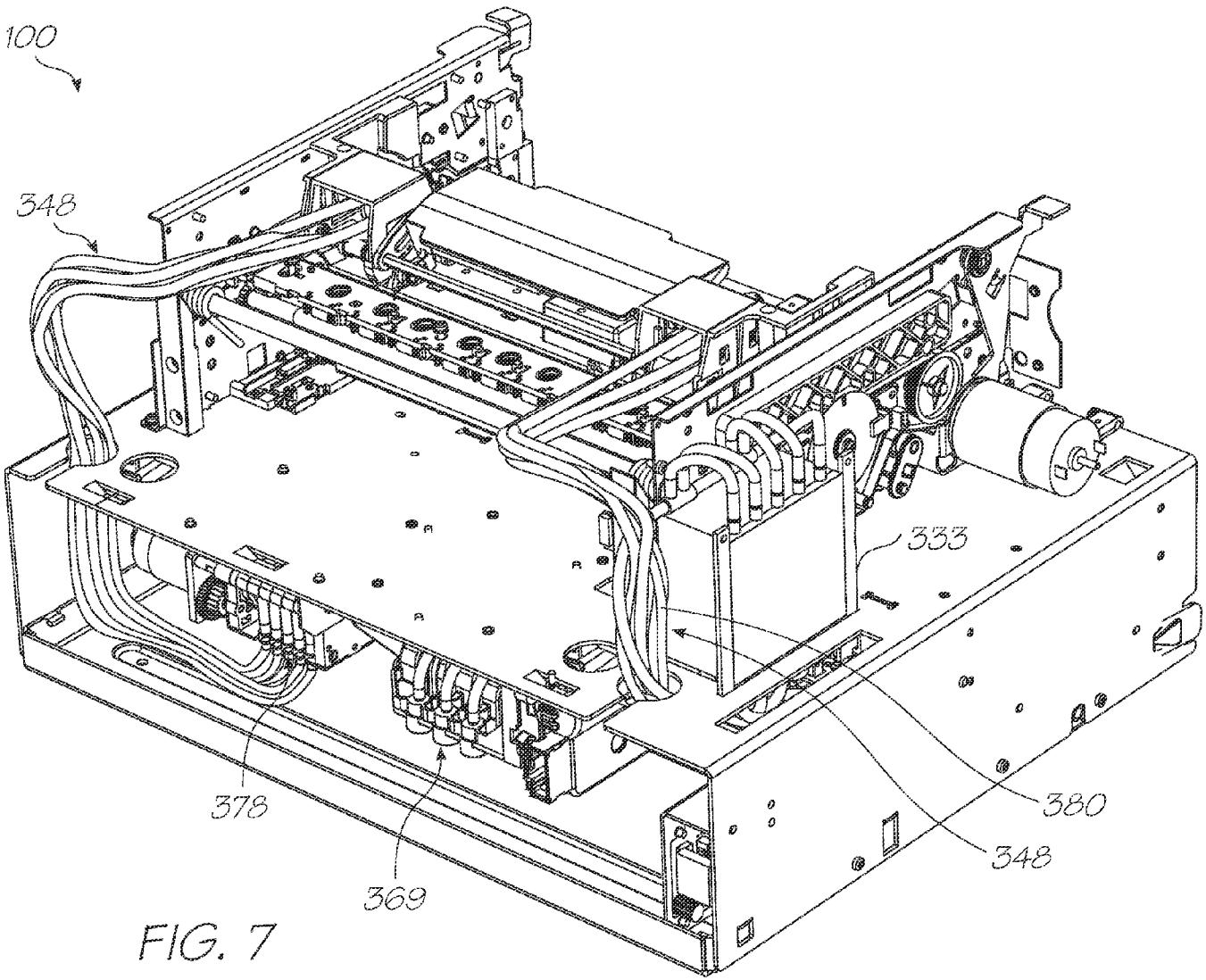
FIG. 7 illustrates an opposite view of the printer as illustrated in FIG. 6.
Figure 8:
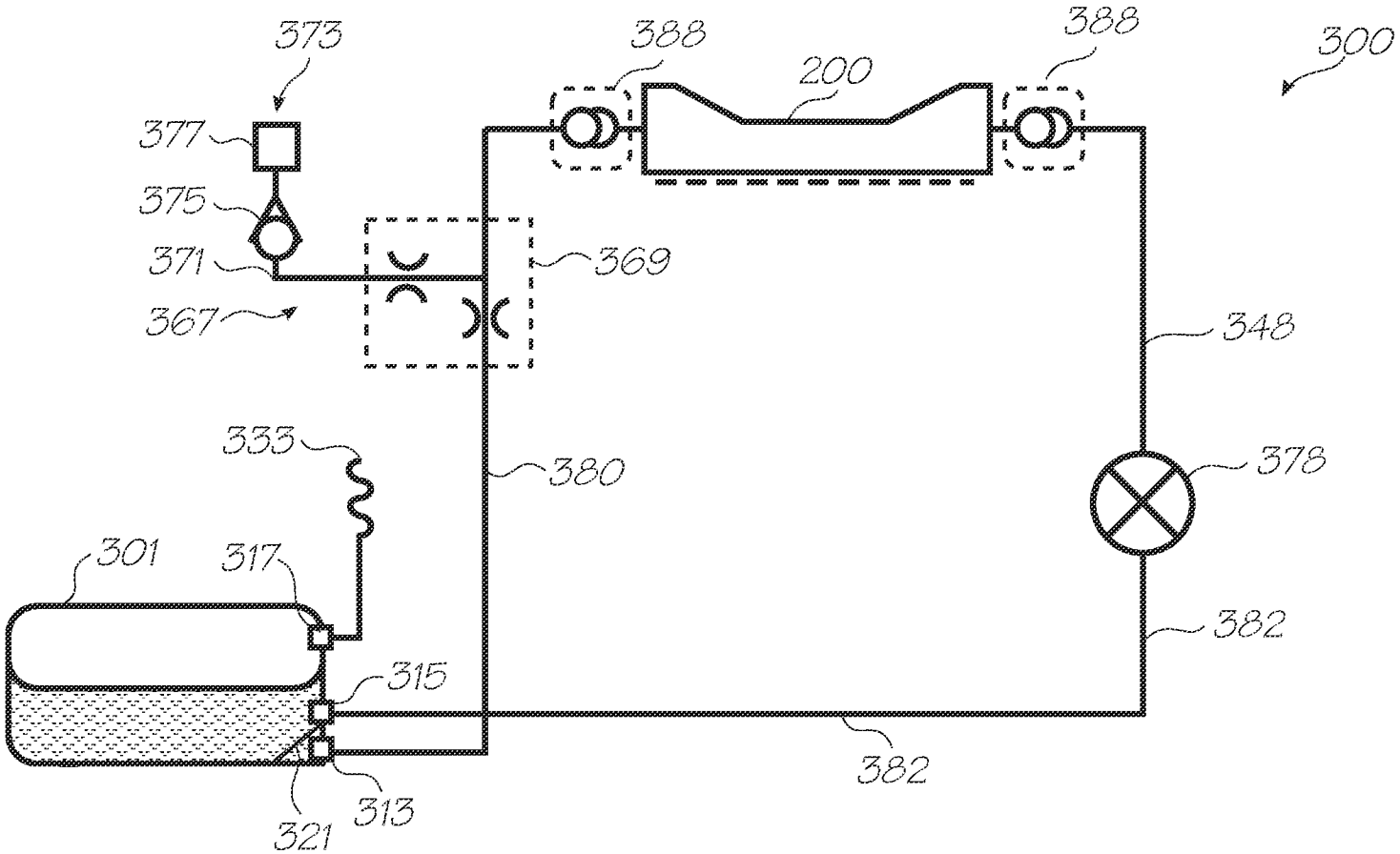
FIG. 8 schematically illustrates an exemplary embodiment of the fluid distribution system.

The fluid distribution system 300 may be arranged in the printer 100 for the multiple fluid channels of the printhead 200 as illustrated in FIGS. 6 and 7. FIG. 8 schematically illustrates the fluid distribution system 300 for a single fluid channel, e.g., for a single colored ink or other printing fluid, such as ink fixing agent (fixative). The illustrated embodiment is similar in arrangement and operation as the pinch and check valve embodiment of the fluid distribution system described in the Applicant's US Provisional Patent Application No. 61/345,552.

The present embodiment of the fluid distribution system differs from the identified embodiment of the incorporated description of the Applicant's US Provisional Patent Application No. 61/345,552 in the provision of fluid supply cartridges and a 2-way pinch valve. These and other components of the present fluid distribution system 300 of FIG. 8 are now described in detail. Where suitable, the same reference numerals for the same components of the incorporated description of the Applicant's US Provisional Patent Application No. 61/345,552 are used. The present embodiment of the fluid distribution system provides a simple, passive and gravity fed fluid (ink) distribution system for the printhead.

The fluid distribution system 300 has sealed containers 301 (herein termed fluid supply cartridges) which contain ink or other fluid/liquid for supply to the printhead 200 via a closed fluid loop 348. In the illustrated embodiment of FIGS. 6 and 7, five supply cartridges 301 and five closed fluid loops 348 are provided for the above-discussed five ink channels of the printhead 200. The fluid supply cartridges of the present embodiment are provided in place of the supply and accumulator tanks of the incorporated Applicant's US Provisional Patent Application No. 61/345,552. The manner in which the five supply cartridges 301 are mounted to a housing 101 of the printer 100 is discussed later.

Figure 11:
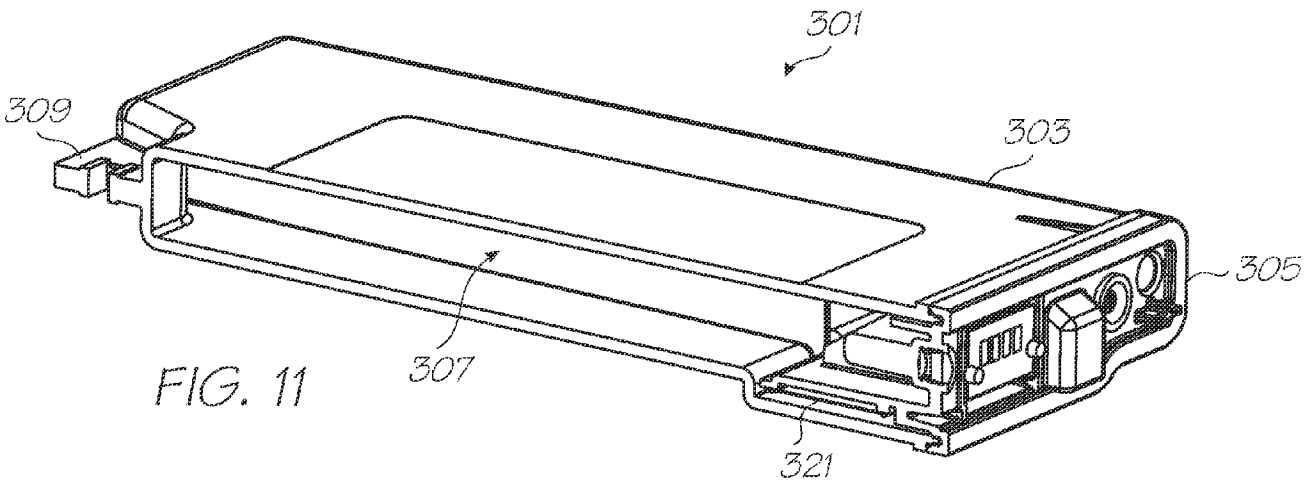
FIG. 11 is a cross-sectional view of the fluid supply cartridge taken through line A-A of FIG. 9.

FIGS. 9-12 illustrate one of the supply cartridges 301. As illustrated, the supply cartridge 301 has a body 303 which is sealed with respect to liquids by a lid 305. The body 303 may be molded from two parts 303*a* and 303*b* which are joined and hermitically sealed by ultrasonic welding so as to provide an opening 303*c* onto which the lid 305 assembled. Alternatively, the body 303 may be molded as a single unit. The body 303 has a flange 303*d* about the periphery of the opening 303*c* which is received within a groove 305*a* of the lid 305*a*, as illustrated in FIG. 11. The assembled body 303 and lid 305 are joined and hermitically sealed by ultrasonic welding so as to form a sealed fluid reservoir.

The body 303 (and the lid 305) is preferably formed of a material which is inert in ink, has a low water vapor transmission rate (WVTR), can be ultrasonically welded and is not susceptible to sympathetic ultrasonic welding when the lid 305 is ultrasonically welded to the body 303. Suitable materials are polyethylene terephthalate (PET) and a combination of polyphenylene ether and polystyrene, such as Noryl 731. The ultrasonic welding used is preferably a dual shear joint that creates a strong hermetic seal and is tolerant to variation in size between the two components. However, other ultrasonic welding or other joining and sealing techniques are possible.

One, or both, of the parts 303*a* and 303*b* of the body 303 is formed with one or more internal ribs 307. The internal ribs 307 drastically improve the rigidity of the supply cartridge 301. This improved rigidity reduces deformation in the cartridge under conditions of positive or negative pressurization, such as occurs during shipping and under conditions of shock which can occur during shipping and handling of the cartridge and/or printer. Improved rigidity also may lead to stronger joints between the cartridge components. A handle 309 is formed as part of the body 303 which provides a grip surface for a user to grasp the supply cartridge 301 without deforming the cartridge, thereby further protecting the sealed cartridge joints.

Figure 12:
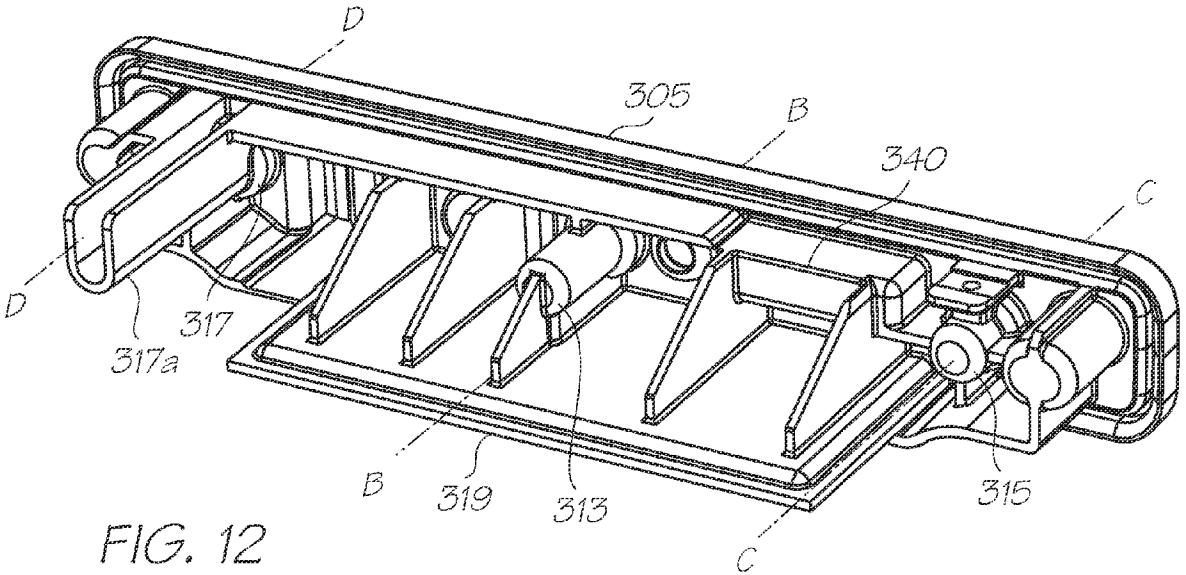
FIG. 12 illustrates a lid of the fluid supply cartridge.
Figure 13A:
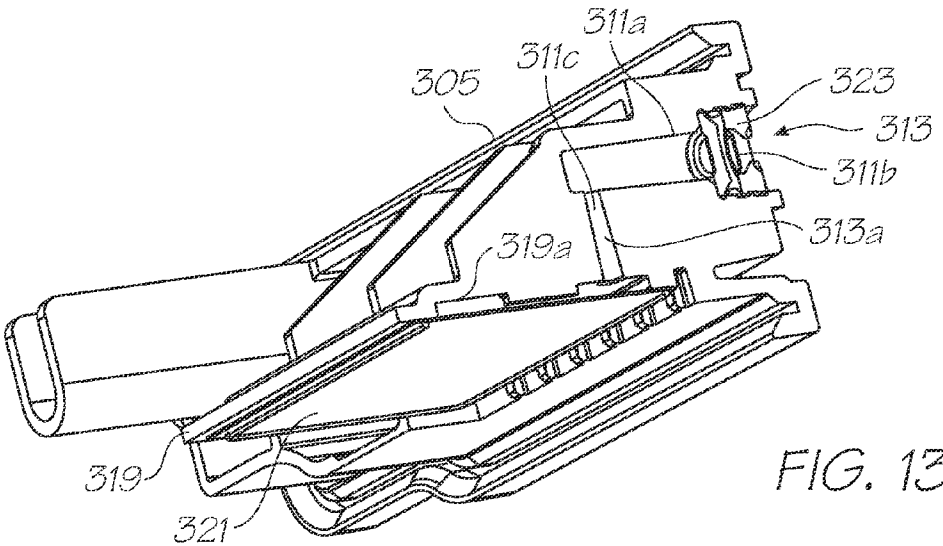
FIG. 13A is a cross-sectional view of the lid taken through line B-B of FIG. 12.
Figure 13B:
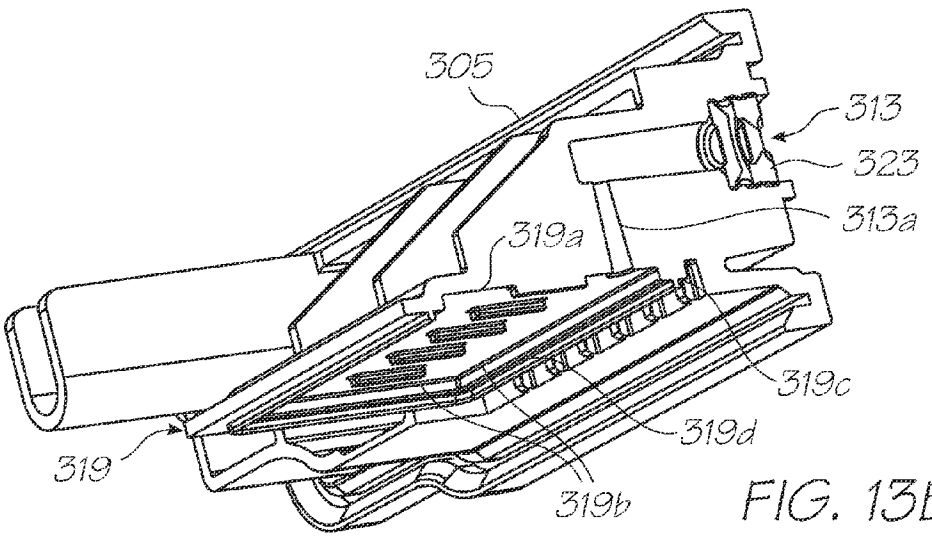
FIG. 13B illustrates the lid of FIG. 13A with a filter omitted.
Figure 14:
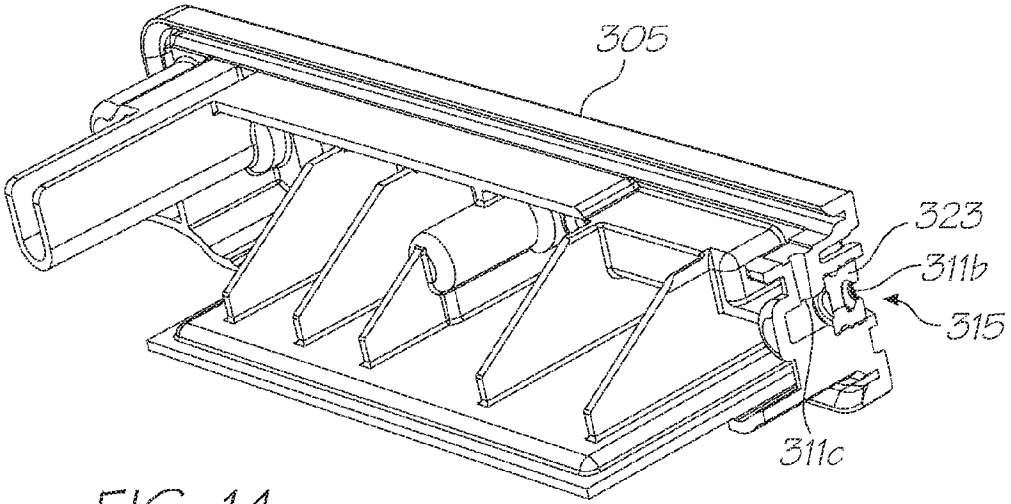
FIG. 14 is a cross-sectional view of the lid taken through line C-C of FIG. 12.

The lid 305 of the supply cartridge 301 is illustrated in detail in FIGS. 12-14. As illustrated, the lid 305 has three sealable fluid ports 311. The ports 311 serve the following functions: a fluid outlet port 313; a gas port 315; and a fluid inlet (or return) port 317. Ink or other printing fluids contained in the supply cartridge 301 can be drawn through the outlet 313 into the closed fluid loop 348 and returned via the closed loop 348 to the supply cartridge 301 through the inlet 317. Whilst the gas port 315 allows gases, such as ambient air and internal vapours, to pass into and out of the supply cartridge 301. This arrangement allows the internal gas pressure of the supply cartridge 301 to be equalized to external ambient conditions.

Each of the ports 311 has an internal channel 311*a* which communicates with the exterior of the cartridge 301 at an external aperture 311*b* and communicates with the interior fluid reservoir of the cartridge 301 at an internal aperture 311*c*. The internal aperture 311*c* of the outlet 313 is formed as a channel 313*a* which communicates with a filter compartment 319 formed on the lid 305. As illustrated in FIGS. 13A and 13B, the filter compartment 319 has a plate 319*a* into which the channel 313*a* opens and sidewalls 319*b* projecting from the periphery of the plate 319*a*. A ridge 319*c* is formed on the outer surfaces of the sidewalls 319*b* to define a peripheral seat 319*d*. The peripheral seat 319*d* receives a filter 321 for removing particles from the ink, or other fluid, contained in the fluid reservoir before the fluid exits through the outlet 313 and ultimately reaches the printhead 200 through the closed loop 348.

The filter 321 is used to filter contaminants from the ink so that the ink reaching the printhead 200 is substantially contaminant-free. The filter 321 is formed of a material which is compatible with the ink stored by the supply cartridge 301 and allows fluid transfer through the filter but prevents particulate transfer. The use of the "compatible" herein is understood to mean that the material said to be "compatible" with the ink does not break down or alter due to prolonged contact with the ink and does not change the characteristics of the ink in any way.

Preferably, the filter 321 is a polyester mesh having a pore size of one micron. Such a mesh filter 321 is preferably mounted on the seat 319*d* of the filter compartment 319 by heat staking or the like so that the filter is sealed about its periphery to the transfer of particles. Providing the supply cartridges with an internal filter obviates the need for filtration within the closed fluid loop 348.

Figure 15:
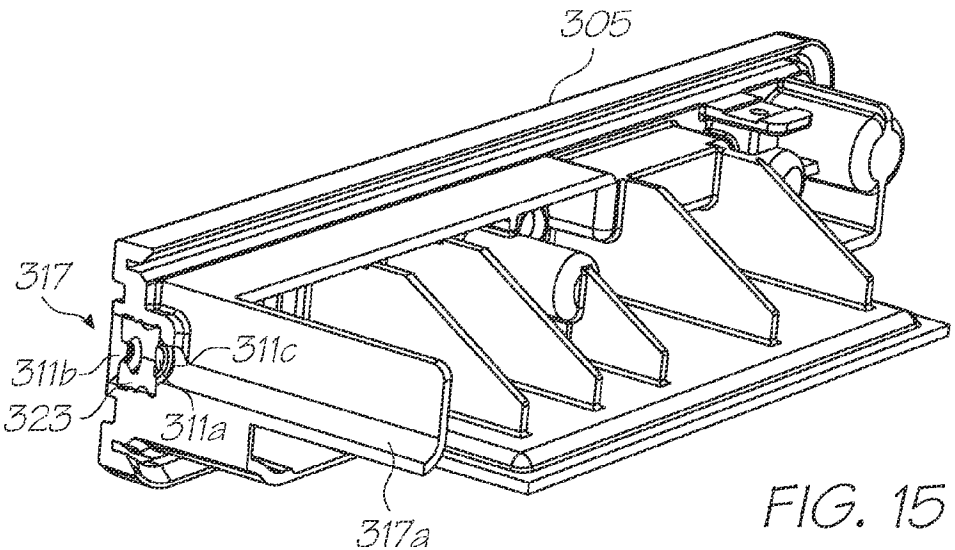
FIG. 15 is a cross-sectional view of the lid taken through line D-D of FIG. 12.

The internal aperture 311*c* of the inlet 317 communicates with the interior fluid reservoir of the cartridge 301 via a chute 317*a*, as illustrated in FIGS. 12 and 15. The internal aperture 311*c* of the gas port 315 is formed as a channel 315*a* which communicates with the interior fluid reservoir of the cartridge 301, as illustrated in FIG. 14.

Figure 16:
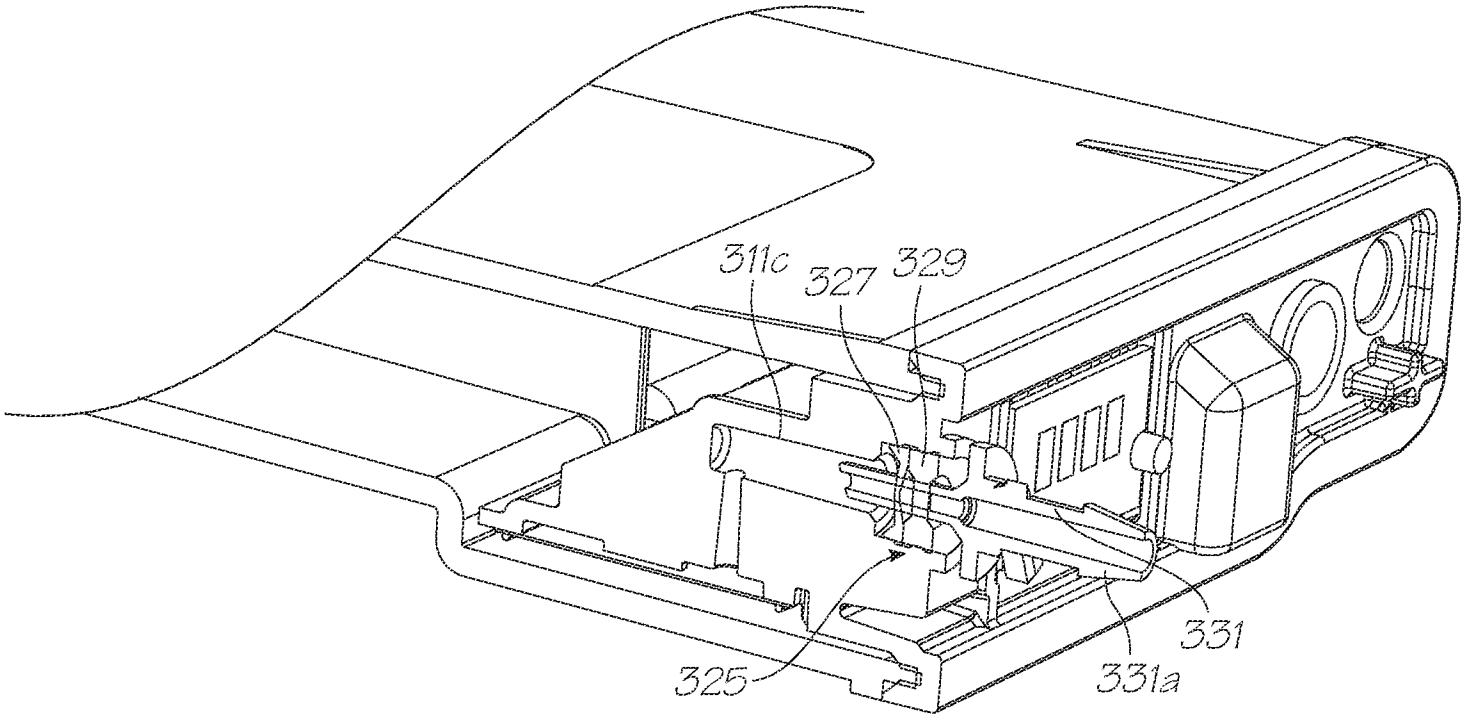
FIG. 16 illustrates a portion of the cross-sectional view of FIG. 13A showing a septum needle for a fluid port of the fluid supply cartridge.

The external aperture 311*b* of each port 311 is formed as a bore which receives a septum 323, as illustrated in FIGS. 13A, 14 and 15, for connection to tubing. In the exemplary embodiment illustrated in FIGS. 16-18B, each septum 323 is provided as a dual septum 325. Each dual septum 325 is an assembly of two adjacent septa being a pierceable septum 327 and a slit septum 329, which together form a leak proof barrier. The leak proof barrier of the dual septa 325 is sealingly penetrated by a corresponding septum needle 331 to allow fluid flow through the ports 311, as illustrated in FIG. 16. Each septum needle 331 has a barb 331*a* as a connector of tubing of the closed fluid loop 348, for the outlet and inlet 313,317, and of tubing of a gas vent or air chimney 333, for the gas port 315.

The combined pierceable and slit septa provide a redundant disengageble and compact fluid port and prevent fluid leakage under the following conditions: (1) before the septum needle has been inserted; (2) while the septum needle is inserted; and (3) after the septum needle has been removed. These conditions are met in the following manner.

The pierceable septum 327 is assembled as the innermost of the septa 327,329 within the bore 311*b* of the corresponding port 311 and as such is in contact with the fluid contained in the cartridge 301 during transportation and storage, and during printing. Therefore, the pierceable septum 327 is formed from a resilient material that is compatible with the fluid in the cartridge 301 and which provides a fluid-tight seal against the bore 311*b* and the septum needle 331. Preferably, the pierceable septum 327 is formed from an elastomeric material, such as low elongation nitrile rubber.

Figure 17C:
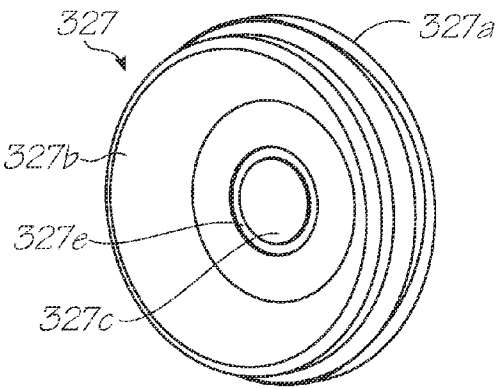
FIGS. 17C and 17D illustrate different views of another exemplary embodiment of a piercable septum of the fluid port.
Figure 17D:
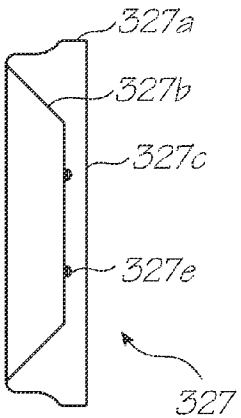
Figure 17A:
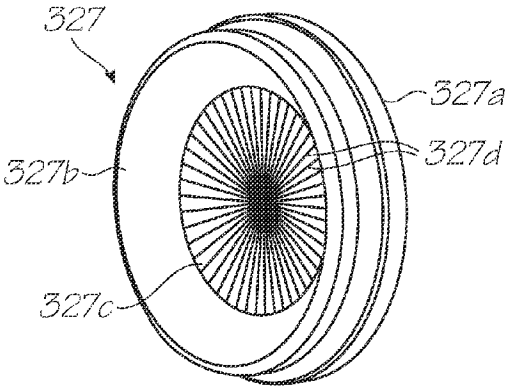
FIGS. 17A and 17B illustrate different views of one exemplary embodiment of a piercable septum of the fluid port.
Figure 17B:
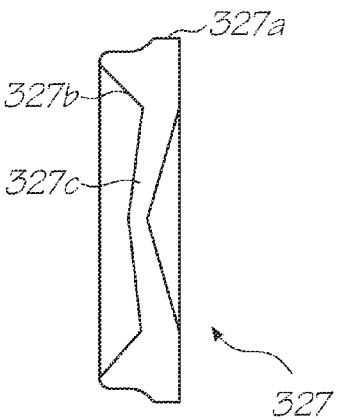

The pierceable septum 327 is circular in form and can be configured as illustrated in the two embodiments illustrated in FIGS. 17A and 17B and in FIGS. 17C and 17D. In both embodiments, the pierceable septum 327 has an annular ridge or seal 327*a* formed at its circumferential edge which is configured to press against the inner wall of the bore 311*b*. This contact pressure deforms the annular ridge 327*a* providing a barrier to the passage of fluid around the circumferential edge of the pierceable septum 327. This deformation is constrained by forming the portion of the pierceable septum 327 interior to the annular ridge 327*a* as a frustoconical surface 327*b*. The surface 327*b* provides rigidity of the inner portions of the pierceable septum 327 which prevents roll and de-sealing of the annular seal 327*a*. The surface 327*b* plateaus at the central portion of the pierceable septum 327 which is formed as a thin membrane 327*c*.

Preferably, the elastomeric material of the pierceable septum 327 has low tear strength. This material selection together with radial score lines 327*d* formed in the membrane 327*c* of the first embodiment illustrated in FIGS. 17A and 17B, and stress concentration geometry 327*e* formed as a groove in the membrane 327*c* concentric with the central point of the membrane 327*c* of the second embodiment illustrated in FIGS. 17C and 17D, make piercing of the membrane 327*c* easier, with less stretch and lower required force, when the septum needle 331 pierces or punctures the pierceable septum 327 during first insertion. After being punctured, the elastomeric material of the pierced surface 327*b* maintains a compressive grip around the inserted septum needle 331 which minimizes communication of fluid across the pierced boundary. Accordingly, the materially compatible resilient seal provided by the pierceable septum 327 prevents fluid leakage under at least the afore-mentioned conditions (1) and (2). A suitable elastomeric material of the pierceable septum 327 is low elongation nitrile rubber.

The slit septum 329 is assembled as the outermost of the septa 327,329 within the bore 311*b* of the corresponding port 311 and as such is not in contact with the fluid contained in the cartridge 301 during transportation and storage. Therefore, the material of the slit septum 329 does not need to be fully compatible with the fluid contained in the cartridge 301. However, the slit septum 329 is required to provide a fluid-tight seal against the bore 311*b* and the septum needle 331, and is therefore also preferably formed from an elastomeric material.

Figure 18A:
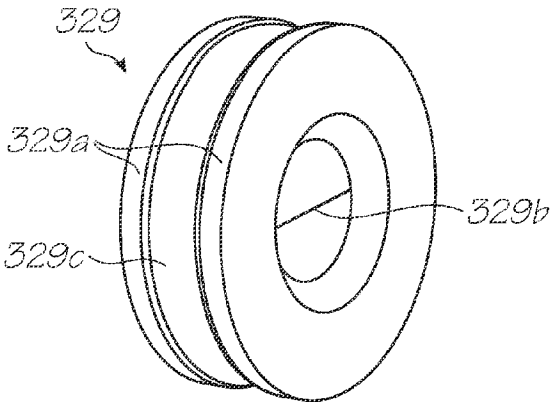
FIGS. 18A and 18B illustrate different views of a slit septum of the fluid port.
Figure 18B:
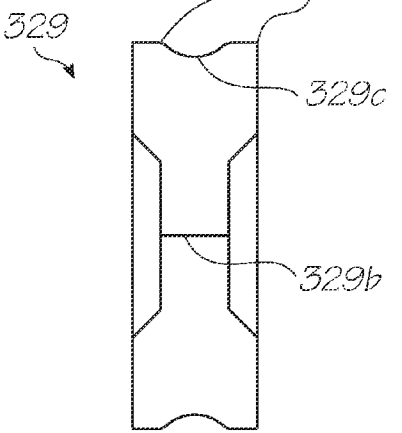

The slit septum 329 is circular in form, as illustrated in FIGS. 18A and 18B, and has two redundant annular ridges or seals 329*a* formed at its circumferential edges which are configured to press against the inner wall of the bore 311*b*. This contact pressure deforms the annular ridges 329*a* providing a barrier to the passage of fluid around the circumferential edges of the slit septum 329. The central portion of the slit septum 329 has a slit 329*b* which is closed and sealed by the contact pressure created by the compression of the annular seals 329*a* so that fluid is prevented from leaking through the closed slit 329*b*. The septum needle 331 is passed through the slit 329*b* and on through the piercable membrane 327*c* of the pierceable septum 327 during first insertion. After insertion, the elastomeric material about the slit 329*b* maintains a compressive grip around the inserted septum needle 331 which minimizes communication of fluid across the slit boundary. Further, after withdrawal of the septum needle 331 the elastomeric material of the slit 329*b* recloses the slit 329*b* which re-seals the slit septum 329.

The slit septum 329 has an annular detent 329*c* between the two annular seals 329*a* which provides a volume into which the elastomeric material of the septum deforms when the septum needle 331 is inserted through the slit 329*b*. Accordingly, the possibly materially incompatible resilient seal provided by the slit septum 329 prevents fluid leakage under all of the afore-mentioned conditions (1), (2) and (3). A suitable elastomeric material of the slit septum 329 is isoprene.

The superior sealing properties of the slit septa means that the material of the pierceable septa can have poor elastomeric properties, e.g., low tear strength, which increases the range of available materials which can be chosen to provide good compatibility with the fluid contained by the supply cartridge. For example, for the inks used by the MEMJET™ printers of the Applicant, only elastomeric sealing materials having poor elastomeric properties are compatible with the inks in terms of swell, low particle shedding, and other desired characteristics. If single septa constructed of such poor elastomeric property materials were used, fluid leakage can occur around the outer surface of the septum or along the surfaces penetrated by the septum needle, because the elastomeric material does not conform well to the surfaces that they are sealing against. Thus, by using the dual septa 325, each port 311 is able to function as a reliably sealed fluid port even when the fluid contained in the cartridge 301 is materially incompatible with one of the two elastomeric seals formed by the dual septa 325. Furthermore, the dual septa 325 provide multiple redundant sealing surfaces to prevent fluid leakage before, during and after use of the fluid supply cartridge.

In the illustrated example, there are a total of three redundant annular seals around the outer edges of the two septa 327,329, and two redundant seals around the inserted septum needle 331. However, other arrangements are possible having different numbers of redundant external and internal seals, so long as the redundancy reduces the likelihood of fluid leakage at different points during the life cycle of the seal The dual septum 325 of the gas port 315 is connected to a vent line 335 of the gas vent 333. The vent line 335 is in the form of tubing connected to the barb 331*a* of the septum needle 331 at one end and to a filter 337 at the other end. The filter 337 is preferably formed of a hydrophobic material, such as ePTFE, so that air exclusive of water vapor and the like is able to enter the vent line 335 from the ambient environment. Preferably, the hydrophobic material of the filter 337 is expanded polytetrafluoroethylene (ePTFE, known as Gore-Tex® fabric) which has these gas transit properties. The use of the term "hydrophobic" herein is to be understood as meaning that any liquid, not only water, is repelled by the material which is said to be "hydrophobic".

The amount of fluid within the supply cartridge is monitored by a sensing arrangement 340. The sensing arrangement 340 senses the level of fluid contained within the supply cartridge and outputs the sensing result to the control electronics 802 of the printer 100. For example, the sensing result can be stored in a quality assurance (QA) device 342 of the supply cartridge which interconnects with a QA device of the control electronics 802, as described in previously referenced and incorporated US Patent Application Publication No. 20050157040.

In the illustrated embodiment of FIGS. 9-12, the sensing arrangement 340 has a prism and associated sensor incorporated in the lid 305 of the supply cartridge at a position which accords to a fluid level providing the predetermined fluid containing capacity of the supply cartridge. As understood by one of ordinary skill in the art in such a sensing arrangement, the sensor emits light of a certain wavelength into the prism and detects returning light and the wavelength of the returning light.

When fluid is present in the supply cartridge at the level providing the predetermined fluid containing capacity (herein termed "full level"), the light emitted by the sensor is refracted by the prism back to the sensor as returning light at a first wavelength. In this case, the sensing arrangement 340 provides a signal which indicates a "full" fluid level to the control electronics 802.

When fluid is present in the supply cartridge at a first level less than the full level (herein termed the "low level"), the light emitted by the sensor is refracted by the prism back to the sensor as returning light at a second wavelength different than the first wavelength. In this case, the sensing arrangement 340 provides a signal which indicates a "low" fluid level to the control electronics 802.

When fluid is present in the supply cartridge at a second level less than the first level (herein termed the "out level"), the light emitted by the sensor passes through the prism such that no returning light is sensed by the sensor. In this case, the sensing arrangement 340 provides a signal which indicates an "out" fluid level to the control electronics 802.

The drawing of ink from the supply cartridge into the closed loop 348 reduces the level of ink within the supply cartridge from the full level to the low level and then the out level. Relaying of this ink level reduction to the control electronics 802 allows printing by the printhead 200 to be controlled to eliminate low quality prints, such as partially printed pages and the like.

For example, at the full indicator, the control electronics 802 allows normal printing to be carried out. At the low ink level indicator, the control electronics 802 allows reduced capacity printing to be carried out, such as subsequent printing of only a certain number of pages of certain ink quantity requirements. And at the out level indicator, the control electronics 802 prevents further printing until the supply cartridge is refilled or replaced with a full cartridge, such as through prompting of a user of the printer 100.

Upon depletion, the supply cartridges 301 are disconnected from the system 300 at the ports 311, either replaced or refilled either in situ or remote from the system 300, and then reconnected to the system 300.

Figure 9:
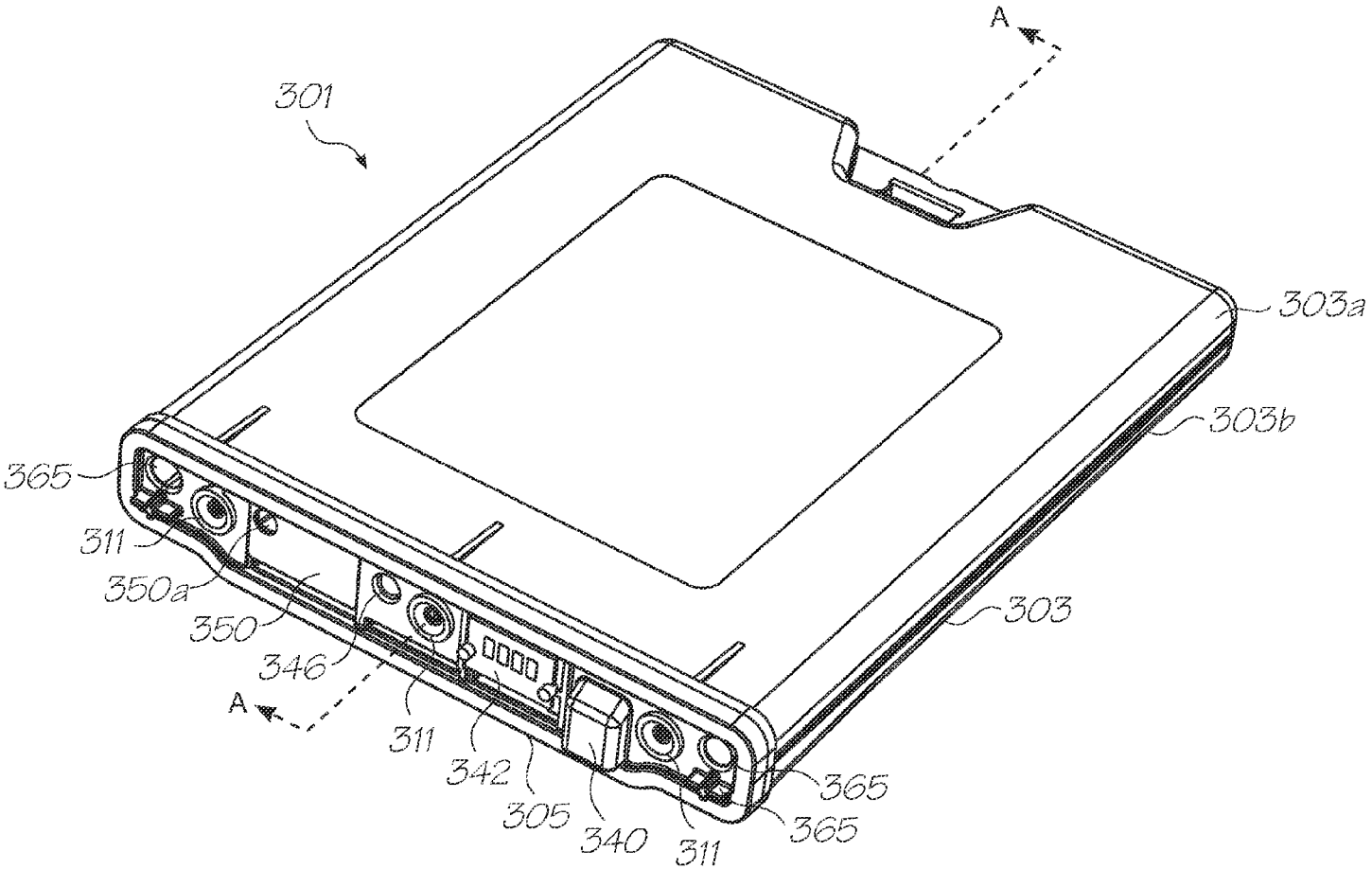
FIG. 9 illustrates a fluid supply cartridge of the fluid distribution system.
Figure 10:
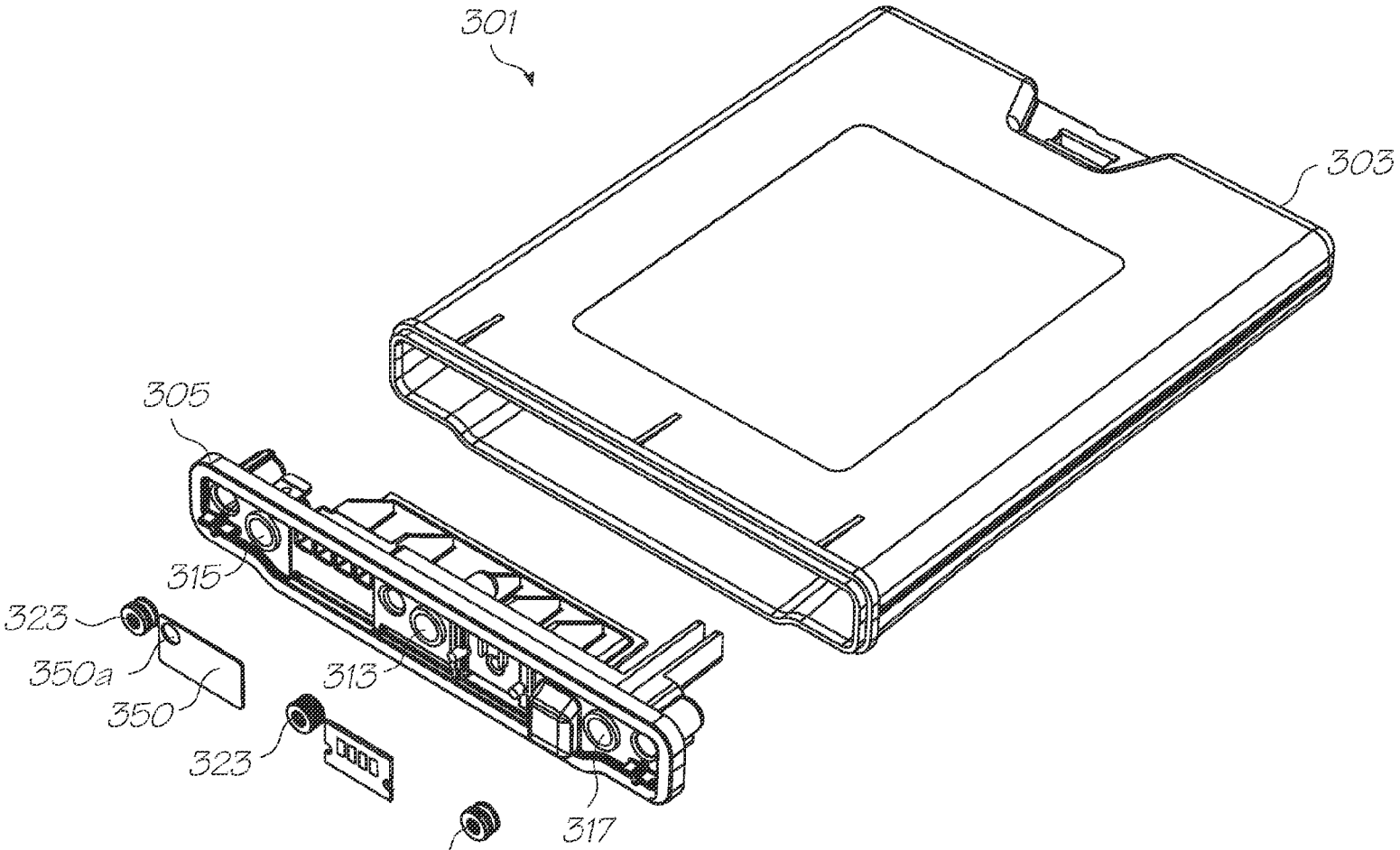
FIG. 10 is an exploded view of the fluid supply cartridge.

In the illustrated embodiment, refilling of the supply cartridge 301 is provided by connecting a refill port 344 in the lid 305 of the supply cartridge 301 with a refilling station or the like. For example, the refill port 344 may comprise a ball valve 346, as illustrated in FIG. 9, or other valve arrangement, which is actuated to open by the refilling station and refilling is carried out under gravity.

The supply cartridges 301 have a slim and low profile. In the illustrated embodiment, the supply cartridges have a height of about 24 millimeters. This enables the supply cartridges 301 to be stacked in the printer housing 101 in the layout illustrated in FIGS. 6 and 21, which disposes the supply cartridges 301 containing different ink colors at different levels to minimize ink color mixing.

In the illustrated layout, five supply cartridges 301 are stacked in an array having three columns and three rows. The five supply cartridges 301 include two black ink supply cartridge 301K, a cyan ink supply cartridge 301C, a magenta ink supply cartridge 301M and a yellow ink supply cartridge 301Y.

Figure 19:
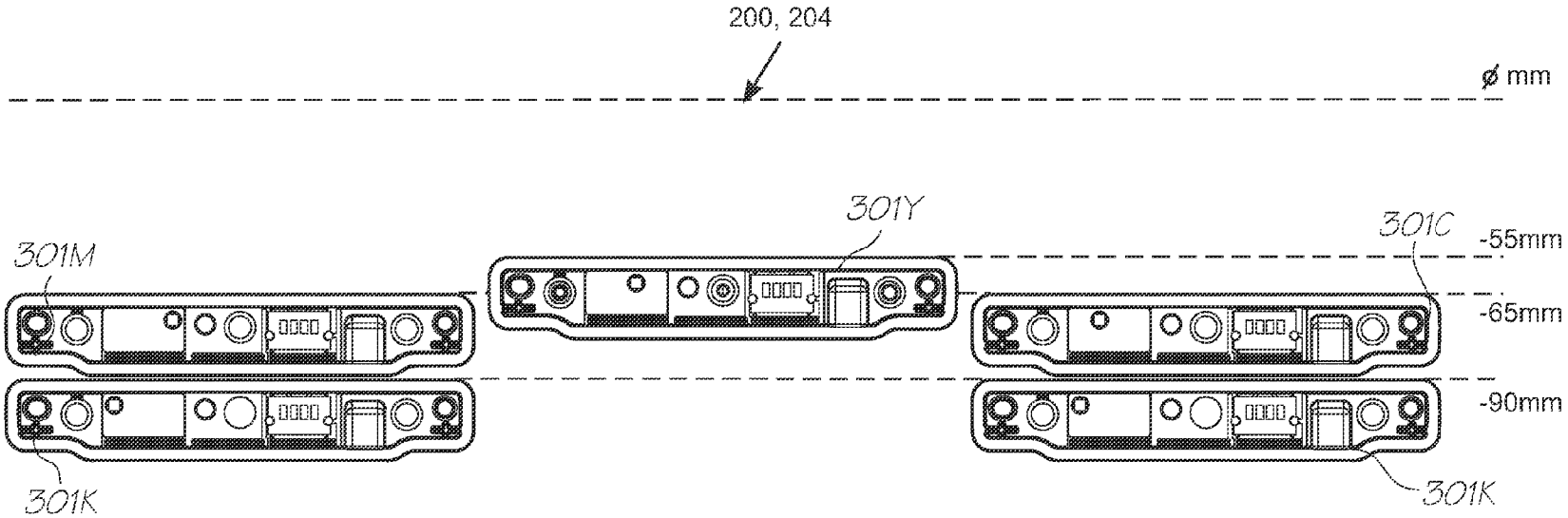
FIG. 19 illustrates a layout of the supply cartridges as mounted in the printer.

In FIG. 19, the printing or ejection face of the printhead 200 containing the ejection surfaces of the ejection nozzles is defined as a reference at zero millimeters. As illustrated, the black ink cartridges 301K are disposed at the lowest row of the array in the first and third columns of the array so that the upper surfaces of the black ink cartridges 301K are at about −90 millimeters relative to reference of the printing surface. The magenta and cyan ink cartridges 301M,301C are disposed at the middle row of the array in the first and third columns of the array so that the upper surfaces of the magenta and cyan ink cartridges 301M,301C are at about −65 millimeters relative to reference of the printing surface. The yellow ink cartridge 301Y is disposed at the highest row of the array in the second column of the array so that the upper surface of the yellow ink cartridge 301Y is at about −55 millimeters relative to reference of the printing surface.

By arranging the different ink color cartridges in the layout of FIG. 19, the black ink channels have a lower backpressure than the magenta, cyan and yellow ink channels, and the magenta and cyan ink channels have a lower backpressure than the yellow channel. The result is that on the printhead 200, in the presence of fibers, dust, ink or other contaminants, if a fluid path is formed between any two ink color channels and fluid begins to flow from one ink channel to another causing color mixing, the flow will be pulled towards the magenta and cyan ink channels from the yellow ink channel and towards the black ink channels from the magenta, cyan and yellow ink channels. Because these flow directions allow the black ink to absorb the other mixed ink colors the effects of color mixing in the printhead 200 are reduced since the color mixing is less noticeable in the printed product than if all ink colors contained similar back pressure levels.

In order to ensure that the correct ink color cartridge is inserted at the correct position in the layout, the lid 305 of each supply cartridge 301 is provided with a lockout plate 350 which has a feature 350*a* at a position on the lockout plate 350 corresponding to the ink color contained in the supply cartridge 301. The features 350*a* engage with respective features on the printer housing 101 at positions corresponding to the ink color in the layout, so that the correct ink color is supplied to the correct ink channel of the fluid distribution system 300 and printhead 200. The lids 305 of the supply cartridges 301 are further provided with locating and alignment features 365 which locate the supply cartridges 301 with mating features on the printer housing 101 thereby aligning the supply cartridges for proper fluid flow into the closed fluid loop and vent lines.

In the above-discussed arrangement two black ink supply cartridges are used for a CYMKK ink channel configuration, however more or less of the ink channels could provide the same ink color depending on the printer application.

Figure 20:
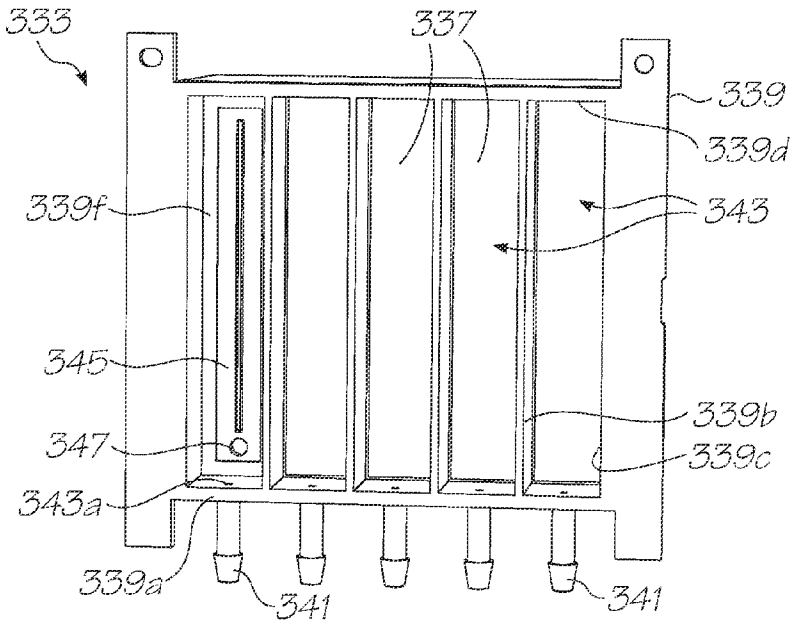
FIGS. 20 and 21 illustrate different views of a multi-channel gas vent assembly of the fluid distribution system.
Figure 21:
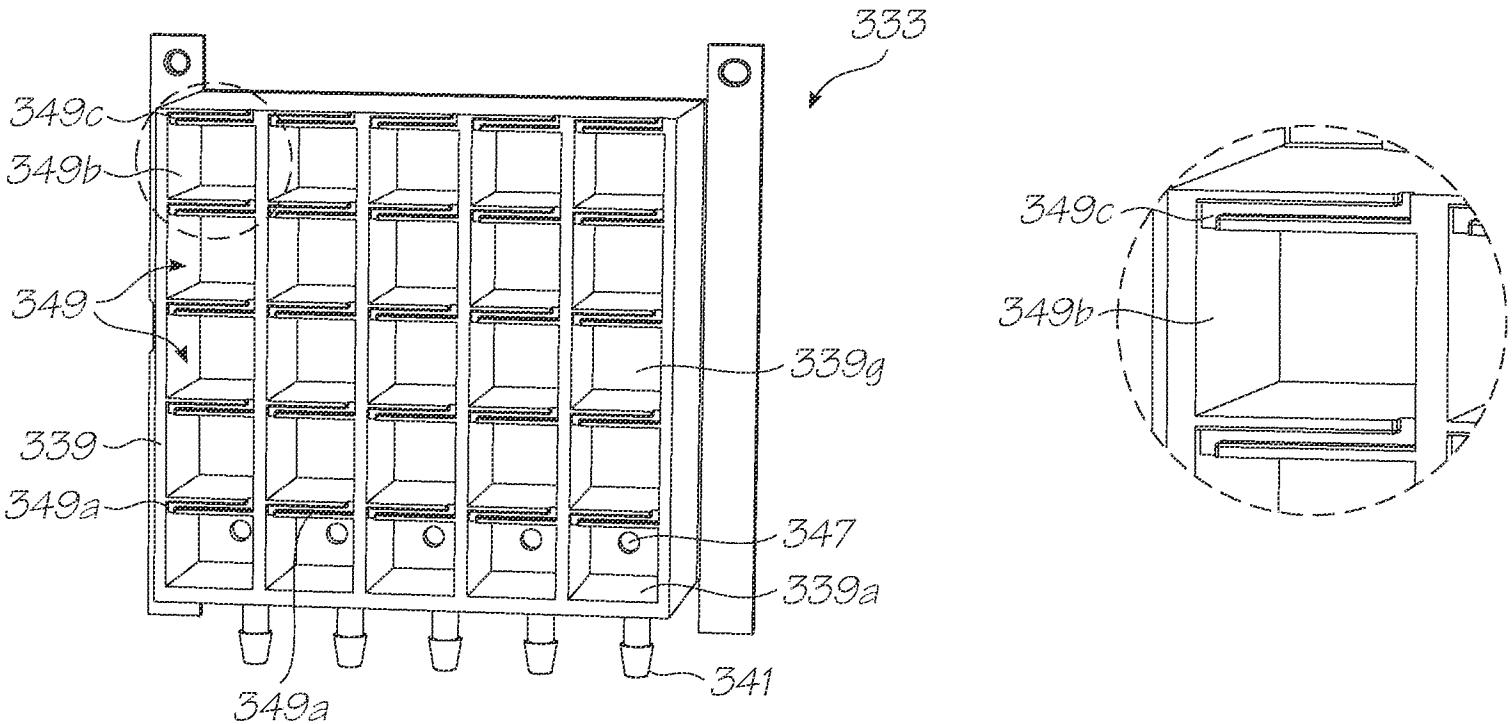

In the illustrated embodiment of the fluid distribution system 300 of FIGS. 6 and 7, a multi-channel gas vent assembly 333 is provided for the five supply cartridges 301 of the five ink channels. The multi-channel gas vent assembly 333 is illustrated in FIGS. 20 and 21. The gas vent assembly 333 has a body 339 which is mounted to the printer housing 101. As illustrated, the body 339 is formed as a box, one sidewall 339*a* of which is formed with barbs 341 as connectors for the tubing of the vent lines 335 of the supply cartridge gas ports 315.

The body 339 has a number of discrete chambers 343 (the number corresponds to the number of ink channels of the printhead 200 which in the illustrated embodiment is five) defined on one side of the box by the sidewall 339*a*, sidewalls 339*b*, 339*c* and 339*d*, internal walls 339*e*, and a surface 339*f*. The remaining open side of each of the chambers 343, as illustrated in FIG. 20, can be sealed by either a further wall of the body 339 or a sealing film or the like mounted on the body 339 (not illustrated for clarity).

Each chamber 343 has a hole 343*a* through the sidewall 339*a* of the body 339 which communicates with the hollow interior of a corresponding one of the connectors 341, thereby defining transfer ports of the gas vent assembly 333. In this way, fluid is communicated between the chambers 343 and the corresponding vent lines 335, and ultimately the corresponding supply cartridges 301 via the gas ports 315.

The surface 339*f* in each chamber 343 is formed with a recess 345 in which apertures 347 are formed through the surface 339*f*. The filters 337 are sealingly received in the recesses 345 so as to provide a hydrophobic filter between the chambers 343 and the apertures 347. In FIG. 20, one of the filters 337 is omitted to allow illustration of the recess 345 and aperture 347 of one of the chambers 343.

Each aperture 347 communicates with a series of compartments 349 defined on the other side of the box by the sidewalls 339*a*-339*d*, internal walls 339*g*, and the surface 339*f*. The remaining open side of each of the compartments 349, as illustrated in FIG. 21, can be sealed by either a further wall of the body 339 or a sealing film or the like mounted on the body 339 (not illustrated for clarity).

The series of compartments 349 corresponding to a particular aperture 347, and therefore a particular chamber 343, are fluidically linked by tortuous or serpentine paths 349*a*. Further, as illustrated in the cut-away partial detailed view of FIG. 21, the final compartment 349*b* of each compartment series is fluidically open to atmosphere via another tortuous path 349*c*. In the illustrated embodiment, there are five compartments 349 in each compartment series, however more or less compartments are possible.

This arrangement for each channel of the gas vent assembly 333 provides a gas path between the vent line 335 and the external atmosphere via the corresponding chamber 343, filter 337 and series of compartments 349. The gas path allows gases, such as ambient air and internal vapors of the supply cartridge 301 formed by volatiles evaporated from the contained ink, to pass into and out of the supply cartridge 301. This gas transit, together with mounting the gas vent assembly 333 to the printer housing 101 so that the connectors 341 are at the lower side of the body 339, allows the internal gas pressure of the supply cartridge 301 to be equalized to external ambient conditions, which provides consistent fluid flow through the outlet and inlet ports 313,317 of the supply cartridges 301.

The hydrophobic nature of the filters 337 together with the fluid containing volume provided by the chambers 343 prevents ink which may overflow from the supply cartridge 301 from passing into the compartments 349. This ensures that air at controlled pressure is always present in the gas vent 333 which enables the gas pressure equalization, and that a volume for the evaporated volatiles is provided. In the illustrated embodiment, the volume provided by each series of compartments 349 is about 15 cubic centimeters, the tortuous path length to area ratio provided by the relatively long and narrow tortuous gas paths of each compartment 349 is about 60 $mm^{-1}$, and the ink overflow volume provided by each chamber 343 is about 12.6 cubic centimeters. Accordingly, the gas vent assembly has cascading chambers with long and narrow serpentine gas paths to gas vents which are protected by a liquid barrier.

Another embodiment of the fluid distribution system 300 incorporates an alternative embodiment of the multi-channel gas vent assembly 333. In this alternative embodiment of the multi-channel gas vent assembly 333 fluid overflow management is provided such that overflowing fluid from the supply cartridges 301 at volumes greater than can be contained in the ink overflow volume provided by the chambers 343 is able to exit the gas vent assembly 333. The fluid distribution system 300 of this embodiment is illustrated schematically for a single fluid channel in FIG. 22A, and the alternative multi-channel gas vent assembly 333 is illustrated in FIGS. 22B and 22C.

As illustrated, each chamber 343 has a further hole 343*b* through the sidewall 339*d* of the body 339 which communicates with the hollow interior of a corresponding barb 351 as a connector for tubing of a waste fluid line 353. The waste fluid lines 353 preferably feed into a single tube 353*a* which drains the overflowed ink, or other printing fluids, into a fluid collection tray 601 of the maintenance system 600, which is described in detail later.

A check valve 355 is preferably provided at each connector 351 so that back flow of ink from the waste fluid lines 353 to the chambers 343 is prevented. That is, as is understood by one of ordinary skill in the art in the art, check valves are one-way valves which allow free fluid flow when positive differential fluid pressure between the upstream and downstream sides of the check valve above the cracking pressure of the check valve is present but disallow, or check, backflow from the downstream side to the upstream side when negative differential fluid pressure between the upstream and downstream sides is present. The check valve is preferably an elastomeric duckbill check valve, as illustrated in FIG. 22B.

In a further alternative embodiment of the fluid distribution system 300 the multi-channel gas vent assembly is replaced by fluid overflow buffer units 354 to provide fluid overflow management from the supply cartridges 301. The fluid distribution system 300 of this embodiment is illustrated schematically for a single fluid channel in FIG. 22D, and the fluid overflow buffer units 354 are illustrated in FIGS. 22E-22H.

The buffer units 354 are configured to store ink that may overflow from the full or partially filled supply cartridges 301 due to volumetric expansion of air within the supply cartridges 301 caused by effects such as ambient temperature changes and barometric variation in the atmosphere. In the case of severe overflow, the buffer units 354 provide a discharge path that allows the ink to flow from the buffer units 354 into the fluid collection tray 601.

The layout of the supply cartridges 301 of FIG. 19 is accommodated for by configuring each buffer unit 354 with a body 356 defining two chambers 358 for capture of ink from two of the supply cartridges. This also allows simple and reproducible manufacture of the buffer units 354 independent of the layout employed for the supply cartridges. In the array of five of the supply cartridges 301 illustrated in FIG. 22E, three buffer units 354 each having upper and lower chambers 358 are arranged with a first buffer unit 354 servicing the magenta and black ink supply cartridges 301M,301K in the first column of the array, a second buffer unit 354 servicing the yellow ink supply cartridge 301Y in the second (middle) column of the array, and a third buffer unit 354 servicing the cyan and black ink supply cartridges 301C,301K in the third column of the array.

Figure 22A:
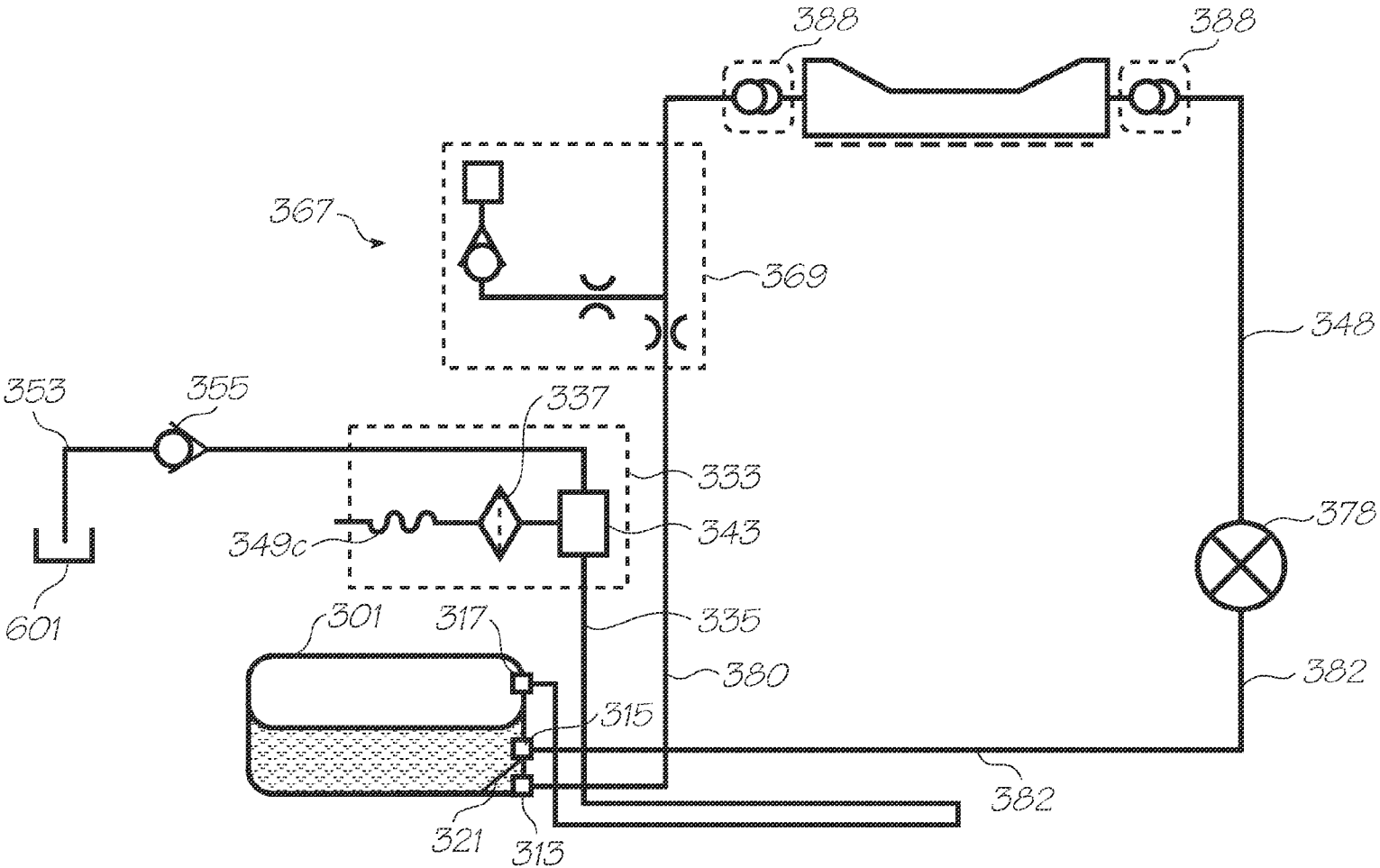
FIG. 22A schematically illustrates another embodiment of the fluid distribution system incorporating an alternative multi-channel gas vent assembly.
Figure 22C:
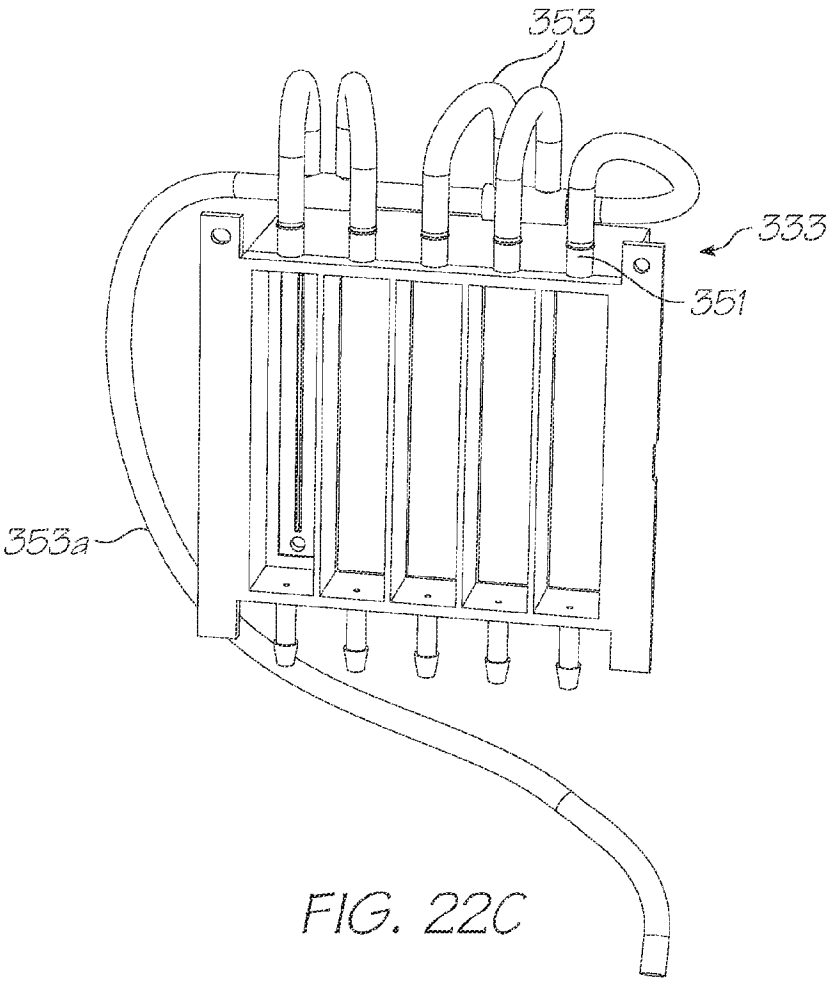
FIG. 22C illustrates a different view of the alternative multi-channel gas vent assembly with the waste fluid lines shown.
Figure 22B:
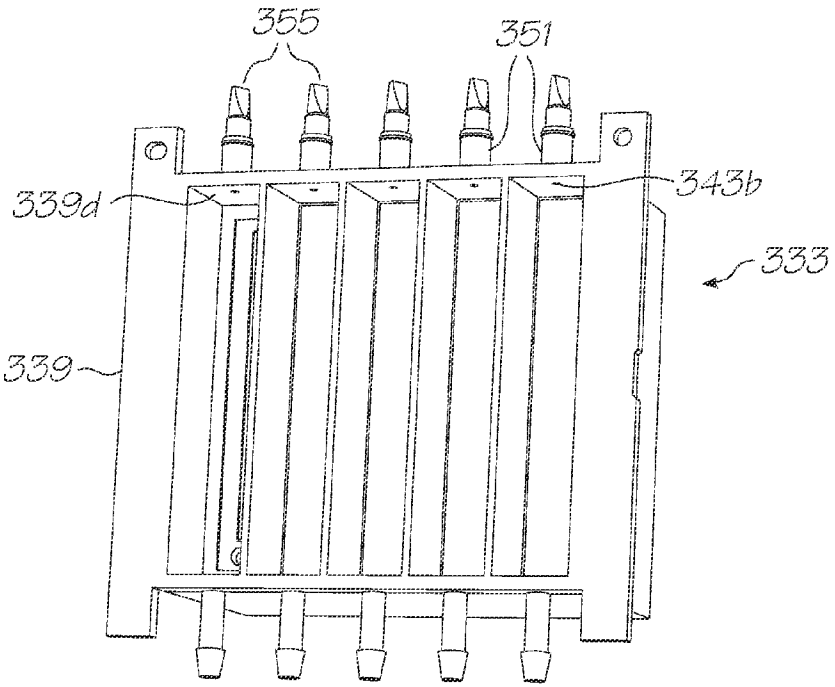
FIG. 22B illustrates the alternative multi-channel gas vent assembly with waste fluid lines omitted.
Figure 22D:
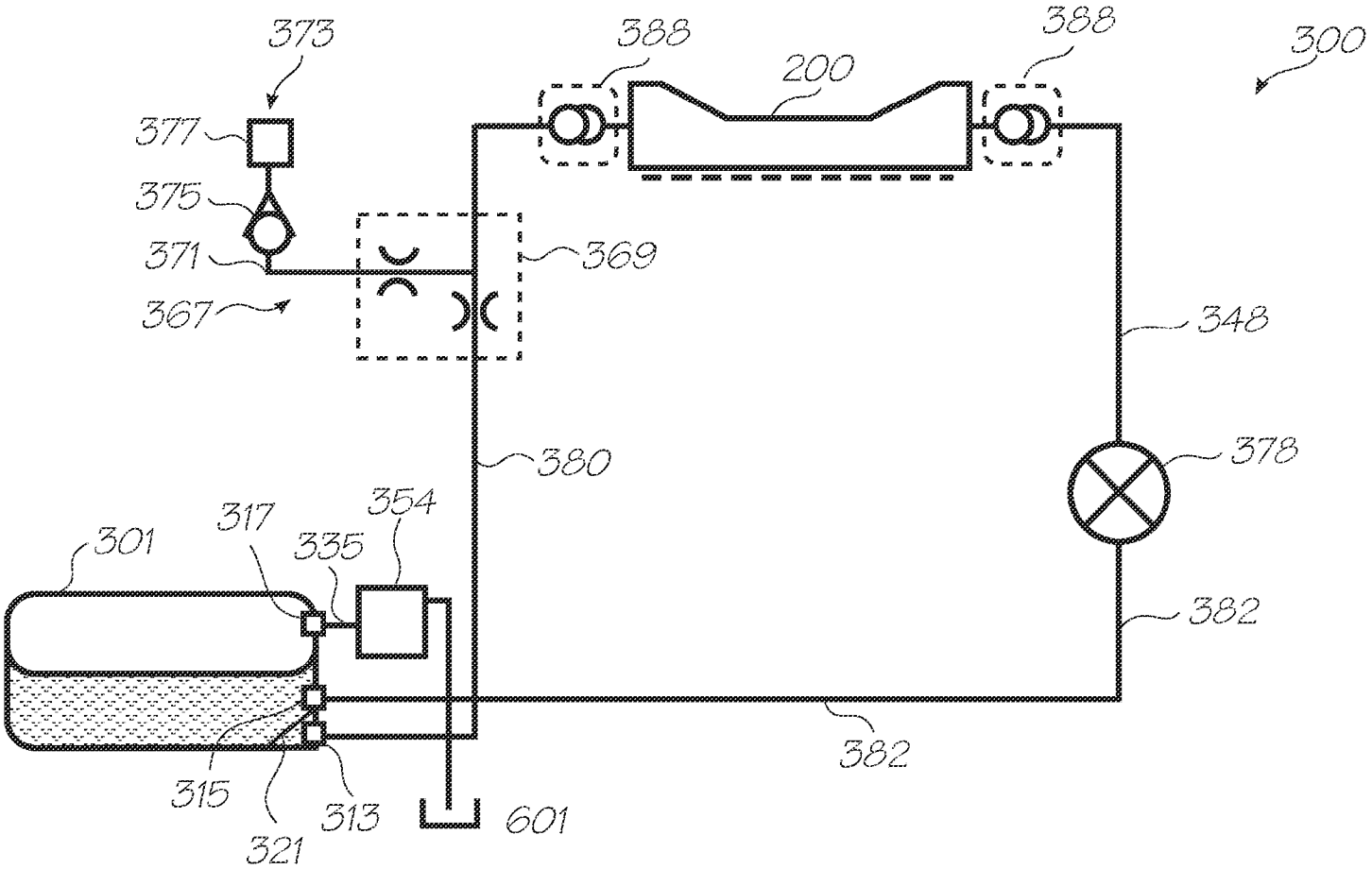
FIG. 22D schematically illustrates another embodiment of the fluid distribution system incorporating buffer units.
Figure 22E:
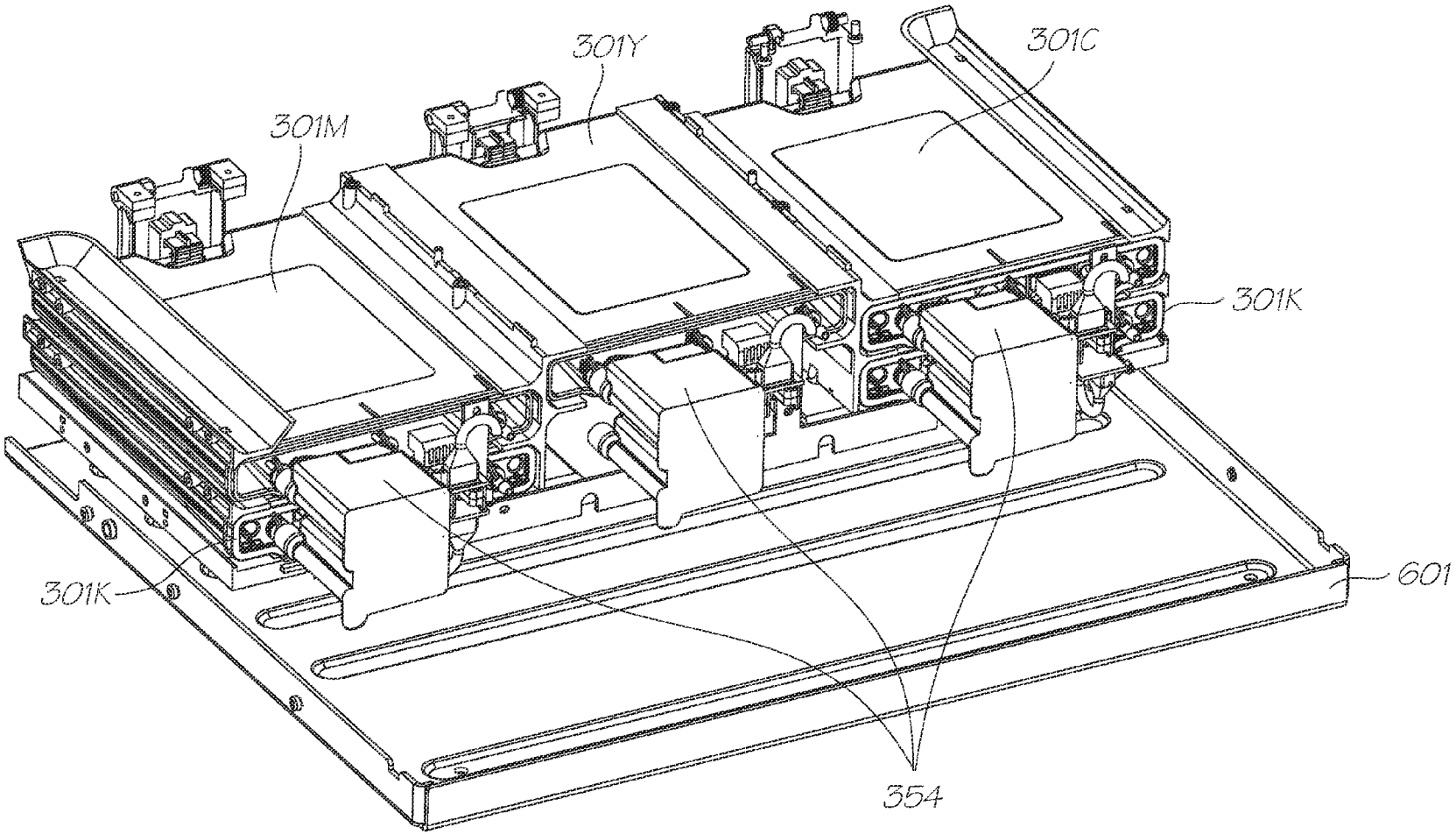
FIG. 22E illustrates fluid overflow buffer units incorporated in the system of FIG. 22D.
Figure 22F:
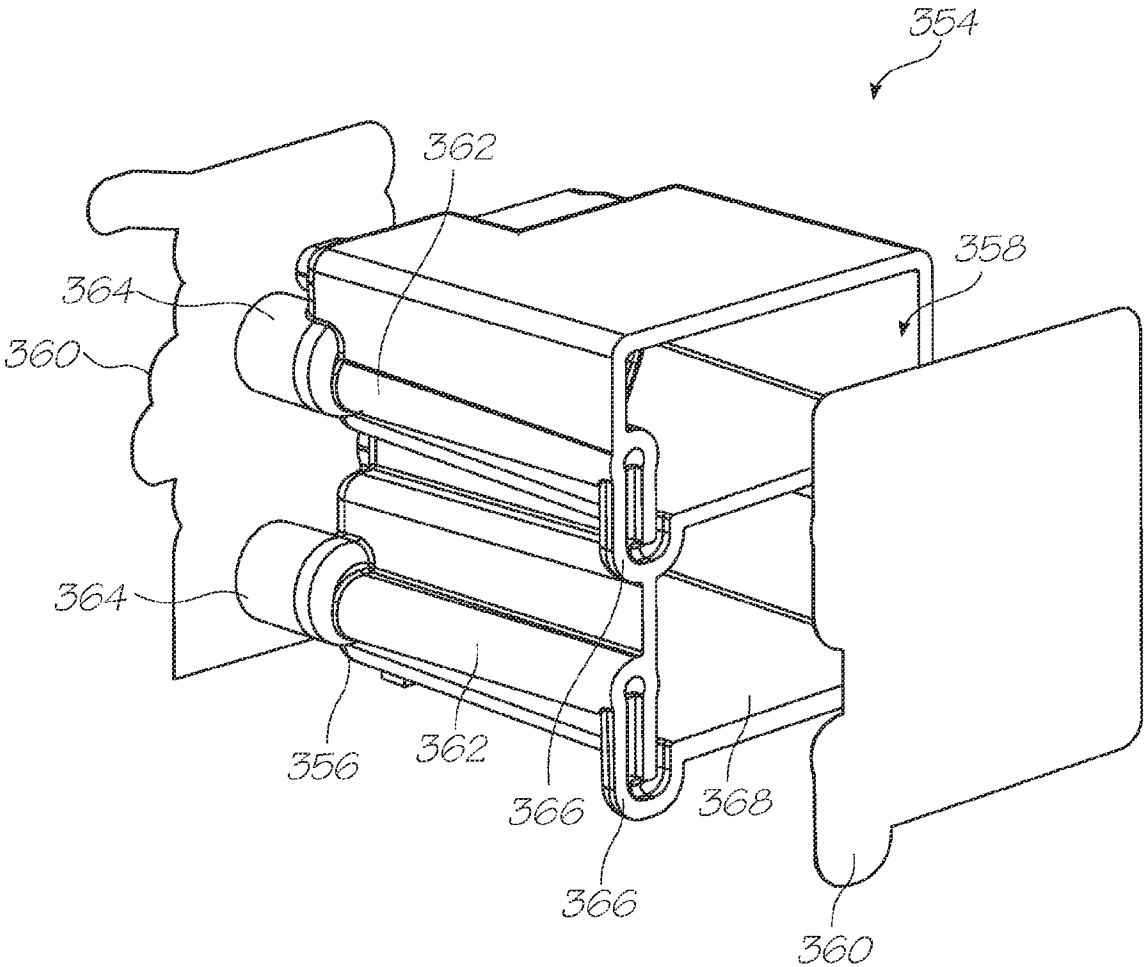
FIGS. 22F-22H illustrate different views of a single buffer unit.
Figure 22H:
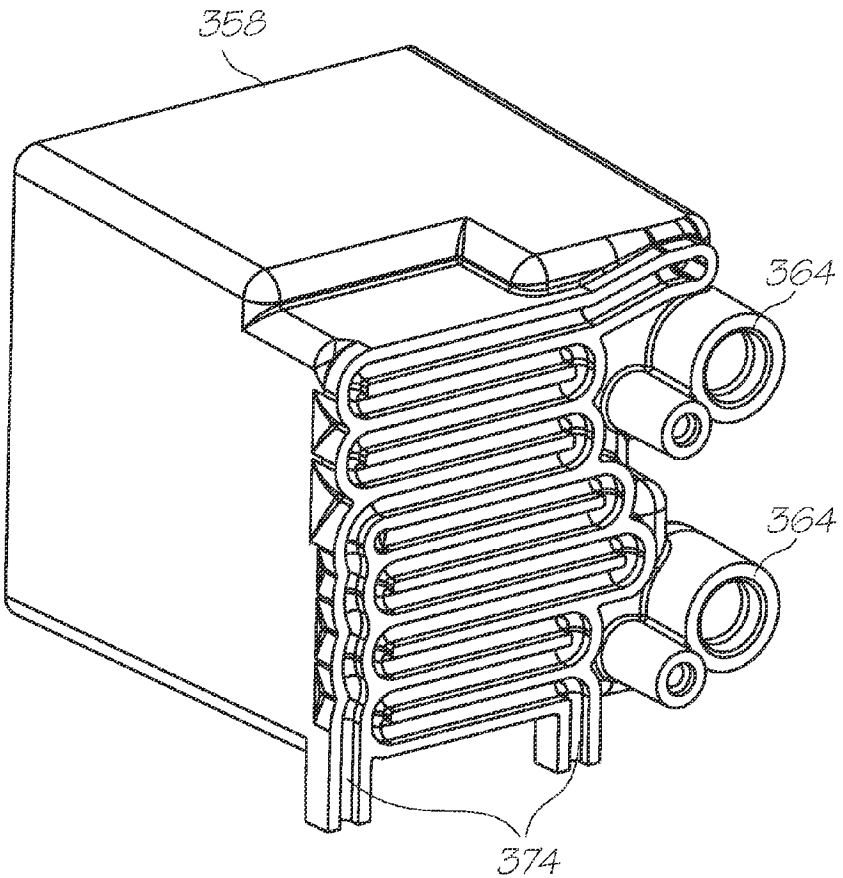
Figure 22G:
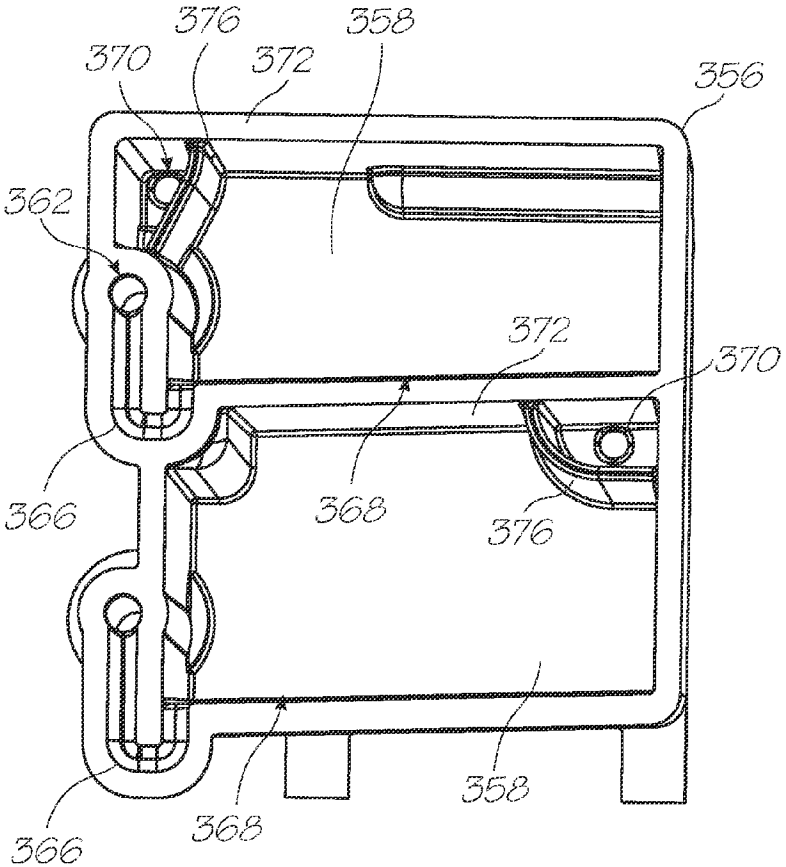
Figure 23A:
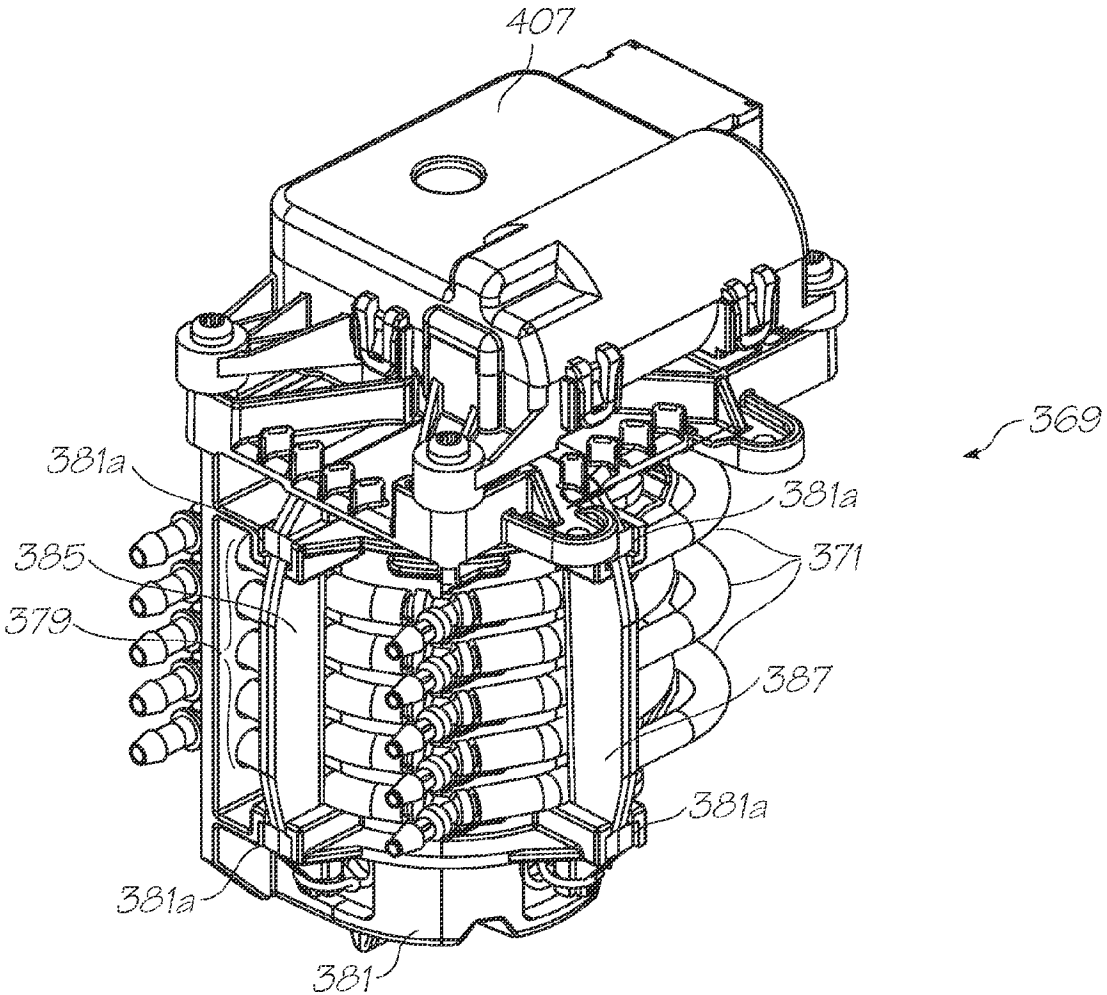
FIGS. 23A and 23B illustrate different isometric views of a multi-channel valve arrangement of the fluid distribution system.
Figure 23B:
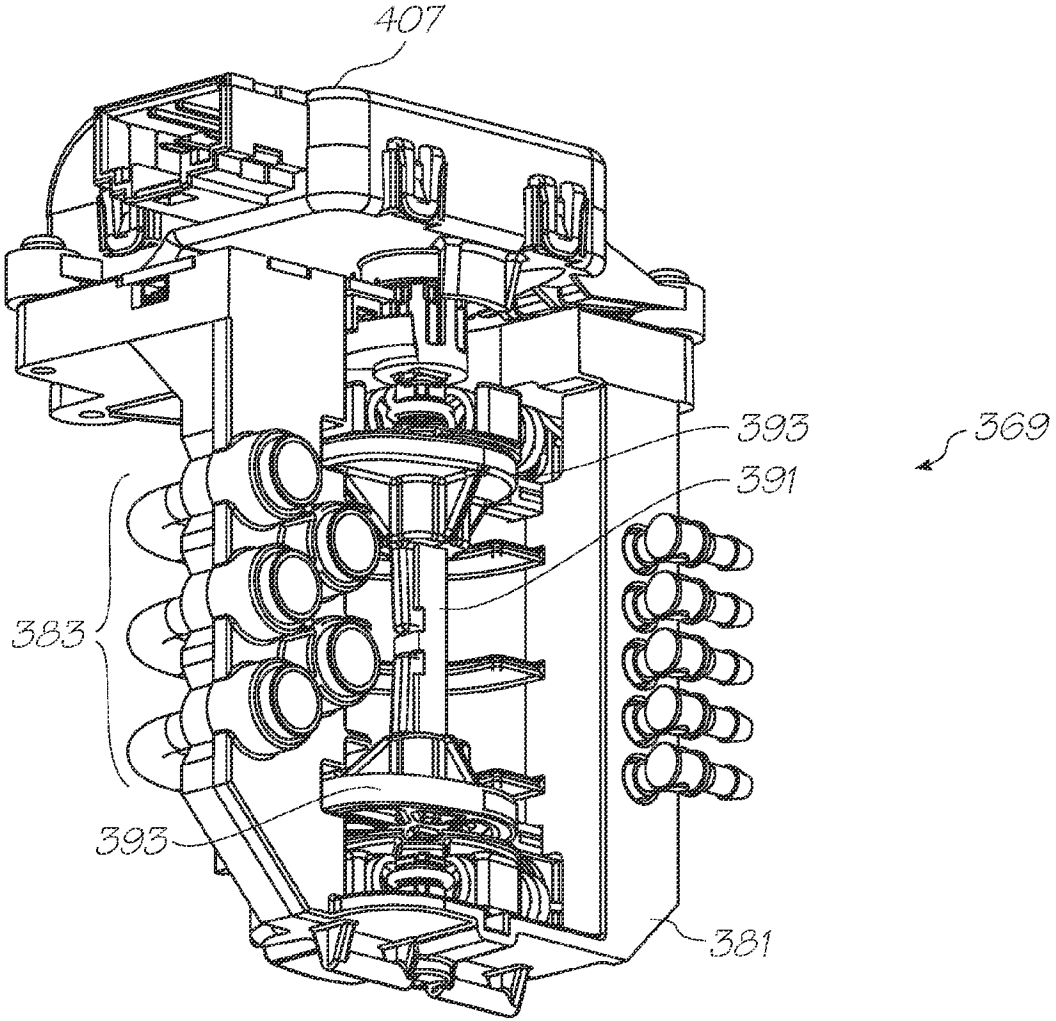

A single buffer unit 354 is illustrated in detail in FIGS. 22F-22H. The chambers 358 of the buffer unit 354 are formed as open compartments of the body 356 and are enclosed by a cover 360. The buffer units 354 are formed of a plastics material inert to ink, and are preferably molded to contain the chambers 358 and associated elements as discussed below. The covers 360 are formed of material which is fluid tight, and are preferably hermetically sealed on the body 356.

Each chamber 358 has a channel 362 which has a port 364 for connection to the gas port 315 of the corresponding supply cartridge 301. The ports 364 are configured to either connect directly to the barbs 331*a* of the septum needles 331 or to tubing connected to the barbs 331*a* of a gas vent. Either way, the channels 362 form part of the vent lines 335 from the supply cartridges 301 through which fluid flows between the supply cartridge 301 and buffer unit 354. The channels 362 are dimensioned so that ink 'slugs' are pulled through the channels 362 without gas and ink passing each other. That is, the inner diameter of the cylindrical channels 362 is sufficiently small so that, with the given wetting angle between the plastic channel wall and the ink meniscus, ink and gas bubbles cannot be trapped in the channel as ink is pulled through during printing. At the same time, the inner diameter of the cylindrical channels 362 is sufficiently large so as not to restrict the flow of ink during printing which could otherwise cause a undesired ink pressure drop. In particular, an inner diameter of the channels 362 of about two millimeters provides this function. In this manner, no ink is stranded in the channels 362 and a clear gas path is created once ink drains out of the buffer unit 354 during printing for normal gas venting from the supply cartridges 301.

Each channel 362 has a U-shaped drain path 366 through which fluid flows into and out of the respective chamber 358. Each drain path 366 has an inner diameter similar to that of the channels 362, e.g., about two millimeters, so that ink 'slugs' are pulled through the drain path 366 without gas and ink passing each other. The bottom walls 368 of the chambers 358 are sloped along two axes so that the lowest point in each chamber 358 is at the location of the respective U-shaped drain path 366. This sloping of the bottom walls 368 is seen most clearly in FIG. 22G. In this way, any ink that overflows into the chamber 358 will flow towards this point as it drains.

Each chamber 358 is configured with sufficient volume to capture the maximum amount of ink that will overflow from the supply cartridges 301. Ink that overflows into the chambers 358 is stored at a lower elevation than the connected gas port 315 of the supply cartridge 301 so that the supply cartridge 301 can be removed from the system 300 without ink leaking from the buffer unit 354 through the gas port 315. In order to account for overfilling of a chamber 362 of the buffer unit 354 with ink from the connected supply cartridge 301, an overflow port 370 is provided adjacent the top wall 372 of each chamber 358 through which excess ink is able to overflow from the buffer unit 354 into the fluid collection tray 601.

The chambers 358 are also configured to serve as gas reservoirs which contain a volume of gas and prevent the contained gas from exiting to the environment via the overflow ports 370 when the chambers 358 are not completely full of ink. This gas warehousing reduces the loss of volatile components in the ink when gas in the supply cartridges volumetrically expands and flows therefrom or through slow evaporation which could otherwise change the composition of the ink. The ink composition should be kept constant so to not affect print quality or the firing properties of the ink drops as they are ejected from the printhead. This is achieved by forming each overflow port 370 with a discharge path 374 to the outside of the buffer unit 354 which has a long and narrow serpentine form enclosed by a cover 360. The serpentine paths 374 prevent humid air in the chambers 358 from diffusing to the outside environment and therefore serves as diffusion barriers between the buffer unit 354 and the outside environment. The inner diameter of the serpentine paths 374 is dimensioned similar to that of the channels 362 so that ink 'slugs' are pulled through the serpentine paths 374 without gas and ink passing each other. In this manner, no ink is stranded in the serpentine paths 374 and the serpentine paths 374 will clear automatically as printing occurs and the ink is drawn up the serpentine paths 374 and into the chambers 358. Isolation walls 376 are formed within the chambers 358 about the overflow ports 370 so as to prevent ink from leaking into the serpentine paths 374 if the printer is turned on its side and there is ink in the buffer unit 354.

Each closed loop 348 provides a fluid path between the corresponding supply cartridge 301 and the printhead 200. This fluid path is provided as a closed loop so that fluid can be primed into the fluid path and the printhead from the supply cartridge, the primed fluid can be printed by the printhead and the fluid can be de-primed from the printhead and the fluid path back to the supply cartridge so that de-primed fluid is not wasted, which is a problem with conventional fluid distribution systems for printers. The closed loop 348 also allows periodic recirculation of fluid within the fluid distribution system 300 to be carried out so that the viscosity of the fluid, such as ink, is retained within specified tolerances for printing.

In the embodiment of FIG. 8, the closed loop 348 is comprised of plural fluid lines. A print fluid line 380 is provided between the supply cartridge outlet 313 and the printhead 200. A pump fluid line 382 is provided between the printhead 200 and the supply cartridge inlet 317. The fluid lines of the closed loop 348 are in the form of tubing, and are preferably tubing which exhibits low shedding and spallation in an ink environment. Thermoplastic elastomer tubing is therefore suitable, such as Norprene® A-60-G. However, one of ordinary skill in the art understands that other types of tubing can be used. The tubing of the closed loop 348 is connected to the printhead 200 by supply couplings 388. The supply couplings 388 and the manner of their connection is described in detail in the incorporated description of the Applicant's US Provisional Patent Application No. 61/345,552.

A pump 378 is provided on the pump fluid line 382. The pump 378 is preferably a peristaltic pump so that contamination of the pumped ink is prevented and so that pumping amounts of about 0.26 milliliters per revolution of the pump are possible. However, one of ordinary skill in the art understands that other types of pumps can be used.

A valve arrangement 367 is provided on the print fluid line 380, as illustrated in FIG. 8. The valve arrangement 367 has a 2-way pinch valve 369 on the print line 380 and a vent line 371 of a gas vent 373 (herein termed "de-prime vent"), and a check valve 375 on the vent line 371. The vent line 371 has one end connected to the check valve 375 and a filter 377 of the de-prime vent 373 disposed at the other end. The valve arrangement of the present embodiment is provided in place of the pinch valve embodiment of the incorporation description of the co-filed US provisional patent application filed under Applicant's US Provisional Patent Application No. 61/345,552.

The above discussion has been made in relation to a fluid distribution system for a single fluid channel, e.g., an ink of one color, arranged as shown in FIG. 8 (or FIGS. 22A and 22D). In order to deliver more than one fluid to the printhead 200 or multiple printheads each printing one or more ink colors, the fluid distribution system 300 is replicated for each fluid. That is, as discussed above, separate supply cartridges 301 for each fluid are provided which are connected to the printhead 200 via an associated closed fluid path loop 348.

Certain components of these separate systems can be configured to be shared. For example, the supply couplings 388, the valve arrangement 367 and the pump 378 can each be configured as multiple fluid channel components, and a single or separate de-prime vents 373 can be used for the multi-channel valve arrangement 367. An exemplary arrangement of these multiple fluid paths is illustrated in FIGS. 6 and 7.

For an exemplary printhead 200 having five ink flow channels, e.g., CYMKK or CYMKIR, as discussed above, the pump 378 is a five channel pump which independently pumps the ink in each channel. The structure and operation of such a multi-channel pump is understood by one of ordinary skill in the art.

Using the multi-channel valve arrangement 367 facilitates efficient manufacture and operation of this component. The multi-channel valve arrangement 367 may be arranged as a multi-channel 2-way pinch valve 369 as illustrated FIGS. 23A-27C.

The multi-channel 2-way pinch valve 369 has five connectors 379, respectively labelled 379-1, 379-2, 379-3, 379-4 and 379-5, in series along a body or housing 381, and five connectors 383, respectively labelled 383-1, 383-2, 383-3, 383-4 and 383-5, also in series along the housing 381. The connectors 379 and 383 are connected to the tubing of the five print lines 380 and the connectors 383 are further connected to the tubing of the five vent lines 371.

Elongate pinch elements 385 and 387 are disposed on the housing 381 respectively extending across the connected tubing of the connectors 379 and 383. The pinch elements 385, 387 have bars 385*a*,387*a* at either longitudinal end which are slidingly received within channels 381*a* of the housing 381. The bars 385*a*,387*a* are configured to be slid within the channels 381*a* so that the pinch elements 385,387 are brought into and out of contact with the print and vent line tubing, respectively, to selectively "pinch" the tubing and thereby selectively obstruct or allow fluid flow through the print and vent lines, respectively. The pinch element 385 is termed herein as the "print line pinch element" and the pinch element 387 is termed herein as the "vent line pinch element".

This sliding movement of the pinch elements 385,387 is provided by a pinch drive arrangement 389 disposed in the housing 381. The pinch drive arrangement 389 has a cam shaft 391 rotatably mounted to the housing 381, two eccentric cams 393 fixedly mounted in parallel on the cam shaft 391, springs 395 disposed between, and interconnecting, the pinch elements 385,387 and the shaft 391, and a sensing arrangement 397.

Figure 24:
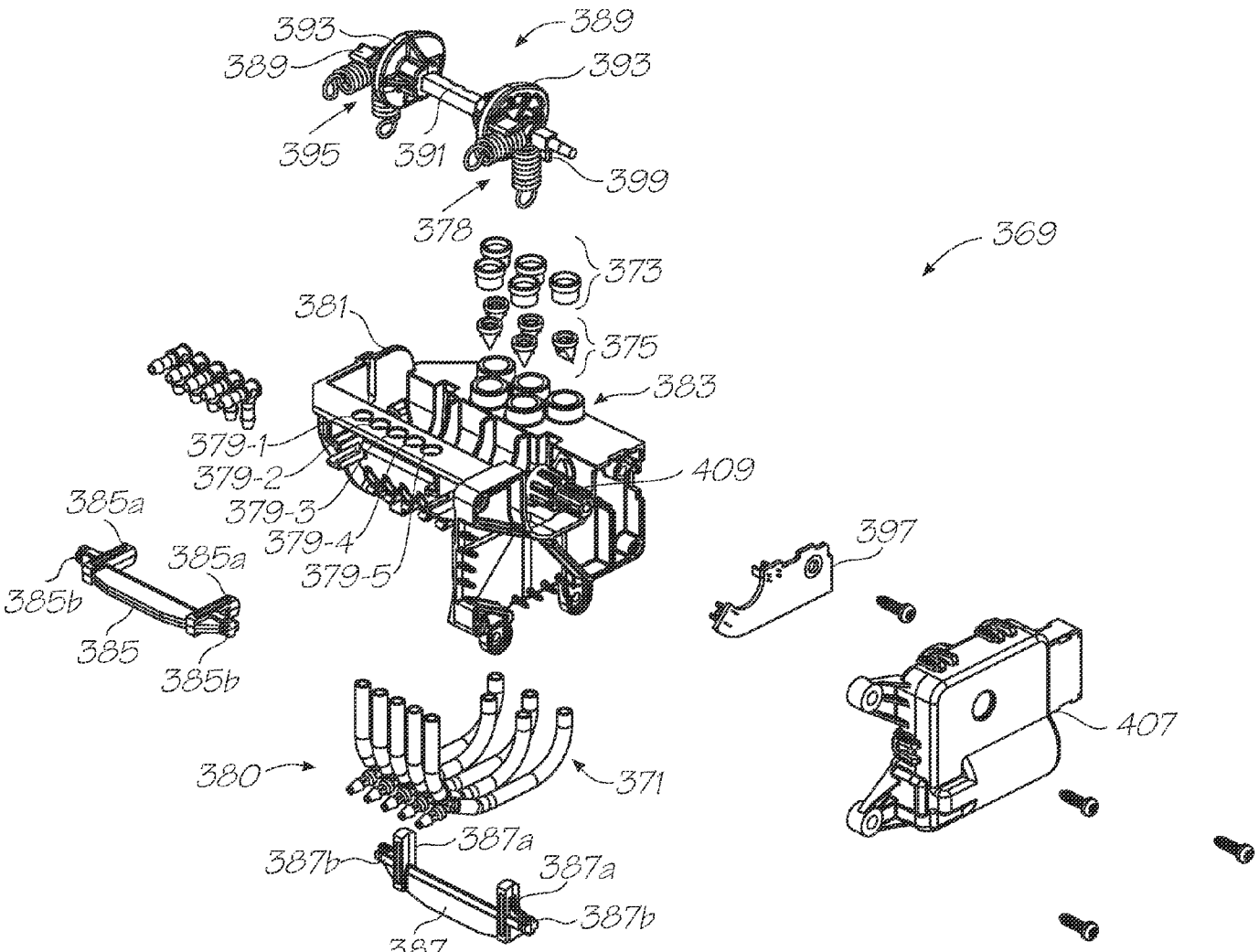
FIG. 24 is an exploded view of the multi-channel valve arrangement.
Figure 25:
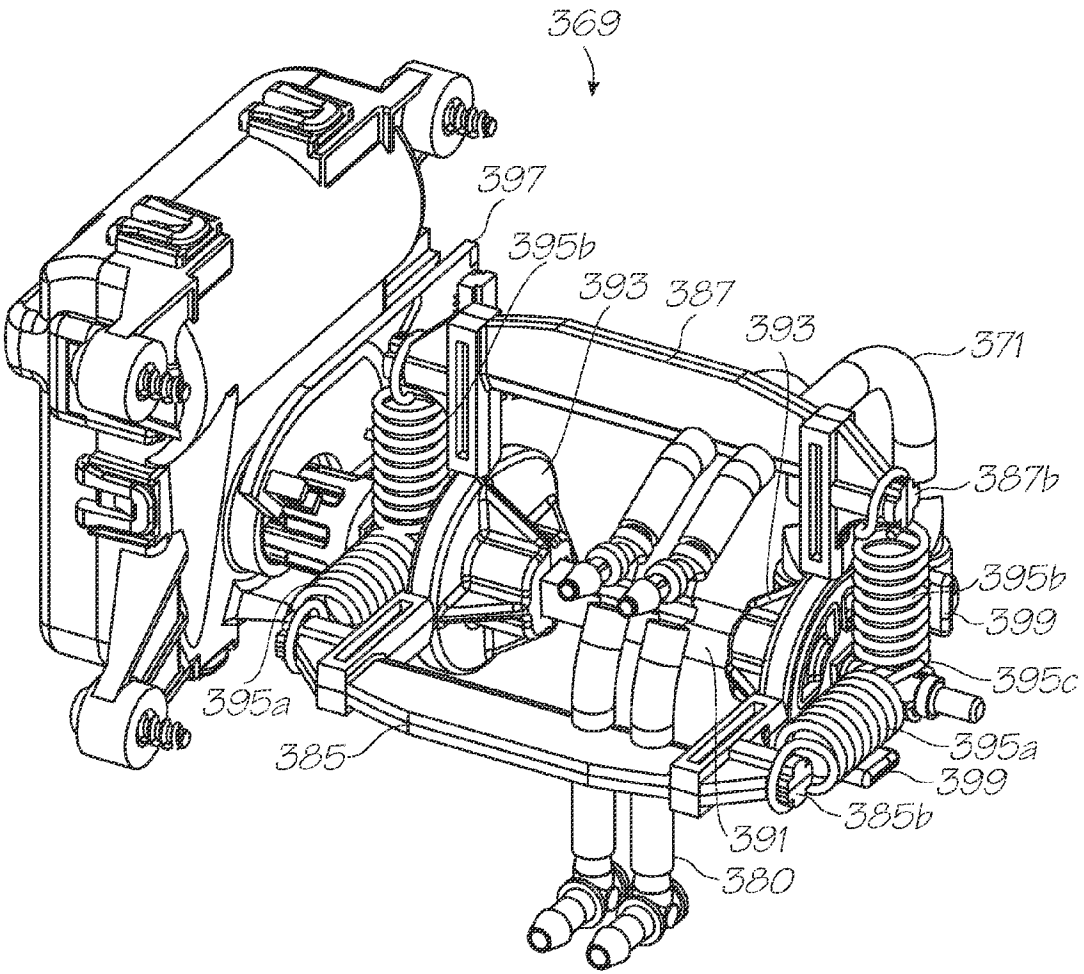
FIG. 25 illustrates the multi-channel valve arrangement with a housing and some fluid lines omitted.
Figure 26:
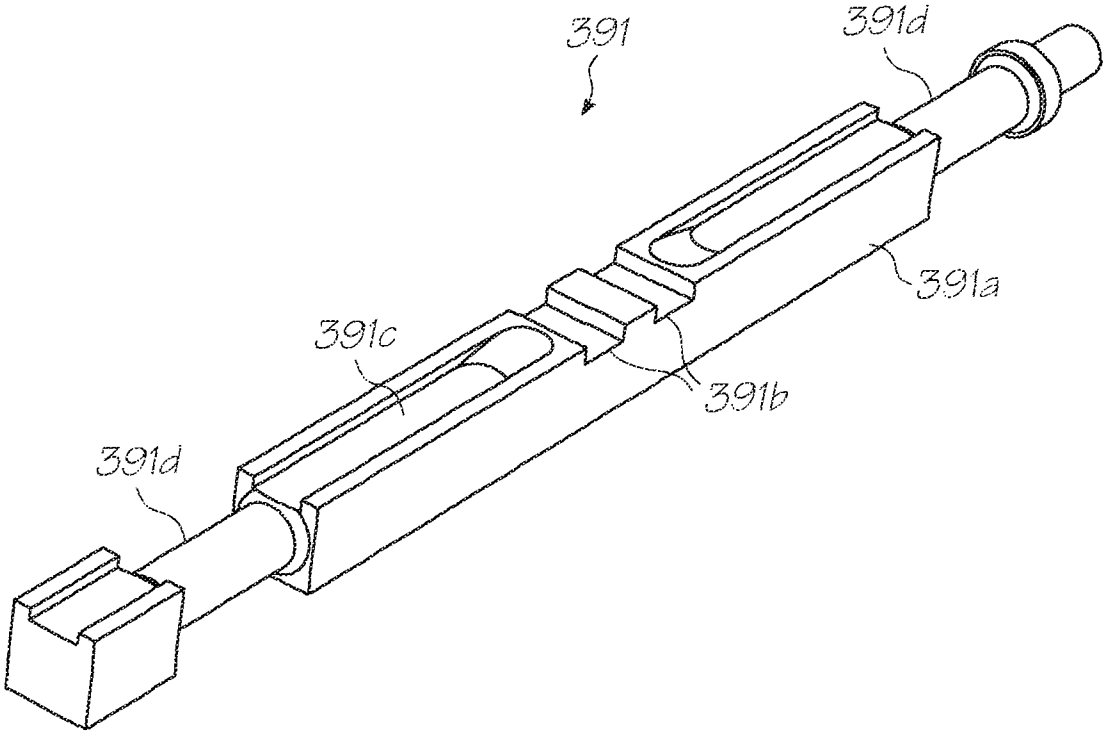
FIG. 26 illustrates a cam shaft of the multi-channel valve arrangement in isolation.

The shaft 391 has a square spline section 391*a* which cooperates with an internal corresponding square spline form 393*a* of the cams 393 so that the square spline form 393*a* conforms with and fits snugly onto the square spline section 391*a*. Each cam 393 further has an arm or poka yoke 393*b* which engages with, and is retained by, a recess or groove 391*b* and a poka yoke feature 391*c* of the shaft 391, as illustrated in FIGS. 24-26. This multiple cooperation ensures that the cams 393 are accurately rotated with rotation of the shaft 391.

In the illustrated embodiment, the springs 395 are provided as two bent springs, however separate springs could be equally provided. The bent springs 395 each have one spring section 395*a* connected to a pin 385*b* at a corresponding longitudinal end of the pinch element 385 and a second spring section 395*b* connected to a pin 387*b* at a corresponding longitudinal end of the pinch element 387. A central section 395*c* of each bent spring 395 which is central to the two spring sections 395*a*,395*b* is mounted over the shaft 391 and held thereon by a mounting member or bushing 399. Each mounting member 399 is mounted on the shaft 391 at a respective cylindrical section 391*d* of the shaft 391 by snap fitting or the like so that the mounting members 399, and therefore the springs 395, are not rotated with the shaft 391. The spring sections 395*a*,395*b* are configured to bias the pinch elements 385,387 toward the shaft 391 and the two springs 395 are provided as disposed so that the pinch elements 385,387 are biased parallel to the shaft 391. The springs 395 are preferably compression springs.

The bars 385*a*,387*a* of the pinch elements 385,387 constitute cam followers having engagement faces 401 which are engaged with, and follow, the eccentricity of the cams 393 due to the bias provided by the springs 395. The eccentric profile of the cams 393 includes a rounded section 403 and a beak section 405 as illustrated in FIGS. 27A-C, which cause the pinch elements 385,387 to be moved relative to the housing 381 so as to selectively pinch or not-pinch the print and vent line tubing thereby providing the following three valve states of the 2-way pinch valve 369.

Figure 27C:
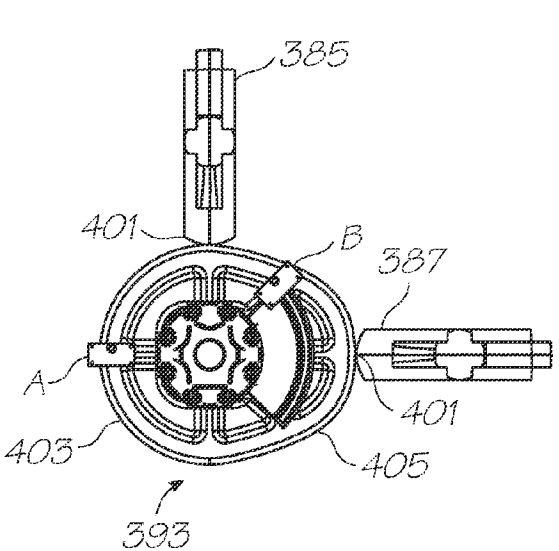
FIGS. 27A-27C illustrate different valve states of the multi-channel valve arrangement.
Figure 27B:
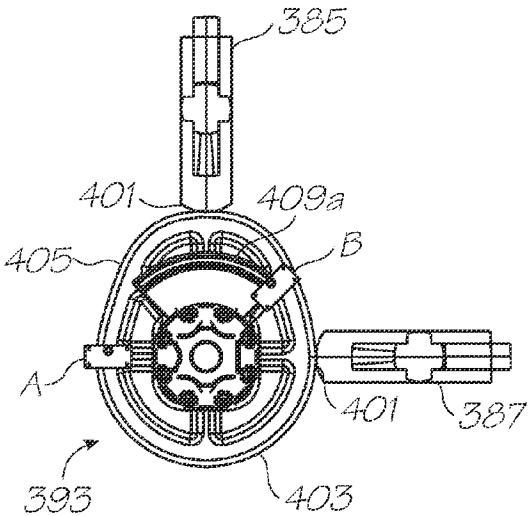
Figure 27A:
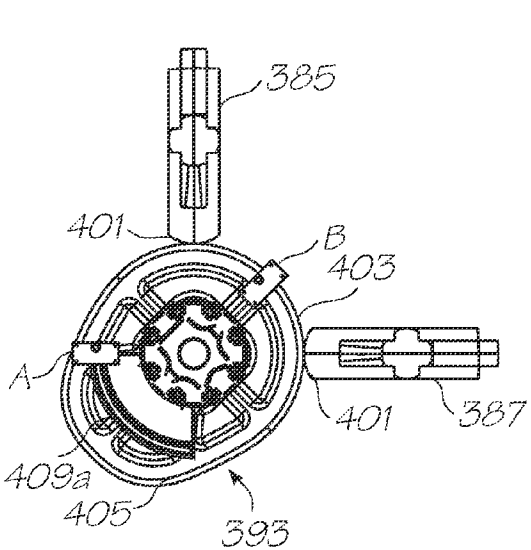

When the 2-way pinch valve 369 is in the fully closed (dual pinch) state illustrated in FIG. 27A both the print line tubing and the vent line tubing are pinched. The fully closed state is provided by rotating the shaft 391 so that the rounded sections 403 of the cams 393 are engaged with the engagement faces 401 of the bars 385*a*,387*a* of the pinch elements 385,387 which causes the pinch elements 385,387 to be forced toward the shaft 391 with the bias of the springs 395.

When the 2-way pinch valve 369 is in the first partially closed (print line pinch) state illustrated in FIG. 27B the print line tubing is pinched whilst the vent line tubing is not pinched. The first partially closed state is provided by rotating the shaft 391 so that the rounded sections 403 of the cams 393 are engaged with the engagement faces 401 of the bars 385*a* of the print line pinch element 385 which causes the print line pinch element 385 to be forced toward the shaft 391 with the bias of the spring sections 395*a* whilst the beak sections 405 of the cams 393 are engaged with the engagement faces 401 of the bars 387*a* of the vent line pinch element 387 which causes the vent line pinch element 387 to be forced away from the shaft 391 against the bias of the spring sections 395*b*.

When the 2-way pinch valve 369 is in the second partially closed (vent line pinch) state illustrated in FIG. 27C the vent line tubing is pinched whilst the print line tubing is not pinched. The second partially closed state is provided by rotating the shaft 391 so that the rounded sections 403 of the cams 393 are engaged with the engagement faces 401 of the bars 387*a* of the vent line pinch element 387 which causes the vent line pinch element 387 to be forced toward the shaft 391 with the bias of the spring sections 395*b* whilst the beak sections 405 of the cams 393 are engaged with the engagement faces 401 of the bars 385*a* of the print line pinch element 385 which causes the print line pinch element 385 to be forced away from the shaft 391 against the bias of the spring sections 395*a*.

The pinch drive arrangement 389 further has a motor 407 which is coupled at one end of the shaft 391 by a motor coupling 409 to provide the rotation of the shaft 391. The motor 409 is preferably a stepper motor with bi-directional operation so that the shaft 391 and the cams 393 are rotatable in both clockwise and counter-clockwise directions to effect movement of the pinch elements 385,387 relative to the shaft 391 and print and vent line tubing. However, other arrangements and motor types are possible.

In the illustrated embodiment, the motor coupling 409 is provided with a projection or flag 409*a* with which sensors A and B of the sensing arrangement 397 cooperate to sense a rotated position of the shaft 391. The sensors A and B are preferably optical interrupt elements and the projection 409*a* is preferably a semi-circular disc dimensioned to pass between an optical emitter and optical sensor of the optical interrupt elements so as to either obstruct or leave open the optical path between the optical emitter and sensor. However, other sensing or operational arrangements for sensing the rotated position of the shaft 391 are possible.

The optical interrupt elements A and B are disposed as illustrated in FIGS. 27A-27C so that when the 2-way pinch valve 369 is in the dual pinch state the projection 409*a* obstructs the emitter and sensor of only the optical interrupt element A (see FIG. 27A) and when the 2-way pinch valve 369 is in the print or vent line pinch states the projection 409*a* obstructs the emitter and sensor of only the optical interrupt element B (see FIGS. 27B and 27C).

The sensing arrangement 397 outputs the sensing results of the sensors A,B to the control electronics 802 of the printer 100 so that operation of the motor 409 can be controlled by the control electronics 802 to select predetermined rotated positions of the cams 393 for selecting the dual, print line and vent line pinch states. Accordingly, the pinch elements 385, 387 and the pinch drive arrangement 389 form a selection device for selecting these valve states by selectively closing and opening the multiple paths of the 2-way pinch valve. The particular manner in which the pinch drive arrangement 389 is operated to select and transition between the dual, print line and vent line pinch states is shown in Table 1. In Table 1, "CW" designates clockwise rotation of the motor coupling and therefore cam shaft and cams, "CCW" designates counter-clockwise rotation of the motor coupling and therefore cam shaft and cams, "A" designates sensor A, and "B" designates sensor B.

TABLE 1 pinch drive arrangement operation for 2-way pinch valve state transitions

| STATE TRANSITION | OPERATION |
|---|---|
| vent line pinch to dual pinch | CW until A is obstructed |
| vent line pinch to print line pinch | CW until B is open; then CW until B is obstructed |
| dual pinch to print line pinch | CW until B is obstructed |
| dual pinch to vent line pinch | CCW until B is obstructed |
| print line pinch to vent line pinch | CCW until B is open; then CCW until B is obstructed |
| print line pinch to dual pinch | CCW until A is obstructed |
| unknown position to dual pinch | if A is open, CW until A is obstructed; if A is obstructed, CCW until A is open |
| unknown position to print line pinch | if B is open, CW until B is obstructed; if B is obstructed, CCW until B is open |
| unknown position to vent line pinch | if B is open, CCW until B is obstructed; if B is obstructed, CW until B is open |

In the above described embodiment of the 2-way pinch valve, the housing 381, the motor coupling 409*a*, the pinch elements 385,387, the cams 393 and the spring mounting members 399 are each preferably formed of a plastics material, such as 20% glass fibre reinforced acrylonitrile butadiene styrene (ABS) for the housing and motor coupling, 30% glass fibre reinforced Nylon for the pinch elements and Acetal copolymer (POM) for the cams and spring mounting members. Further, the cam shaft 391 and springs 395 are preferably formed of metal, such as stainless steel for the cam shaft and music wire for the springs.

The check valves 375 may be provided as mechanical one-way valves. The state of a mechanical check valve 375 may be controlled by the control electronics 802 of the printer 100 so that in the closed state of the check valve 375, the vent line 371 is isolated from the print line 380, and in the open state of the check valve 375, air can enter the system 300 via the de-prime vent 373. In such an example, the check valve 375 has a structure and function well understood by one of ordinary skill in the art. A single check valve 375 can be provided for a single de-prime vent 373 in the system 300, or if the system has multiple de-prime vents 373, such as five for the five ink channels discussed earlier, a separate check valve 375 can be provided for each de-prime vent 373.

In the illustrated embodiment of FIG. 24, the check valves 375 are provided as an integral part of the 2-way pinch valve 369 structure as passive elastomeric duckbill check valves 375 within the tubing of the vent lines 371 between the pinch element 387 and the de-prime vent 373. Duckbill check valves provide reliable backflow prevention at low pressure differentials. The duckbill check valves 375 of the illustrated embodiment are arranged to allow air to flow through the filters 377 to the corresponding vent lines 371 when the vent lines 371 are un-pinched by the pinch element 387 whilst preventing ink from flowing from the vent lines 371 to the filters 377 when the vent lines 371 are both un-pinched and pinched by the pinch element 387.

Positioning passive check valves in this manner prevents ink accumulating in the vent lines due to repeated pressure priming of the printhead (discussed later) in which small quantities of ink may be pushed past the pinched sections of the vent line tubing by the high fluid pressures used in the pressure priming. This accumulated ink could otherwise have adverse effects on the hydrophobic filter or cause ink leaks through the de-prime vent. The cracking pressure of each of the duckbill check valves 375 is sufficiently low so as to prevent interference with their function of de-priming the printhead 200 (discussed later).

The operations performed by the fluid distribution system 300 at the three valve states of the 2-way pinch valve 369 of the valve arrangement 367 are shown in Table 2 with respect to the print lines 380 and the vent lines 371. In Table 2, an "X" indicates that the associated state is selected and a blank indicates that the associated state is not selected. It is noted that when the vent lines 371 are open, the check valves 375 are also open and when the vent lines 371 are closed, the check valves 375 are also closed, due to the above-described nature and disposition of the check valves 375.

TABLE 2

2-way pinch valve states

| | PRINT LINES | | VENT LINES | |
|---|---|---|---|---|
| OPERATION | open | closed | open | closed |
| PRIME | X | | | X |
| PRINT | X | | | X |
| STANDBY | | X | | X |
| PULSE | | X | | X |
| DEPRIME | | X | X | |

The manner in which these state settings of the valve arrangement 367 are used is now discussed.

At first power up of the printer and at times subsequent to first power up when priming is required (such as at start up of the printer), the fluid distribution system 300 is primed by first performing a heavy flush and then a light pressure prime so that air in the printhead is displaced to the supply cartridges via their inlets, and so that it is ensured that the pump is fully wetted prior to beginning any further volumetric pumping procedures. For the heavy flush, the 2-way pinch valve is set to PRIME and the pump is operated in the clockwise direction for 50 to 100 revolutions at 200 rpm so that ink is moved from the supply cartridge outlets to the supply cartridge inlets via the print lines, printhead and pump lines thereby priming each closed loop. In the light pressure prime, the 2-way pinch valve is set to PULSE and the pump is operated in the counterclockwise direction for two revolutions at 325 rpm to cause ink to be egested from the nozzles of the printhead and then the maintenance system 600 is operated to wipe the ejection face of the printhead so as to remove the egested ink, as described later or in the incorporated description of the Applicant's US Provisional Patent Application No. 61/345,559.

Then, the 2-way pinch valve is set to PRINT.

It is important to note in this pressure prime procedure that the printhead wipe is performed before moving the 2-way pinch valve from the PULSE setting to the PRINT setting.

This is to prevent the ink on the ejection face of the printhead being sucked into the nozzles due to the negative fluid pressure at the nozzles which is established when the supply cartridge is reconnected to the printhead via the print line. Further, a delay of at least 10 seconds after finishing the wiping operation is observed before moving the 2-way pinch valve from the PULSE setting to the PRINT setting so as to minimize color mixing which the Applicant has found can result from the pressure priming. The spitting of 5000 drops from each nozzle of the printhead before setting the valve to PRINT has been found by the Applicant to sufficiently clear this color mixing. This spitting procedure equates to about 0.35 milliliters of ink being spat out by the entire printhead when the ejection drop size of each nozzle is about one picoliter.

When printing is to be carried out, a quick flush is periodically first performed. In the quick flush, the 2-way pinch valve is set to PRIME and the pump is operated in the clockwise direction for at least 10 revolutions at 200 rpm. Then printing is performed by setting the 2-way pinch valve to PRINT and ejection of ink from the nozzles causes ink flow from the supply cartridges to the printhead via the print lines. After printing, the 2-way pinch valve is set to STANDBY.

A user can request a printhead recovery procedure when printing problems are encountered. A user can initiate a recovery by selecting a recovery operation through a user interface of the printer which is connected to the control electronics. The recovery procedure defines escalating and decrementing recovery levels depending on the manner of the recovery request. At the lowest (first) recovery level, the afore-described heavy flush, printhead wipe and spitting operations are performed. At the next highest (second) recovery level, the afore-described heavy flush, light pressure prime, printhead wipe and spitting operations are performed. At the highest (third) recovery level, the afore-described heavy flush operation is performed then a heavy pressure prime is performed followed by the afore-described printhead wipe and spitting operations. In the heavy pressure prime, the 2-way pinch valve is set to PULSE and the pump is operated in the counterclockwise direction for three revolutions at 325 rpm to cause ink to be egested from the nozzles of the printhead The control electronics 802 includes a register which stores an updateable setting of the recovery level to be performed upon receipt of a recovery request. The first recovery level is set upon initial receipt of recovery request. The recovery level setting is incremented to the second recovery level and then the third recovery level whenever further recovery requests are received within 15 minutes of each prior recovery request. The recovery level setting is decremented to the next lowest recovery level depending on which recovery level was most recently performed whenever five print jobs are performed or 15 minutes elapse without receipt of a recovery request.

When printing is to be carried out, a quick flush is periodically first performed. In the quick flush, the 2-way pinch valve is set to PRIME and the pump is operated in the clockwise direction for at least 10 revolutions at 200 rpm. Then printing is performed by setting the 2-way pinch valve to PRINT and ejection of ink from the nozzles causes ink flow from the supply cartridges to the printhead via the print lines. After printing, the 2-way pinch valve is set to STANDBY.

When the printhead is to be removed from the fluid distribution system 300 or the printer is powered down, it is necessary to de-prime the printhead. In the de-prime procedure, the 2-way pinch valve is set to DEPRIME and the pump is operated in the clockwise direction for 25 to 30 revolutions at 100 to 200 rpm to de-prime the print lines, printhead and pump lines by allowing air to pass through the printhead from the de-prime vents which pushes the ink from the print lines, printhead and pump lines into the supply cartridges so that the ink is moved into the pump lines to at least a leak safe location downstream of the pump relative to the printhead. Then, the 2-way pinch valve is set to STANDBY, which closes the all of the print and vent lines thereby allowing leak safe removal of the printhead or the like.

The above described values for the pump operation in the various priming and de-priming procedures are approximate and other values are possible for carrying out the described procedures. Further, other procedures are possible and those described are exemplary.

The above described de-prime procedures of the multi-channel valve arrangement clears the printhead of ink with about 1.8 milliliters of ink being left in the printhead, which Was determined by the Applicant through relative weight measures of the printhead prior to first priming and after de-priming. This is considered as the dry-weight of the printhead.

Figure 28:
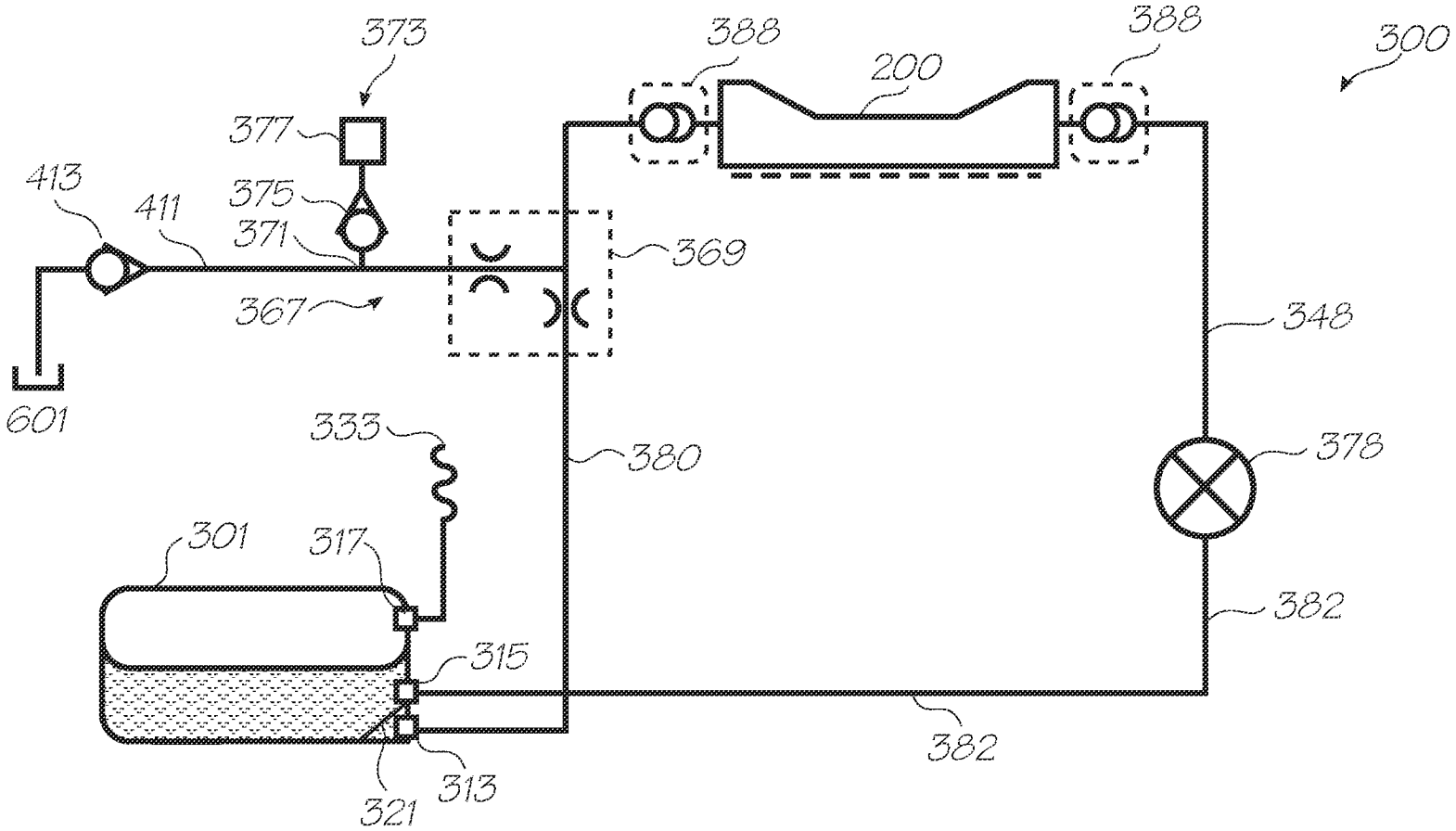
FIG. 28 schematically illustrates another embodiment of the fluid distribution system incorporating an on demand de-prime arrangement.

In an alternative embodiment of the fluid distribution system 300 having the 2-way pinch valve 369 illustrated in FIG. 28, on demand de-priming of the fluid distribution system 300 is provided. On demand de-priming may be useful in situations where it is desirable to drain some ink out of the supply cartridge or out of the vent lines of the supply cartridges which can fill with ink due to air expanding in the supply cartridge which can be caused by temperature and barometric changes in the environment.

The on demand de-primed fluid is purged to the fluid collection tray 601 via the vent lines 371 of the valve 369. This is achieved by positioning a purge line 411 on each vent line 371 between the pinch element 387 and the respective de-prime vent 373. Each purge line 411 terminates with a check valve 413, such as a passive elastomeric duckbill check valve, which is positioned so that ink can be ejected into the fluid collection tray 601. This arrangement allows the printhead to be de-primed and primed on demand with no wasting of ink and no net overflow of ink out of the supply cartridges.

In this alternative embodiment, the printhead is de-primed on demand as follows. The 2-way pinch valve is set to DEPRIME and the pump is operated in the clockwise direction for a number of revolutions to de-prime the printhead by allowing a 'slug' of air to pass through the printhead from the de-prime vents. Note that air has been introduced into the system so that an equal amount of fluid (air or ink) will overflow into the vent line of the supply cartridges.

The printhead is on demand re-primed by setting the 2-way pinch valve to DEPRIME (i.e., the same setting as during the on demand de-prime) and the pump is operated in the counterclockwise direction for the same, or nearly the same, number of revolutions as during the on demand de-prime to force the introduced 'slug' of air out through the purge lines 411. This action also pulls the ink or air back into the supply cartridge from the vent lines where it would have overflowed during the on demand de-prime. After this procedure, no net ink has been displaced in the fluid distribution system.

The above-described valve arrangements for the fluid distribution system 300 is exemplary, and other alternative arrangements are possible to provide selective fluid communication within the closed fluid loop of the system, such as the valve arrangements of the incorporated description of the Applicant's US Provisional Patent Application No. 61/345,552.

The maintenance system 600 is now described. The maintenance system 600 is similar in arrangement and operation as the maintenance system described in the Applicant's US Provisional Patent Application No. 61/345,552

The present maintenance system differs from the maintenance system of the incorporated description of the Applicant's US Provisional Patent Application No. 61/345,559 in the provision of a wiper module having a transfer roller and a scraper, a simplified waste fluid collection arrangement of the maintenance sled and a fluid collection tray. This and other components of the maintenance system 600 are now described in detail. Where suitable, the same reference numerals for the same components of the incorporated description of the Applicant's US Provisional Patent Application No. 61/345,559 are herein used.

The maintenance system 600 maintains the printhead 200, and thereby the fluid distribution system 300, in operational order throughout the operational life of the printhead 200.

After each print cycle of the printhead 200, and during periods of non-use of the printhead 200, the maintenance system 600 is used to cap the ejection nozzles of the printhead 200 so as to prevent drying of fluid within the nozzles. This reduces problems with subsequent printing due to blockages in the nozzles.

The maintenance system 600 is also used to clean the afore-mentioned printing face of the printhead 200, i.e., the surface of the printhead 200 containing the printhead ICs 204, by wiping the printhead ICs. Further, the maintenance system 600 is also used to capture fluid which the printhead 'spits' or egests from the nozzles during priming and maintenance cycles.

Further, the maintenance system 600 is also used to provide support for media during printing in a clean manner which minimizes fluid transfer onto the media.

Furthermore, the maintenance system 600 stores the ink and other printing fluids collected during these functions within the printer 100 for later disposal or re-use.

To achieve these functions, the maintenance system 600 employs the fluid collection tray 601 and a modular maintenance sled 603. The sled 603 defines a maintenance unit of the printer 100 and houses several maintenance devices or modules each having a different function. In the illustrated embodiment of FIGS. 29 and 30, the maintenance modules include a platen module 604, a wiper module 605 and a capper module 608. The fluid collection tray 601, sled 603 and wiper module 605 of the present embodiment are provided in place of fluid collector, sled and wiper module of the incorporated description of the Applicant's US Provisional Patent Application No. 61/345,559, whilst the platen and capper modules are configured and function in the same manner as described in the incorporated description of the Applicant's US Provisional Patent Application No. 61/345,559 and therefore detailed description of the platen and capper modules is not provided herein.

The sled 603 is housed by the printer housing 101 so as to be selectively displaceable relative to the printhead 200 and so that media for printing is able to pass between the printhead 200 and the sled 603. Further, the maintenance modules are displaceable with respect to the sled which forms a support frame for the modules. The displacement of the sled selectively aligns each of the maintenance modules with the printhead and the displacement of the aligned maintenance modules brings the aligned maintenance modules into operational position with respect to the printhead. This operation of the sled and displacement of the maintenance modules is described later and in further detail in the incorporated description of the Applicant's US Provisional Patent Application No. 61/345,559.

Figure 29:
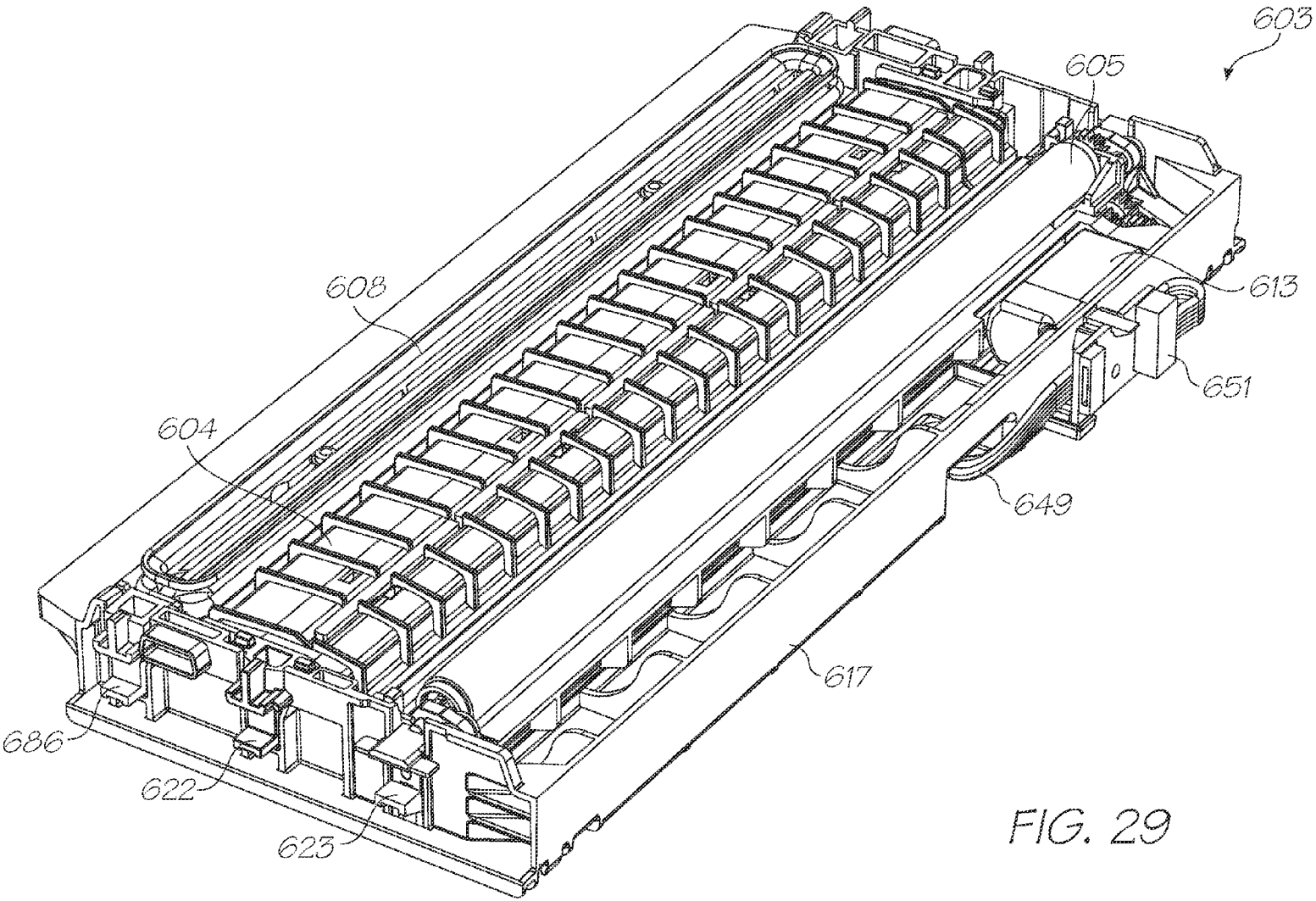
FIG. 29 illustrates a modular maintenance sled of an exemplary embodiment of the maintenance system.
Figure 30:
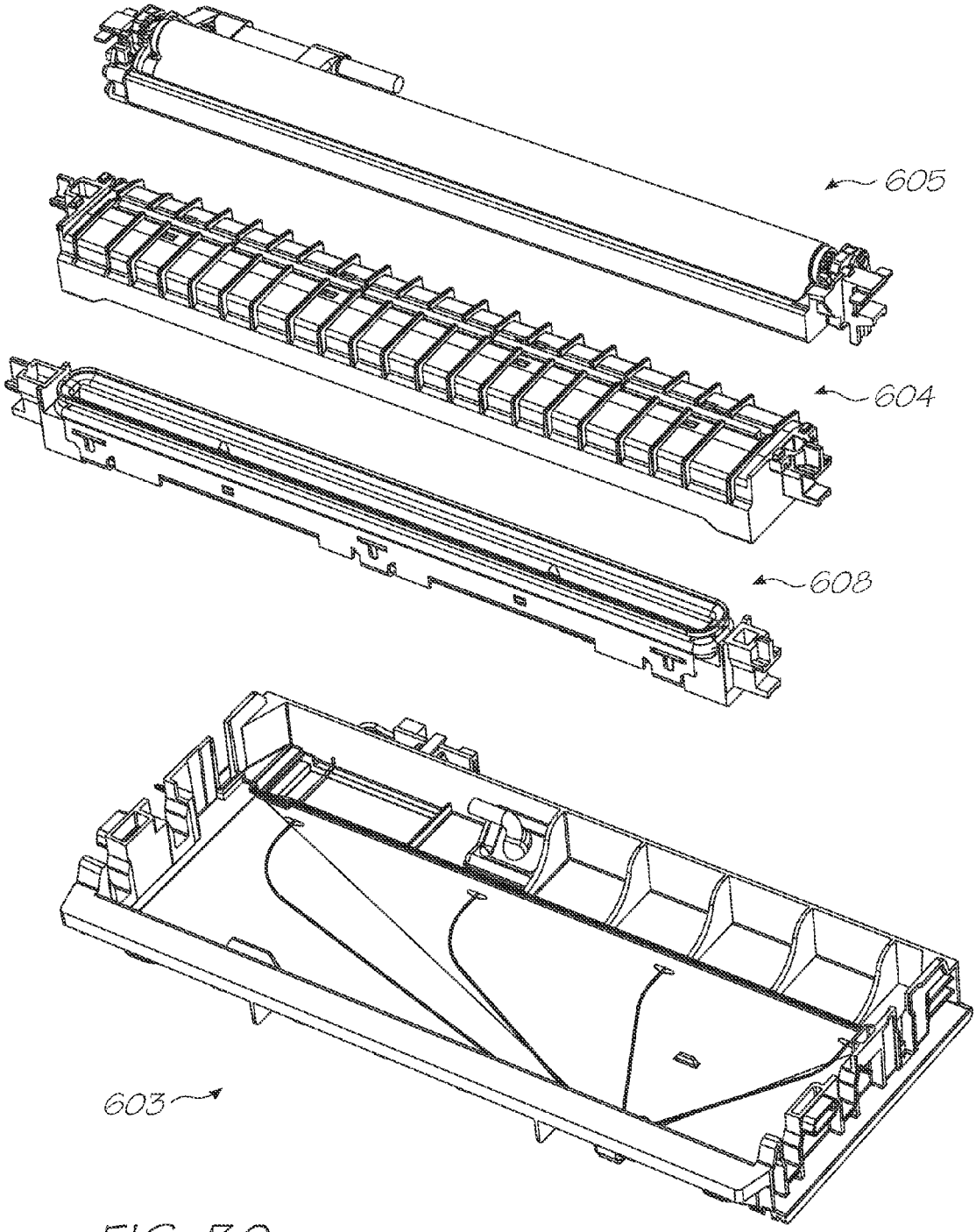
FIG. 30 is an exploded view of the maintenance sled.
Figure 31:
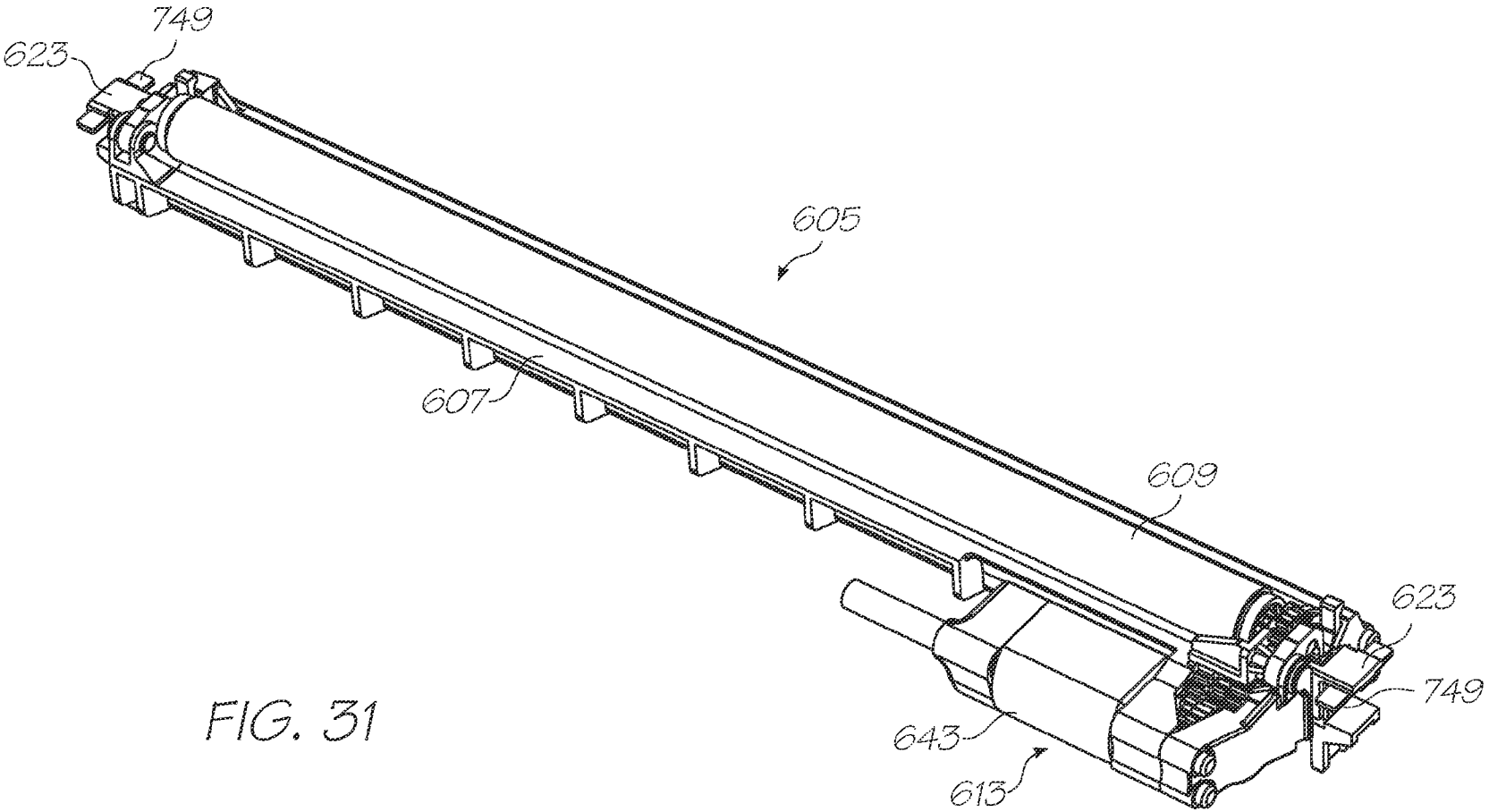
FIG. 31 illustrates a wiper module of an exemplary embodiment of the sled.

FIGS. 29-38G illustrate various exemplary aspects of the wiper module 605. The wiper module 605 is an assembly of a body 607, a wiper element 609, a transfer element 611, a drive mechanism 613 and a scraper element 615. The body 607 is elongate so as extend along a length longer than the media width of the printhead 200. The wiper module 605 is housed within an elongate frame 617 of the sled 603 so as to be adjacent the platen module 604, as illustrated in FIG. 29. The frame 617 has a base 619 and sidewalls 621 projecting from the base 619 within which notches 621*a* are defined.

The notches 621*a* removably receive retainer elements 622 at the longitudinal ends of the platen module 604, retainer elements 623 at the longitudinal ends of the body 607 of the wiper module 605, and retainer elements 686 at the longitudinal ends of the capper module 608. This engagement of the notches and retainers allows the platen, wiper and capper modules to be held by the frame 617 in an unsecured, yet constrained manner. That is, the modules effectively "float" within the sled, which facilitates the displacement of the modules relative to the sled. The wiper module 605 is assembled in the frame 617 so that the wiper element 609 faces the printhead 200 when the wiper module 605 is in its operational position.

The wiper element 609 is an assembly of a wiper roller 625 held on a shaft 627 by collars 629. The wiper roller 625 has a length at least as long as the media width of the printhead 200 and is removably and rotatably mounted to the body 607 by retention clips 631 at either longitudinal end of a recess 633 formed by the base 619 and sidewalls 621 of the body 607. The retention clips 631 are pivotally mounted to the body 607 so as to provide a simple mechanism for removing and replacing the wiper roller 625 when required.

The wiper roller 625 is caused to rotate through rotation of the shaft 627 by the drive mechanism 613. This rotation is achieved through the cooperation of a wiper gear 635 fixedly mounted on one end of the shaft 627 with a drive gear train 637 of the drive mechanism 613. The gears of the gear train 637 are rotatably mounted to the body 607 by a manifold 639 and cooperate with a motor gear 641 of a motor 643 of the drive mechanism 613. The motor 643 is mounted to the body 607 and constitutes an on-board motor of the wiper module 605. The rotation of the wiper roller 625 is used to wipe ink from the printing face of the printhead 200, as discussed in detail later.

The transfer element 611 has a non-porous transfer roller 645 which has a length as long as the length of the wiper roller 625 and is either integrally formed with pins 647 at either longitudinal end or mounted on a shaft 647. The transfer roller 645 is removably and rotatably mounted to the body 607 at either longitudinal end of the recess 633 by engaging the pins or shaft 647 within corresponding holes 607*a* in the body 607. In this assembled arrangement, removal of the transfer roller 645 is possible upon removal of the wiper roller 625 from the body 607. However, other relative mounting arrangements are possible in which the transfer roller is accessible independent of the wiper roller.

The transfer roller 645 is caused to rotate by the drive mechanism 613. This rotation is achieved through the cooperation of a transfer gear 649 fixedly mounted on one of the pins 647 or one end of the shaft 627 with the gear train 637 of the drive mechanism 613. This rotation of the transfer roller 645 is used to clean the wiper roller 625, as discussed in detail later.

The on-board motor 643 of the wiper module 605 is powered through a flexible connection 649 with a power coupling 651 mounted on the frame 617 of the sled 603 which is coupled with a power supply (not shown) of the printer 100 under control of the control electronics 802.

As the wiper module 605 is lifted from the frame 617 of the sled 603 into its operational position at which the wiper roller 605 contacts the printing face of the printhead 200, position sensors on the printer housing 101 which communicate with the control electronics 802 sense the lifted position of the wiper module 605. One of ordinary skill in the art understands possible arrangements of such position sensors, so they are not discussed in detail herein. This sensing of the lifted position of the wiper module is used to control rotation of the wiper roller prior to contact with the printing face of the printhead so that the wiper roller is already rotating as it contacts the printhead. This rotating contact reduces the amount of blotting of the nozzles of the printhead by the wiper roller which could otherwise disturb the menisci within the nozzles and prevents un-desired deformation of the wiper roller about its circumference.

The rotational wiping of ink, other fluids and debris, such as media dust and dried ink. from the printing face of the printhead 200 by the wiper roller 625 is primarily performed after priming of the printhead 200 and after completion of a printing cycle, as described earlier. However, wiping can be performed at any time through selection of the wiper module 605.

The removal of ink and other fluids from the printing face of the printhead 200 is facilitated by forming the wiper roller 625 of a porous wicking material which is compressed against the printing face so as to encourage wicking of the fluid into the wiper roller 625, and the removal of debris from the printing face is facilitated by the rotation of the wiper roller 625.

Figure 32:
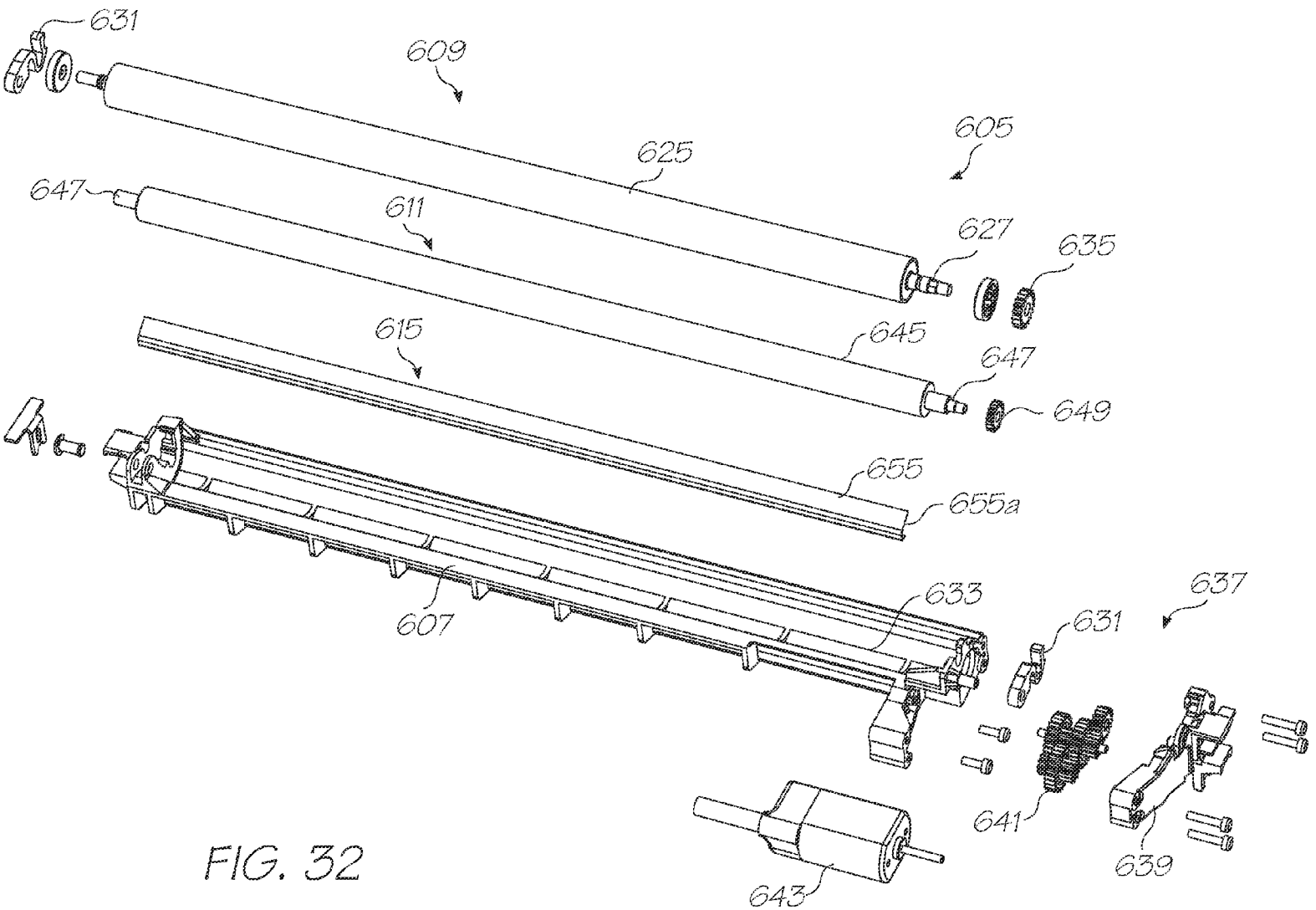
FIG. 32 is an exploded view of the wiper module.

In the illustrated embodiment of FIG. 32, the wiper roller 625 has a compressible core 625*a* mounted to the shaft 627 and a porous material 625*b* provided over the core 625*a*. In the exemplary embodiment, the core 625*a* is formed of extruded closed-cell silicone or polyurethane foam and the porous material 625*b* is formed of non-woven microfiber. Using microfiber prevents scratching of the printing face, whilst using non-woven material prevents shedding of material strands from the wiper roller and into the nozzles of the printhead. The non-woven microfiber is wrapped about the core by a spiralling technique so that at least two layers of the microfiber are present about the core with an adhesive between the layers. Using two or more layers provides sufficient fluid absorption and compressibility of the porous material from the core, which aids fluid absorption, whilst spiralling reduces the possibility of the porous material being unwrapped from the core during the high-speed rotation of the wiper roller.

The Applicant has found that the use of microfiber which is compressed against the printing face of the printhead whilst rotating the microfiber, causes ink to be drawn from the nozzles into the microfiber by capillary action. The amount of ink drawn from the nozzles is not so much that drying of the nozzles occurs, but is sufficient to remove any dried ink from within the nozzles.

In order to prevent to core from absorbing the fluid collected in the microfiber, which could otherwise cause oversaturation of the wiper roller 625 leading to transfer of the absorbed fluid back to the printhead 200, a hydrophobic film, such as pressure sensitive adhesive, is disposed between the core 625*a* and the porous material 625*b*.

Fluid and debris collected on the surface of the wiper roller 625 is further prevented from being transferred back to the printing face by arranging the transfer roller 645 in contact with the wiper roller 625. The transfer roller 645 is arranged to contact the outer porous material 625*b* of the wiper roller 625 along the elongate length of the wiper roller 625 on a vertical circumferential region of the wiper roller below the upper circumferential region of the wiper roller which contacts the printing face of the printhead 200, as illustrated in the cut-away partial detailed view of FIG. 33. Further, the transfer roller 645 is preferably formed as a smooth cylinder of solid material, such as solid steel, stainless steel, or other metal or plated metal, so long as the material is resistant to corrosion, particularly in ink environments, and is durable. Such a smooth metallic transfer roller 645 can be machined to integrally include the pins 647.

This smooth and solid form of the transfer roller 645 and its contact with the wiper roller 625 causes removal of fluid and debris from the wiper roller 625 by capillary action through the porous material 625*b*, compression of the compressible core 625*a* of the wiper roller 625, preference of fluid to move to areas of less saturation and the shear of the wiper and transfer rollers 625,645 provided by their rotated contact. The fluid removed from the wiper roller 625 drains under gravity into a drainage area 653 in the base 619 of the sled 603 through holes 607*b* in the body 607 of the wiper module 605, as is illustrated in FIG. 33 and as discussed in more detail later.

Figure 33:
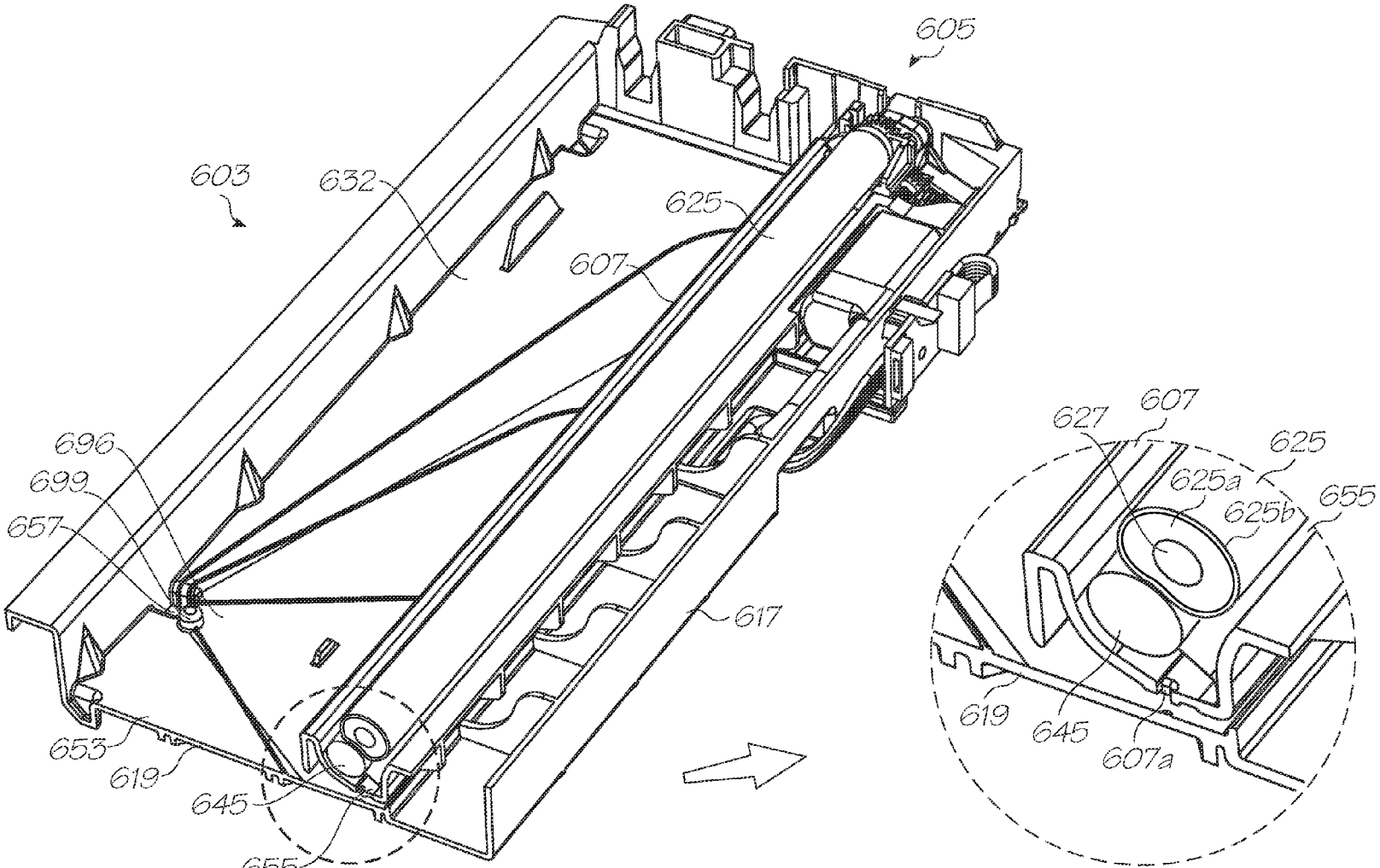
FIG. 33 is a cross-sectional view of the sled illustrating the wiper module position.

In the illustrated embodiment, the wiper and transfer rollers are geared together through the driven gear train of the drive mechanism to rotate in the same direction, however other geared arrangements are possible in which the wiper and transfer rollers rotate in opposite directions, so long as the transfer roller exerts contact pressure on the compressible wiper roller in a region of wiper roller which is rotationally returning to the upper circumferential region of the wiper roller in the rotational direction of arrow A illustrated in FIG. 33. That is, the transfer roller is positioned upstream of the rotational wiping direction of the wiper roller. This positional arrangement ensures that fluid and particles are removed by the transfer roller from portions of the wiper roller prior to those portions re-contacting the printhead.

The cleaning of the wiper roller by the transfer roller can also be effected when the wiper module is not in its operational position for wiping the printhead, i.e., the wiper module is in the non-lifted (home) position in the sled 603, since the on-board motor 643 and drive train 637 of the wiper module 605 can be operated in any operative or non-operative position of the wiper module.

The scraper element 615 has a scraper or doctor blade 655 which has a length as long as the length of the transfer roller 645 and is mounted within the recess 633 of the body 607 so as to contact the transfer roller 645. The doctor blade 655 is formed from a thin sheet of resilient material, preferably steel or Mylar, however other materials which are inert to ink and other printing fluids can be used. The doctor blade 655 has a cantilevered section 655*a* so as to form a sprung squeegee. The free end of the cantilevered section 655*a* contacts the outer surface of the transfer roller 645 to wipe the transfer roller 645 clean as the transfer roller 645 rotates thereagainst.

The doctor blade 655 is arranged to contact the transfer roller 645 along the elongate length of the transfer roller 645 on a vertical circumferential region of the transfer roller below the upper circumferential region of the transfer roller which contacts the wiper roller 625, as illustrated in the cut-away partial detailed view of FIG. 33. The cleaning of the transfer roller by the thus arranged scraper element 615 provides a newly clean transfer roller surface to be exposed to the wiper roller surface. Like the fluid transferred from the wiper roller 625, the fluid removed from the transfer roller 645 drains under gravity into the drainage area 653 in the base 619 of the sled 603.

Figure 34:
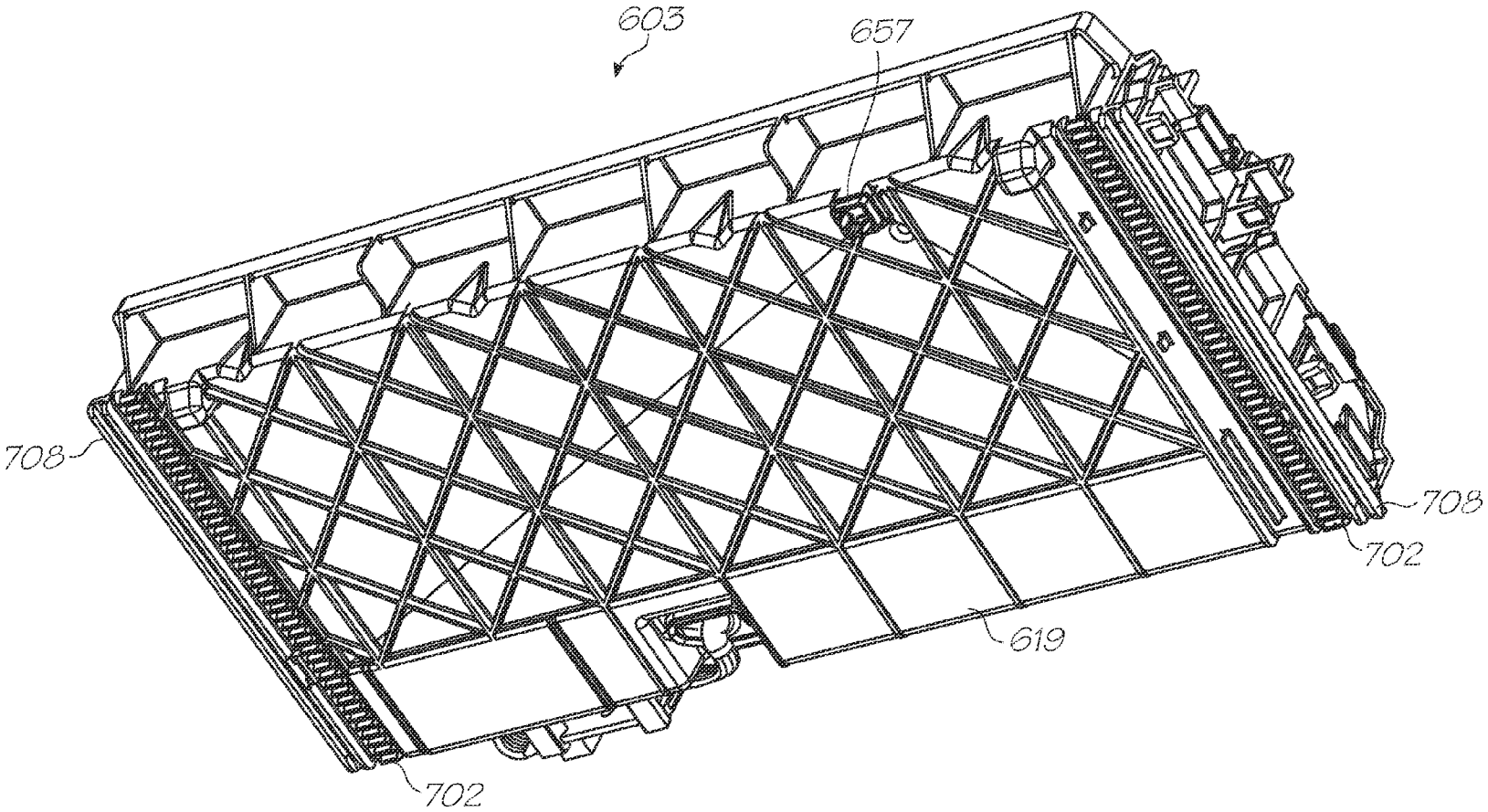
FIG. 34 is a bottom isometric view of the sled.
Figure 35:
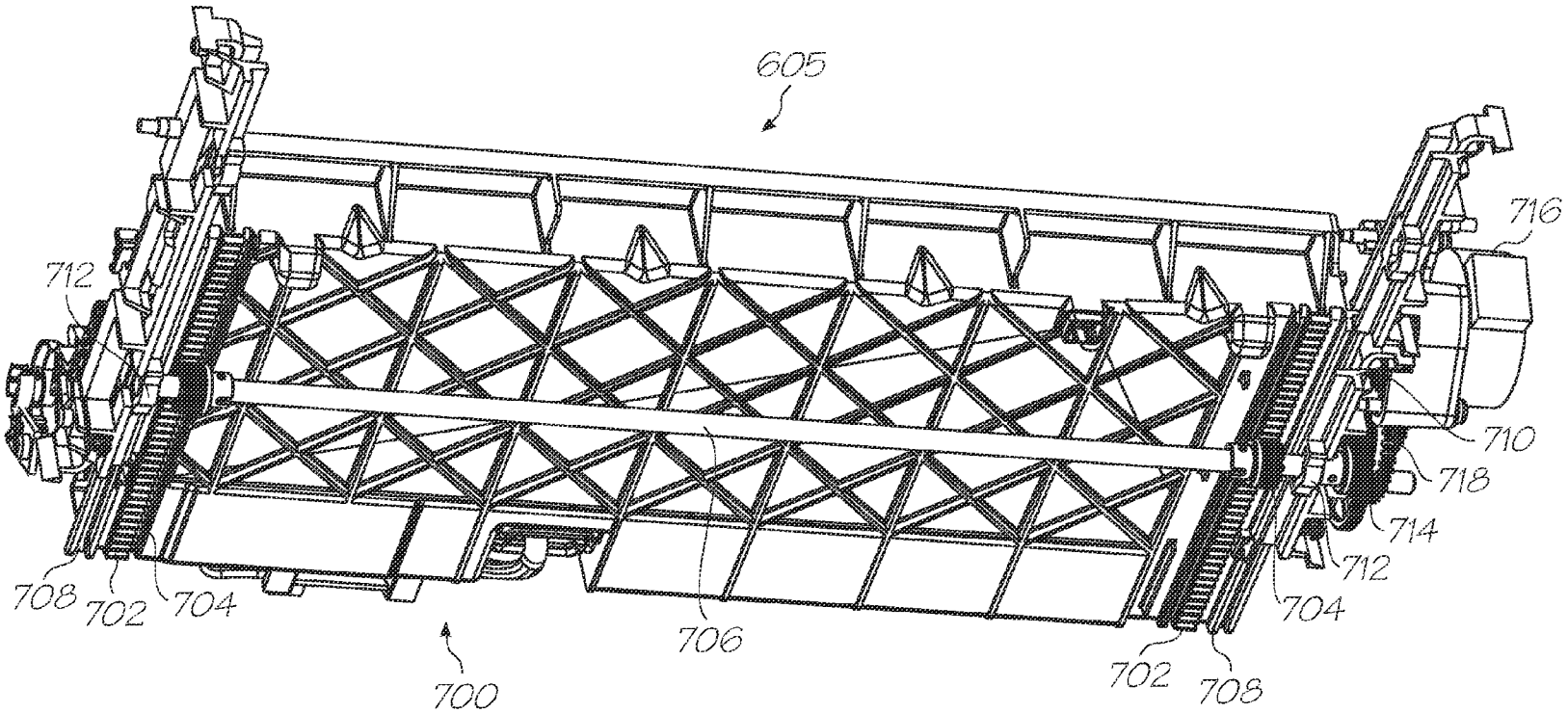
FIG. 35 illustrates a translation mechanism of the sled.

FIGS. 34 and 35 illustrate various exemplary aspects of a displacement mechanism 700 for the modular sled 603. The displacement mechanism 700 is similar to that described in incorporated description of the Applicant's US Provisional Patent Application No. 61/345,559 and therefore the same reference numerals are used herein where suitable.

The displacement mechanism 700 is used to provide the selective displacement of the sled 603 relative to the printer housing 101 and the printhead 200 which selectively aligns each of the maintenance modules with the printhead. In the illustrated embodiment, the displacement mechanism 700 is a dual rack and pinion mechanism, having a rack 702 at either elongate end of the sled 603, which are aligned with the media travel direction when sled 603 is installed in the printer 100, and a pinion gear 704 at either end of a shaft 706, which is rotationally mounted to the printer housing 101 so as to be aligned with the media width direction. The sled 603 is mounted to the printer housing 101 at the racked ends through sliding engagement of rails 708 on the sled 603 with linear bushings 710 mounted on the printer housing 101 (omitted in FIG. 35).

One end of the shaft 706 has a drive gear 714 coupled to a motor 716 via a gear train 718. The motor 716 is controlled by the control electronics 802 to drive rotation of the shaft 706 via the coupled gears thereby sliding the sled 603 along the linear bushings 710. Selective positioning of the sled 603 to align the modules with the printhead is achieved by providing position sensors which communicate with the control electronics. One of ordinary skill in the art understands possible arrangement of such position sensors, so they are not discussed in detail herein.

The use of the dual rack and pinion mechanism for translating the sled relative to the printhead, provides un-skewed and accurate displacement of the sled, which facilitates true alignment of the modules with the printhead. Other arrangements are possible however, so long as this un-skewed and accurate displacement of the sled is provided. For example, a belt drive system could be employed to displace the sled.

Figure 36A:
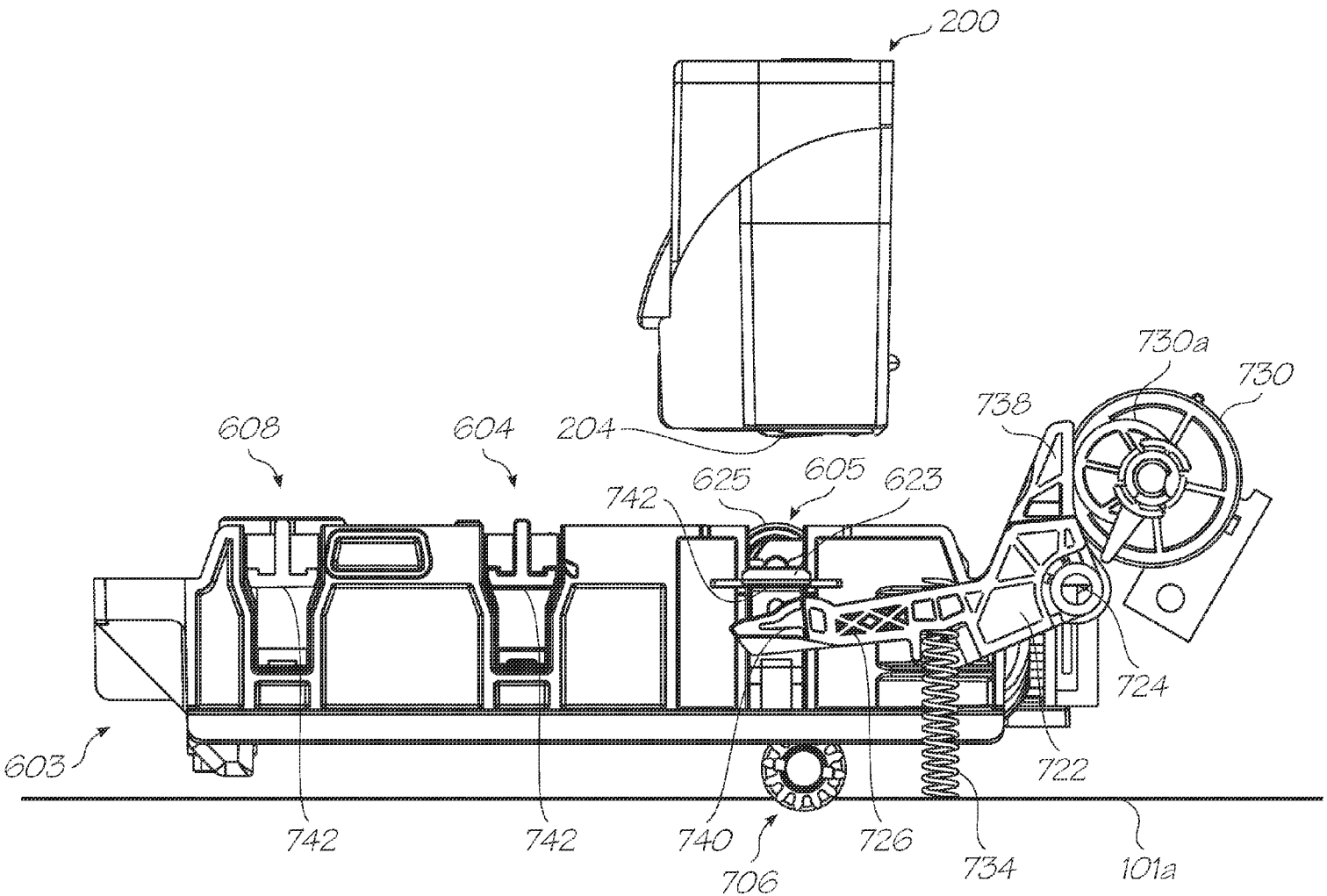
FIG. 36A is a cross-sectional view of the printer with most components omitted and illustrating the wiper module engaged with a lift mechanism in a non-lifted position.
Figure 36B:
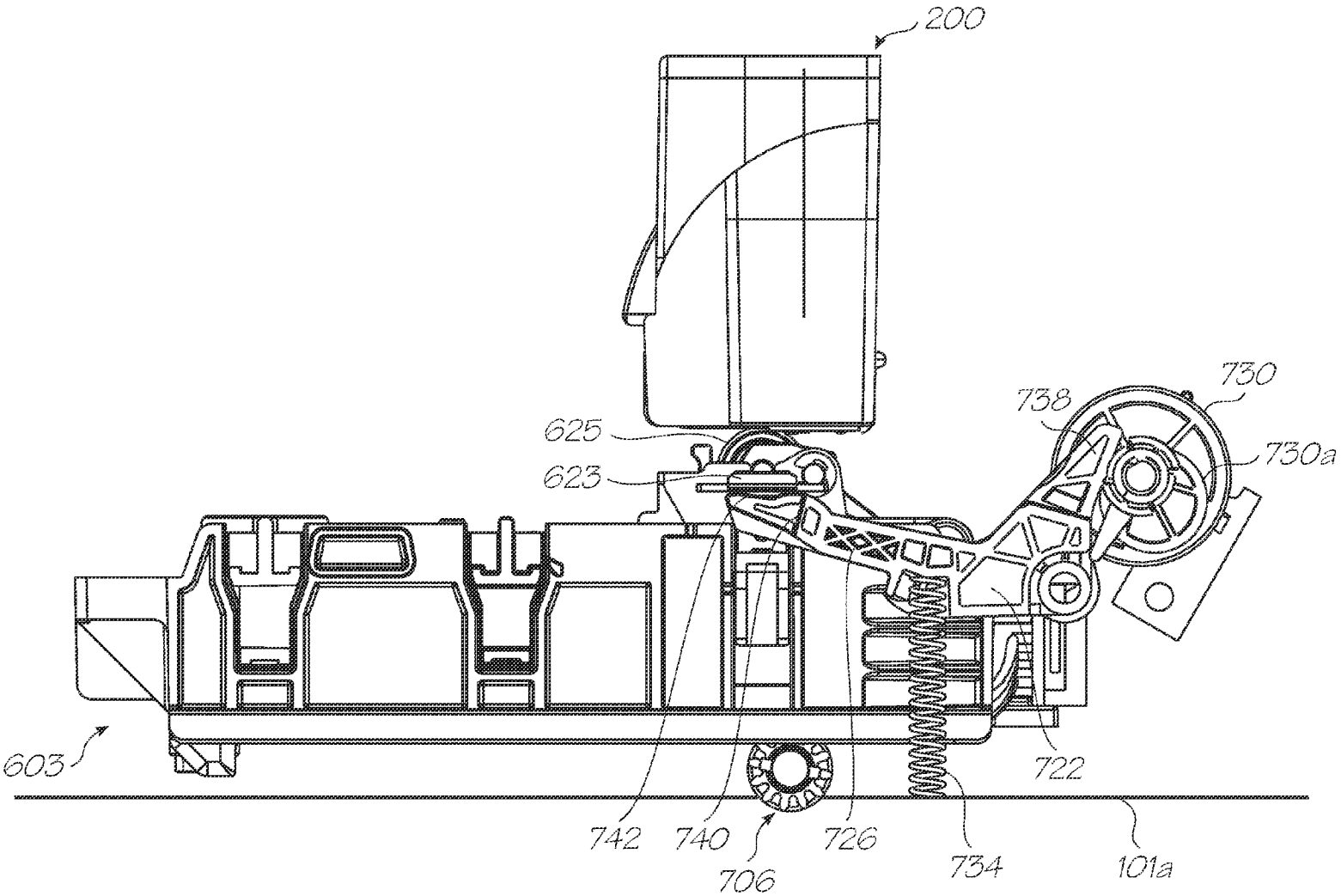
FIG. 36B illustrates the wiper module engaged with the lift mechanism in a lifted position.
Figure 36C:
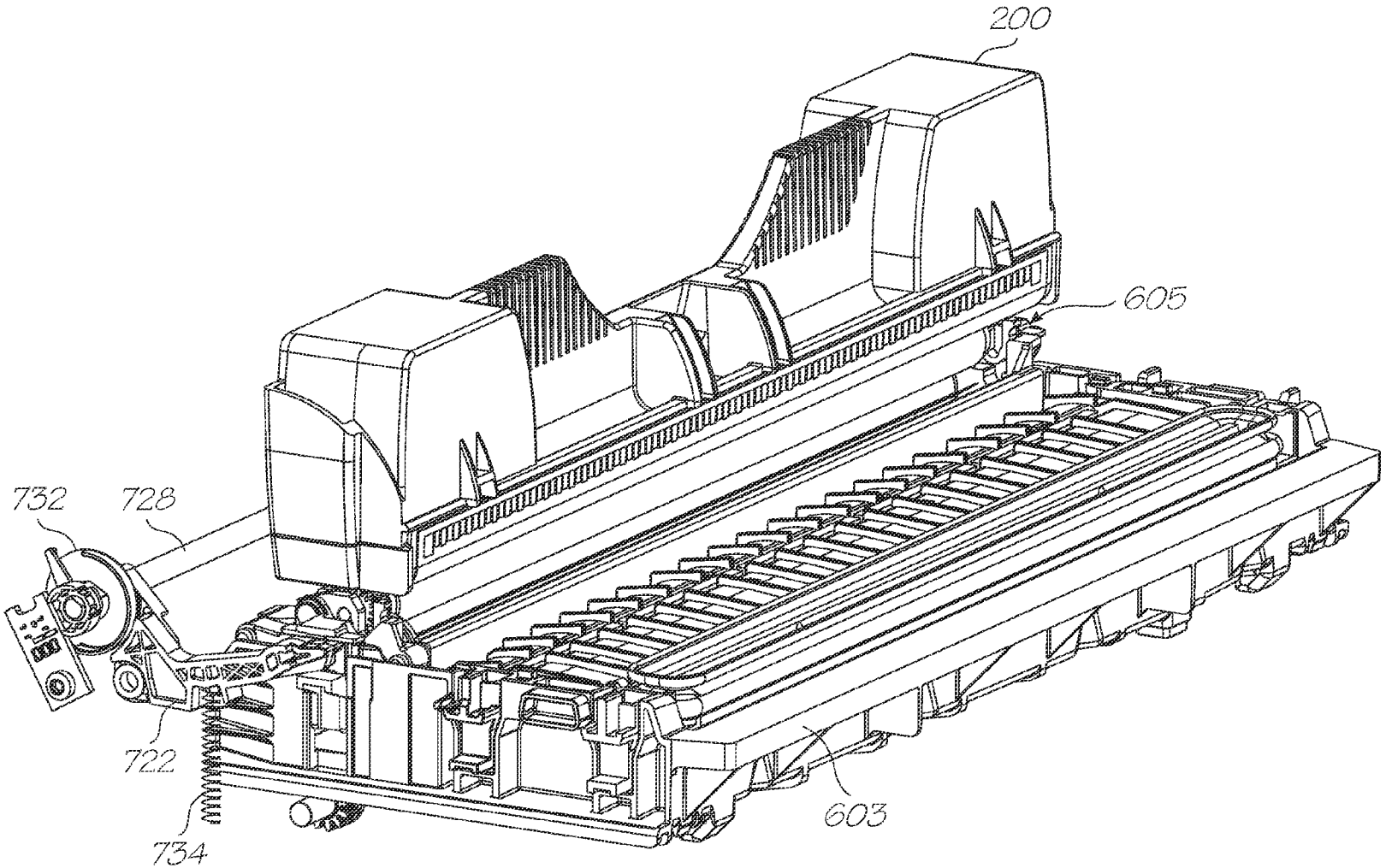
FIG. 36C illustrates the wiper module in an operational position relative to the printhead.
Figure 37:
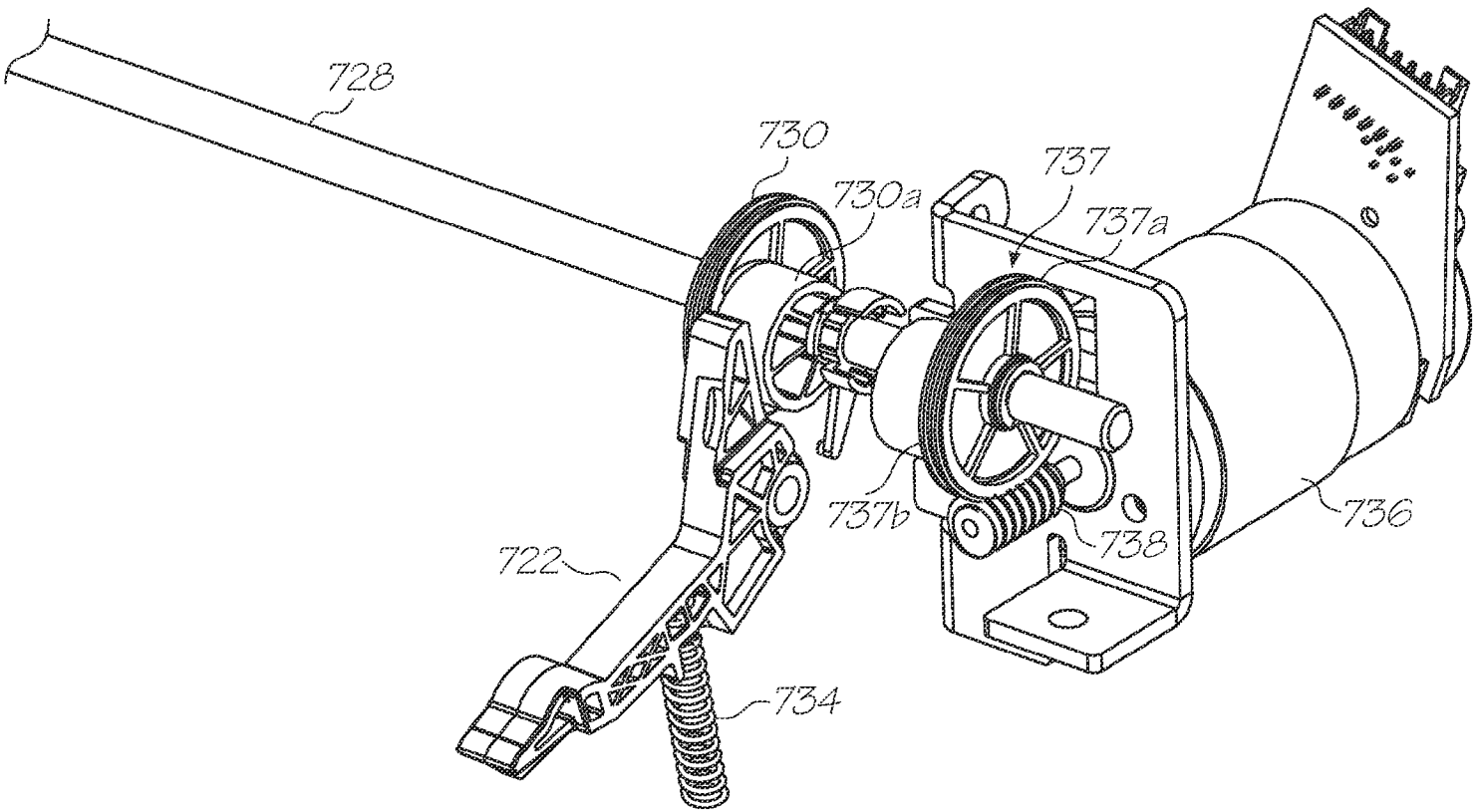
FIG. 37 is a close up view of one section of the lift mechanism.

Once a selected one of the modules is aligned with the printhead, the aligned module is lifted from the sled into its respective afore-described operational position. Lifting of the modules is performed by a lift mechanism 720, various exemplary aspects of which are illustrated in FIGS. 36A-37 with respect to the wiper module 605. The lift mechanism 720 is similar to that described in incorporated description of the Applicant's US Provisional Patent Application No. 61/345,559 and therefore the same reference numerals are used herein where suitable.

The lift mechanism 720 has rocker arms 722 which are pivotally mounted to a lower (first) housing section 103 of the printer housing 101 at either sidewall 103*a* of the lower housing section 103 at a pivot point 724. Each rocker arm 722 has an arm portion 726 and a cam follower portion 728 defined on opposite sides of the respective pivot point 724.

The lift mechanism 720 also has a cam shaft 728 which is rotationally mounted between the sidewalls 103*a* to be aligned with the media width direction. The cam shaft 728 has cam wheels 730 and 732 at respective ends thereof. The cam shaft 728 is disposed so that an eccentric cam surface 730*a*, 732*a* of each respective cam wheel 730,732 is in contact with the cam follower portion of a respective one of the rocker arms 722. The eccentric cam surfaces 730*a*,732*a* of the eccentric cams 730,732 are coincident with one another, such that rotation of the cam shaft 728 causes simultaneous and equal pivoting of the rocker arms 722 through rotated contact of the eccentric cam surfaces 730*a*,732*a* against the cam followers 728. It is noted that in FIG. 36C the eccentric cam surface 732*a* of the eccentric cam 732 is obscured from view, FIGS. 44A, 44B and 46 of the previously incorporated in the Applicant's US Provisional Patent Application No. 61/345,559 illustrate the eccentric cam surface 732*a* of the eccentric cam 732 more clearly.

This pivoting of the rocker arms 722 is constrained by the profile of the eccentric cam surfaces 730*a*,732*a* and by a spring 734 mounted between each rocker arm 722 and a base 101*a* of the printer housing 101. In the illustrated embodiment, the springs 734 are compression springs, such that when the rocker arms 722 are pivoted to their lowest orientation the springs 734 are compressed, as illustrated in FIG. 36A, and when the rocker arms 722 are pivoted to their highest orientation the springs 734 are at their rest position, as illustrated in FIG. 36B.

Rotation of the cam shaft 728 is provided by a motor 736 which is mounted on an outer surface of one of the sidewalls 103*a*. The cam shaft 728 projects through this sidewall 103*a* so that the cam wheel 730 is disposed on the internal side of the sidewall 103*a*, with respect to the internal disposition of the maintenance sled 603, and a worm gear 737 on the cam shaft 728 is disposed on the external side of the sidewall 103*a*. The motor 736 is disposed on the sidewall 103*a* so that a worm screw 738 of the motor 736 contacts an outer circumferential surface 737*a* of the worm gear 737 and meshes with ridges 737*b* along the outer circumferential surface 737*a*, as illustrated in FIG. 37. The threads of the worm screw 738 are helical, preferably right-handed with a 5° orientation and an involute profile. Likewise, the ridges 737*b* are helical, preferably right-handed with a 5° orientation and an involute profile.

Accordingly, rotation of the worm screw 738 through operation of the motor 736 under control of the control electronics 802 causes rotation of the cam wheel 737 which rotates the cam shaft 728. The rotated position of the eccentric cam surfaces 730*a*,732*a* is determined by an optical interrupt sensor 739 mounted on the sidewall 102*a* of the printer housing 102 adjacent the other cam wheel 732. The optical interrupt sensor 739 cooperates with a slotted outer circumferential surface 732*b* of the cam wheel 732, as illustrated in FIG. 36C, in a manner well understood by one of ordinary skill in the art.

When the sled 603 is being translated by the displacement mechanism 700 to select one of the maintenance modules, the cams are controlled so that the rocker arms 722 are at their lowest position. In this lowest position, projections 740 of the arm portions 726 of the rocker arms 722, which project toward the sled 603, are able to pass through recesses in the retainer elements of the modules, such that displacement of the sled 603 is not inhibited. Once the selected module is in position, the cams are controlled so that the rocker arms 722 are moved to their highest position.

During this transition of the rocker arms 722 from the lowest to the highest position, the projections 740 engage lift surfaces 742 of the retainer elements 622,623,686. This engagement causes the selected module to be lifted with the rocker arms 722. The lift surfaces 742 are parallel to the base 619 of the sled 602 and are substantially flat. That is, in the illustrated embodiment the flat lift surfaces are horizontal. The retainer elements 623 of the wiper module 605 have stiffening elements 749 at which the projections 740 of the rocker arms 722 contact the lift surfaces 742. The stiffening elements 749 provide increased rigidity to the retainer elements throughout lifting and lowering of the wiper module 605.

Like the wiper module described in the incorporated description of the Applicant's US Provisional Patent Application No. 61/345,559, the present wiper module 605 is configured to be translated back and forth along the media travel direction so that the wiper roller 605 is rotationally wiped across the printing face of the printhead 200. This displacement of the wiper module relative to the printhead during wiping maximizes the amount of fluid and debris that can be wiped from the printhead. That is, a greater surface area of the printing face can be wiped by moving the wiper module and wiping in difficult areas to wipe due to the different topographical levels on the printing face provided by the different components can be achieved.

This translational wiping operation is achieved by displacing the sled 603 whilst the wiper module 605 is in its lifted (wiping) position with the wiper roller 625 contacting the printhead 200 and rotating under drive of the drive mechanism 613. As is illustrated in FIG. 36B, the notches 621*a* in the sidewalls 621 of the sled frame 617 are dimensioned so that, in the wiping position, the retainer elements 623 of the wiper module 605 do not leave the constraint of the notches 621*a*. Accordingly, as the sled 603 is displaced the wiper module 605 is also displaced in the same manner.

The on-board motor 643 of the present wiper module 605 allows retained connection to the power supply of the printer 100 through the flexible connection 649 in a large range of lifted and translated positions of the wiper module 605. This large range of translated wiping enables wiping of only a selected surface area of the printing face of the printhead up to wiping of the entire surface area of the printing face thereby providing an effective total cleaning operation of the printhead.

Figure 38A:
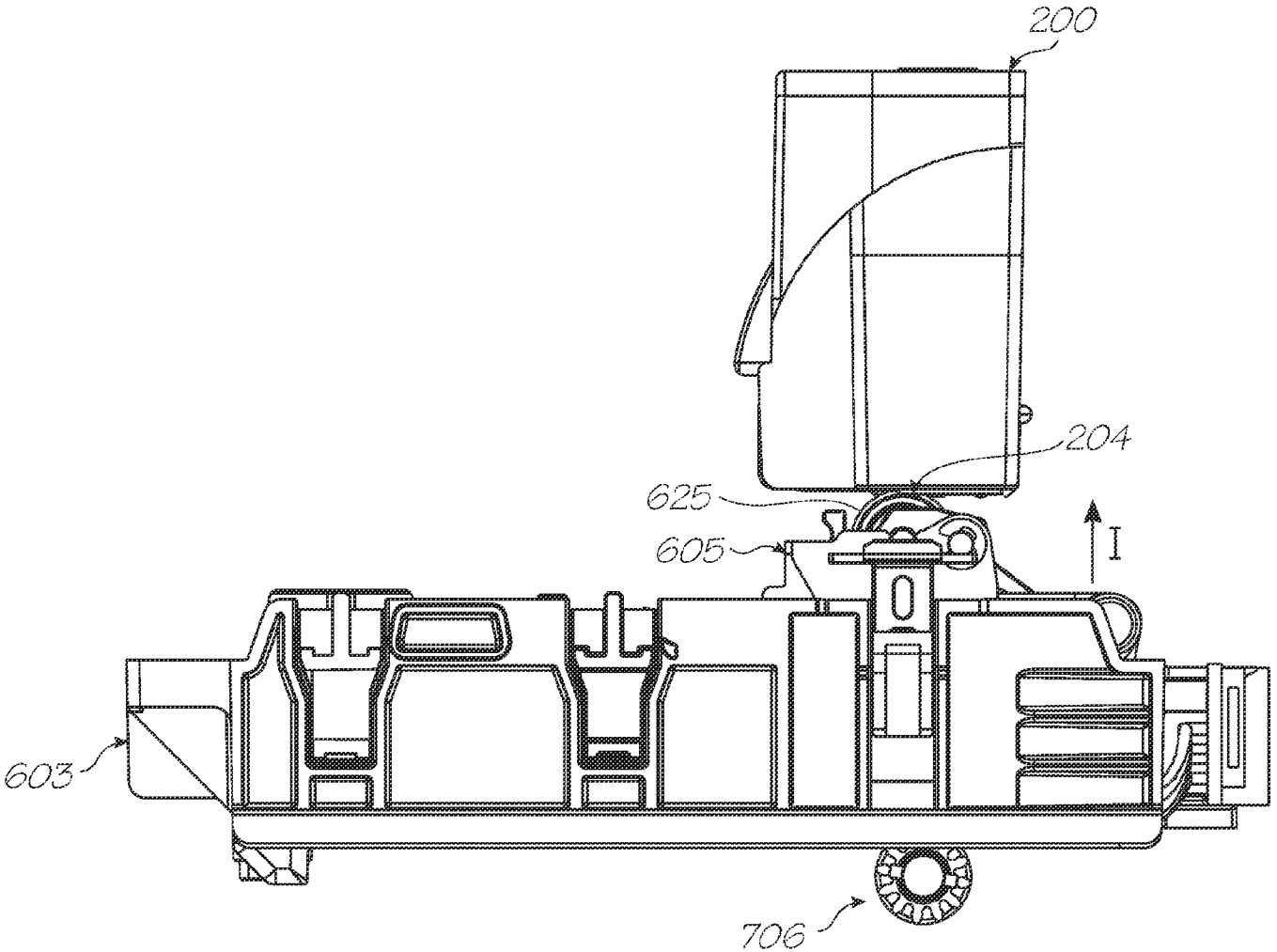
FIGS. 38A-38G illustrate different schematic views of exemplary translated wiping movements of the wiper module.
Figure 38B:
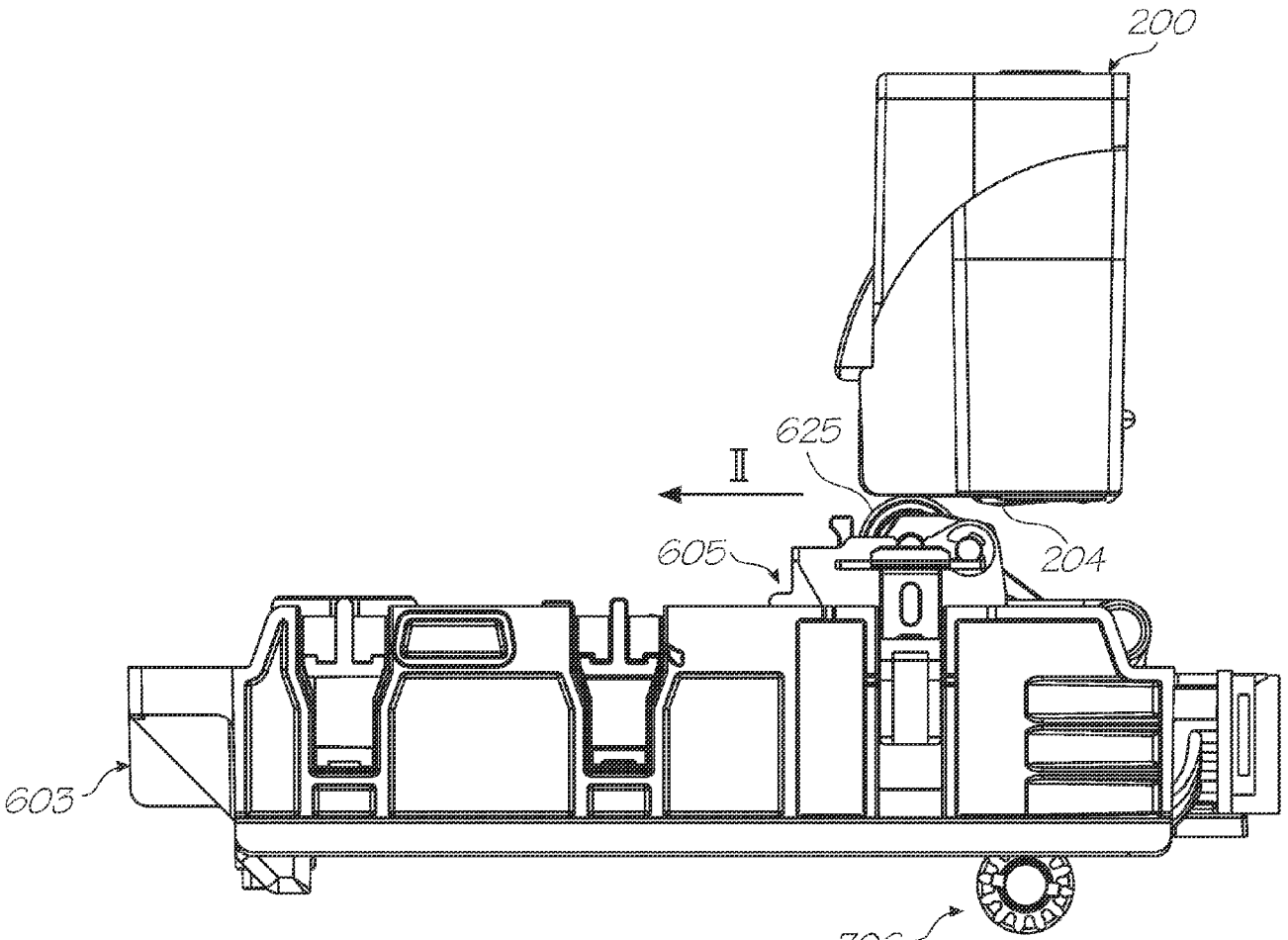
Figure 38C:
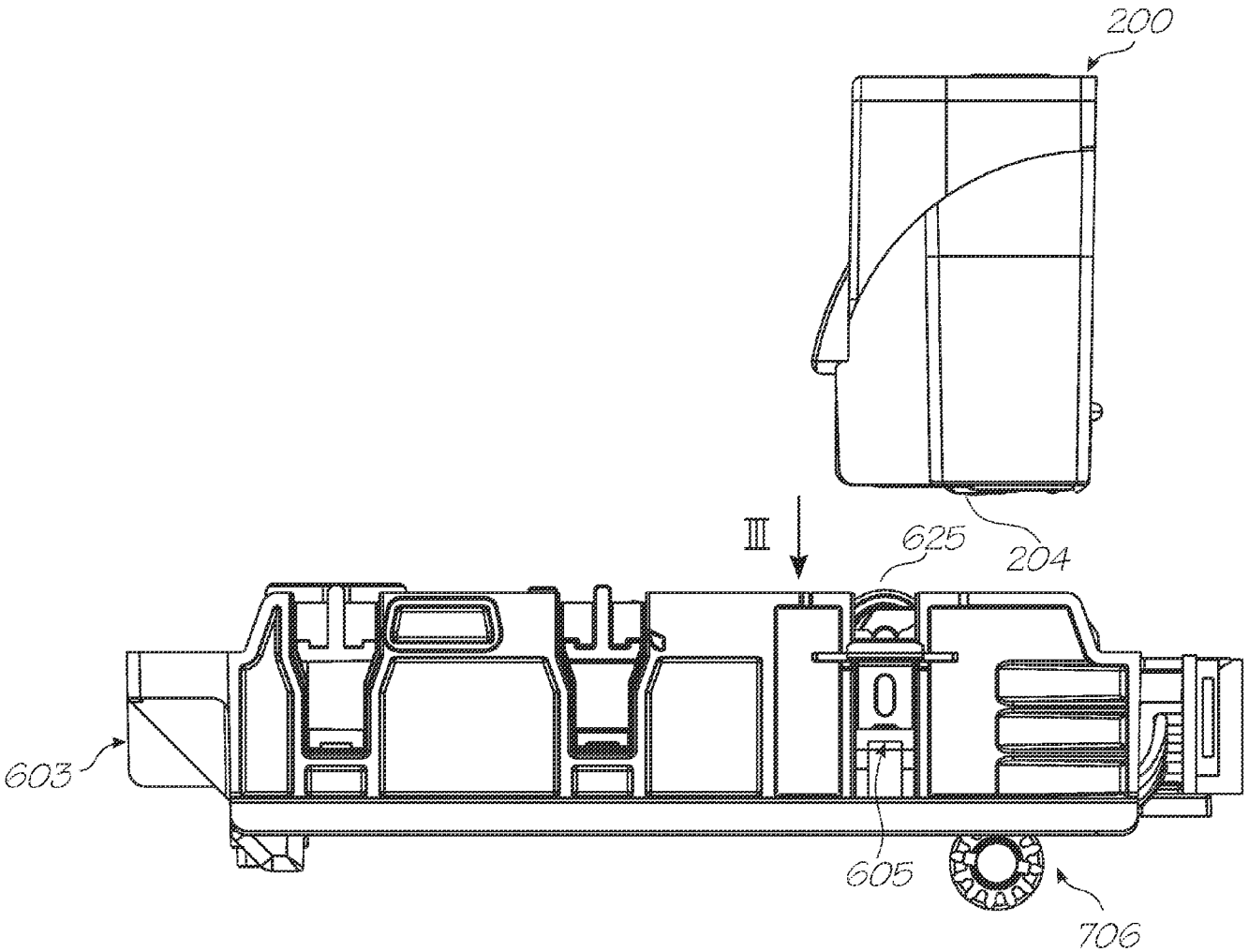
Figure 38D:
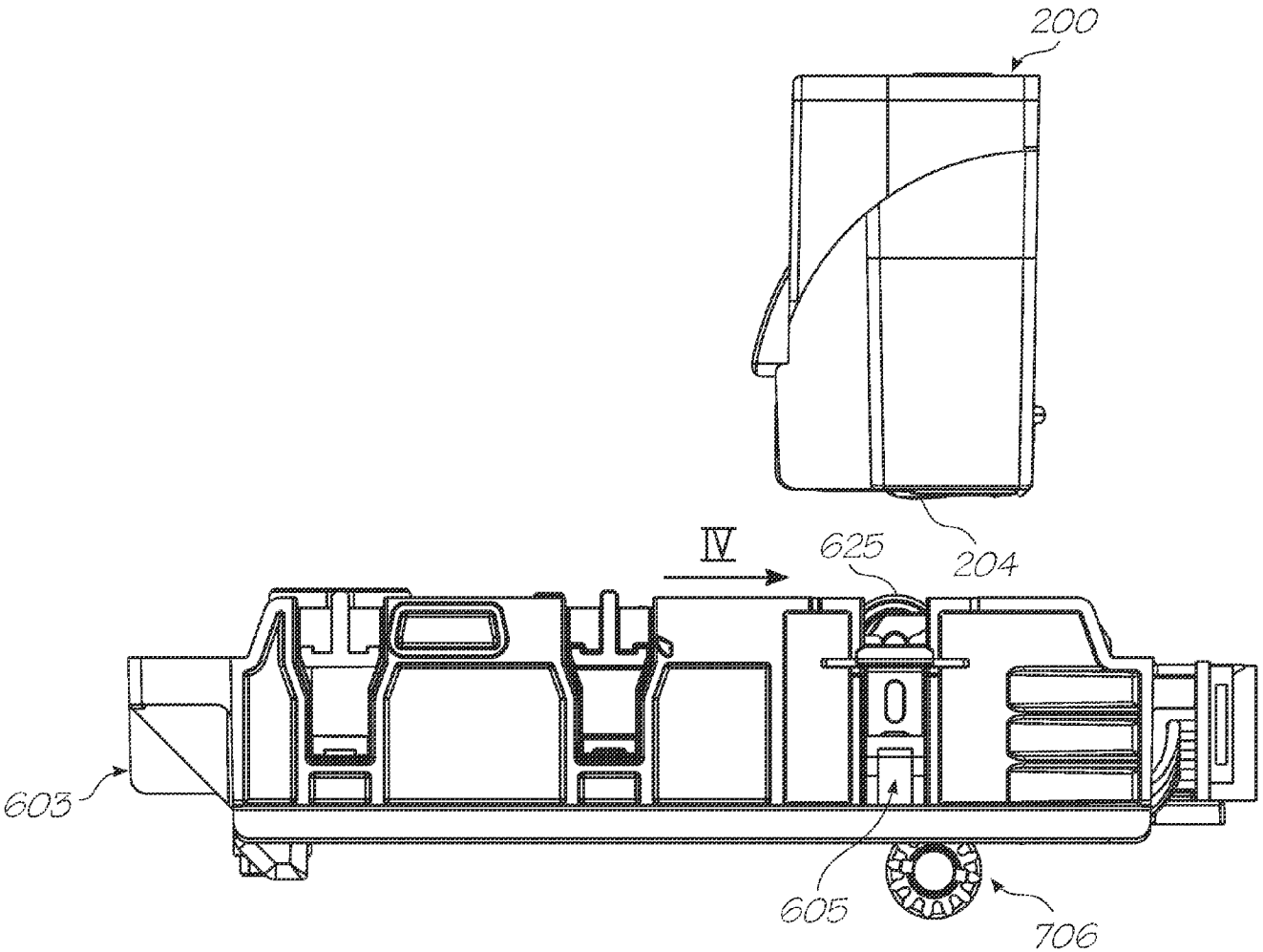
Figure 38E:
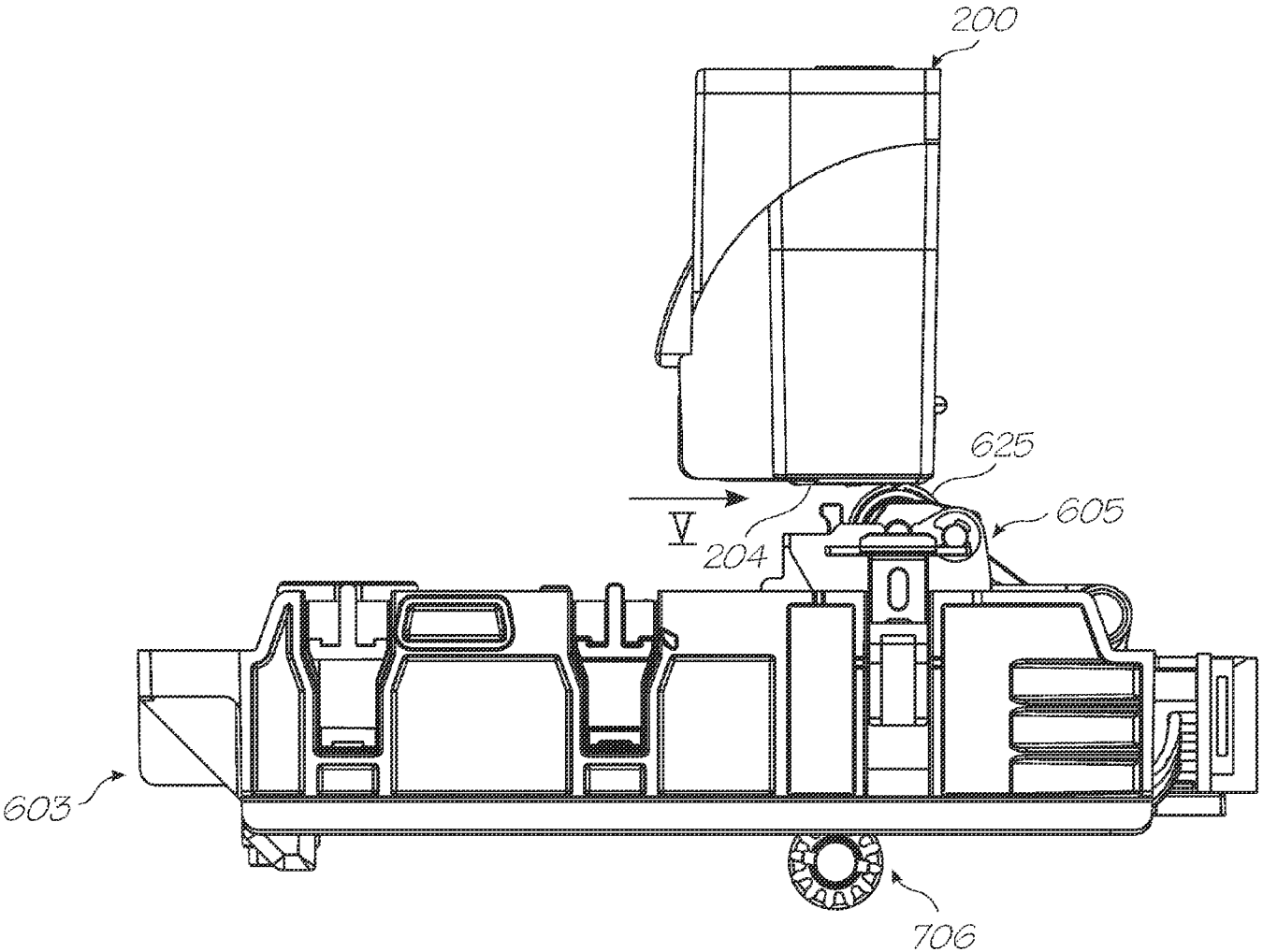
Figure 38F:
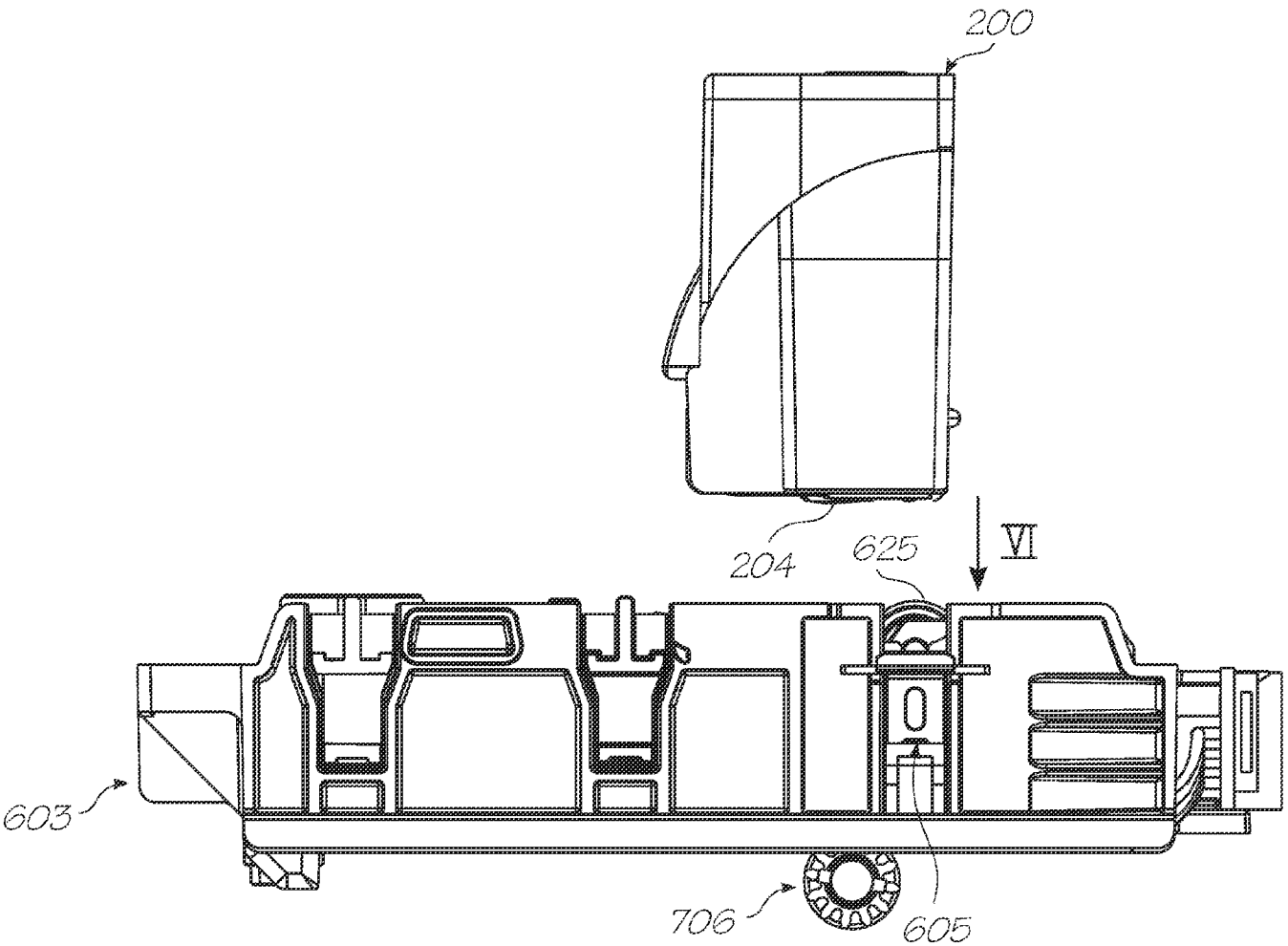
Figure 38G:
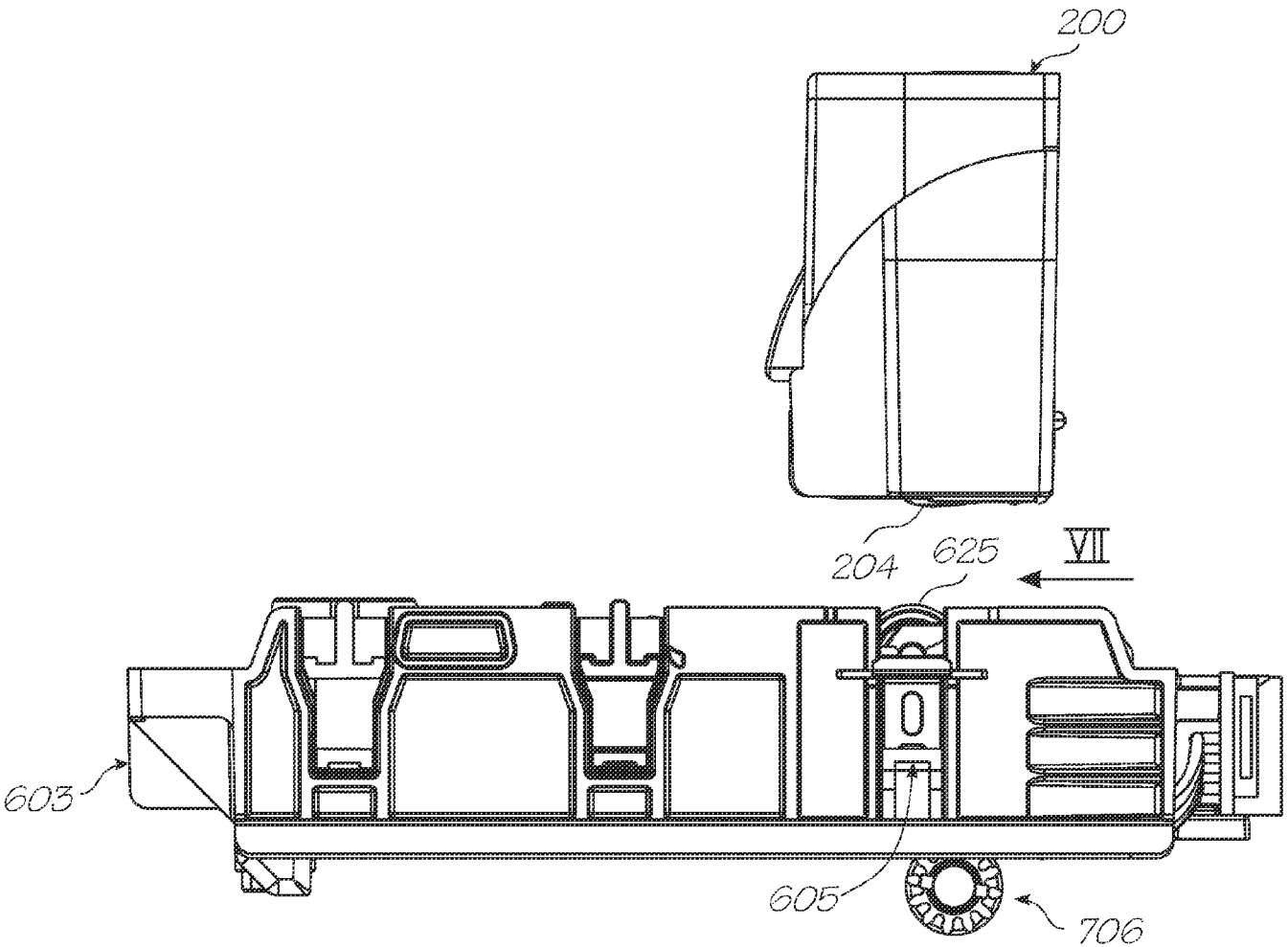

Exemplary translated wiping motions of the wiper module 605 are illustrated in the schematic views of FIGS. 38A-38G. In FIG. 38A, the wiper module is lifted in direction I so that the rotating wiper roller 625 is brought into wiping contact with the printing face. In FIG. 38B, the sled 603 is translated in direction II with the wiper roller 625 in constant rotating contact with the printing face. In FIG. 38C, the wiper module 605 is returned to its home position in the sled 603 in direction III from the translated position of FIG. 38B. In FIG. 38D, the sled 603 having the wiper module 605 in its home position is translated in direction IV. In FIG. 38E, the sled 603 is translated in direction V with the wiper roller 625 in constant rotating contact with the printing face. In FIG. 38F, the wiper module 605 is returned to its home position in the sled 603 in direction VI from the translated position of FIG. 38E. In FIG. 38G, the sled 603 having the wiper module 605 in its home position is translated in direction VII.

As is described later in relation to FIG. 40, in terms of the direction of media transport for printing provided by the media handling system 900, direction VII of FIG. 38G is the media transport direction and direction IV of FIG. 38D is opposite to the media transport direction. Accordingly, the right-hand side of the each of the schematics illustrated in FIGS. 38A-38G is defined as the "upstream" side of the printhead 200 and the left-hand side of the each of the schematics illustrated in FIGS. 38A-38G is defined as the "downstream" side of the printhead 200.

The control electronics 802 can be programmed to define certain combinations of these translated wiping motions of FIGS. 38A-38G so as to provide differently defined wiping routines of the maintenance system 600. Some exemplary wiping routines are now described, however many other wiping routines could be defined depending on the printing application of the printer 100.

A basic wiping routine is defined as a combination of the translated wiping motions of FIGS. 38A-38C in the following order:

(1) the motion of FIG. 38A is executed with the sled positioned so that the wiper roller is aligned with the printhead ICs of the printhead and the wiping contact of the wiper roller on the printhead ICs is maintained for two or three rotations of the wiper roller so that the wiper roller dwells at the nozzles of the printhead ICs;

(2) the motion of FIG. 38B is executed so that the wiper roller is translated just off the downstream edge of the printhead ICs; and (3) the motion of FIG. 38C is executed so that the wiper roller moves back to its home position in the sled whilst still rotating, which cleans the wiper roller through the afore-described action of the transfer roller and the scraper.

This basic wiping routine reduces ink contamination by drawing out contaminated ink from the nozzles due to the slight dwell of the wiper roller on the printhead ICs, clears debris and fibers from the nozzles due to the translated wiping over and off the printhead ICs, and thereby revives non-ejecting nozzles.

An exemplary full-face wiping routine is defined as a combination of the translated wiping motions of FIGS. 38A-38F in the following order:

(1) the motion of FIG. 38A is executed but the wiper roller is not dwelled at the printhead ICs;

(2) the motion of FIG. 38B is executed so that the wiper roller is translated off the downstream edge of the printhead ICs and over the entire downstream side of the printing face of the printhead;

(3) the motion of FIG. 38C is executed so that the wiper roller moves to its home position in the sled whilst still rotating, which cleans the wiper roller through the afore-described action of the transfer roller and the scraper;

(4) the motion of FIG. 38D is executed until the wiper roller is aligned with the printhead just off the upstream edge of the printhead ICs;

(5) the motion of FIG. 38A is executed so that the wiper roller makes wiping contact with the printing face in the aligned position of (4);

(6) the motion of FIG. 38E is executed so that the wiper roller is translated over the entire upstream side of the printing face of the printhead; and (7) the motion of FIG. 38F is executed so that the wiper roller moves to its home position in the sled whilst still rotating, which cleans the wiper roller through the afore-described action of the transfer roller and the scraper.

This full-face wiping routine clears condensation, ink puddles and fibers that may have accumulated on any area of the printing face of the printhead. The full-face wiping routine is not intended to revive the nozzles, however the basic and full-face wiping routines can be used in conjunction with one another, or with any other wiping routine, to achieve this.

As discussed above, the fluid captured by the wiper module 605 drains into the sled 603. Fluid captured by the platen and capper modules similarly drains into the sled 603 in the manner described in the incorporated description of the Applicant's US Provisional Patent Application No. 61/345,559. As illustrated in FIG. 33, the sled 603 has the drainage areas 632, 653 and 696 in the base 619. The drainage areas are defined in the base 619, such as by molding, to provide discrete paths to a hole 657 in the base 619, from which the fluid in the drainage areas is able to leave the sled 603. The hole 657 in the sled 603 may be aligned with a slot or aperture in the base 101*a* of the printer housing 101 so that the drained fluid is routed to the fluid collection tray 601 which collects and stores the drained fluid. The discrete paths are defined by walls 619*a* which act as drainage ribs which constrain the fluid in the sled 603 from free movement during displacement of the sled 603. In this way, the captured fluid is able to drain from the sled without being 'sloshed' around the sled which could cause the fluid to be 'splashed' onto the printhead. The sled 603 may be molded from a plastics material, such as a 10% glass fibre reinforced combination of polycarbonate and acrylonitrile butadiene styrene (PC/ABS), with the walls 619*a* integrally defined therein.

The drainage area 653 receives fluid drained from the wiper module 605 through the holes 607*b* of the body 607, as illustrated in FIGS. 32 and 33. In the manner described in the incorporated description of the Applicant's US Provisional Patent Application No. 61/345,559, the drainage area 632 receives fluid drained from the platen module 604 and the drainage area 696 receives fluid drained from the capper module 608 engagement of a valve 698 of the capper module 608 and a projection 699 on the base 619 of the sled 603.

Figure 39:
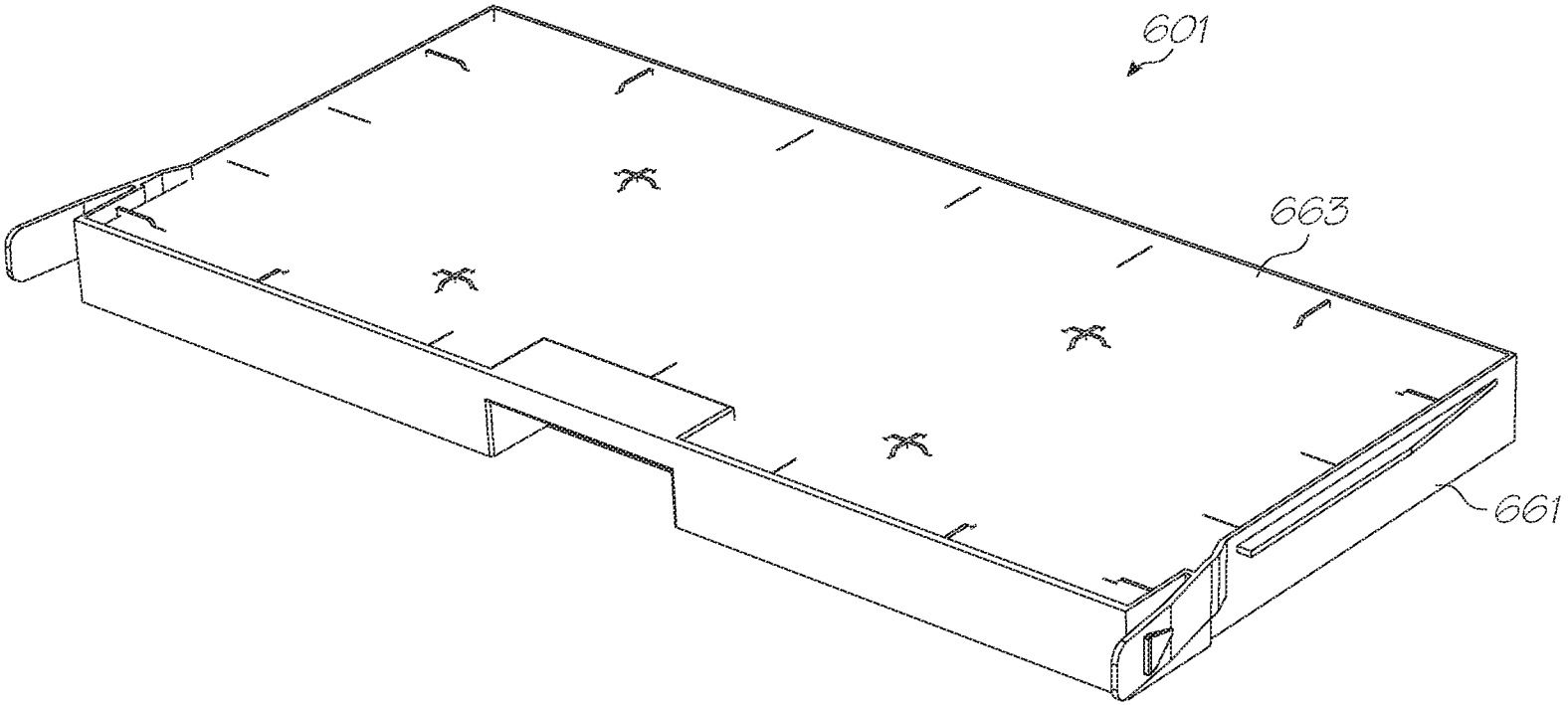
FIG. 39 illustrates a fluid collection tray of the maintenance system.

As illustrated in FIG. 39, the fluid collection tray 601 is an assembly of a tray 661 and a fluid storage pad 663 of an absorbent material which is exposed within the tray 661. The fluid collection tray 601 is removably received in the printer housing 101 so that replacement or emptying of the fluid storage pad 663 is possible. In particular, the tray 661 may be slid into position directly beneath the sled 603 in the printer housing 101 so that the drained fluid flows into the fluid storage pad 663 under gravity. Alternatively, as illustrated in FIG. 6, the tray 661 may be slid into position beneath the supply cartridges 301 and a shaped wicking element (not shown) between the sled 603 and the fluid storage pad 663 so that the drained fluid flows into the wicking element under gravity and then flows into the fluid storage pad 663 under capillary action and gravity.

The afore-described components of the maintenance system 600 provide a means of maintaining the printhead 200 and fluid distribution system 300 in operational condition by maintaining the printing environment about the printhead 200 free from unwanted wet and dried ink and debris. In particular, the linear translating sled with selectable maintenance modules provides a simple and compact manner of maintaining the stationary, full media width printhead. Employing a wiper module which is fully translatable whilst wiping the printhead provides enhanced cleaning.

The media handling system 900 is now described. FIGS. 6, 7 and 39-45B illustrate various exemplary aspects of the media handling system 900.

Figure 40:
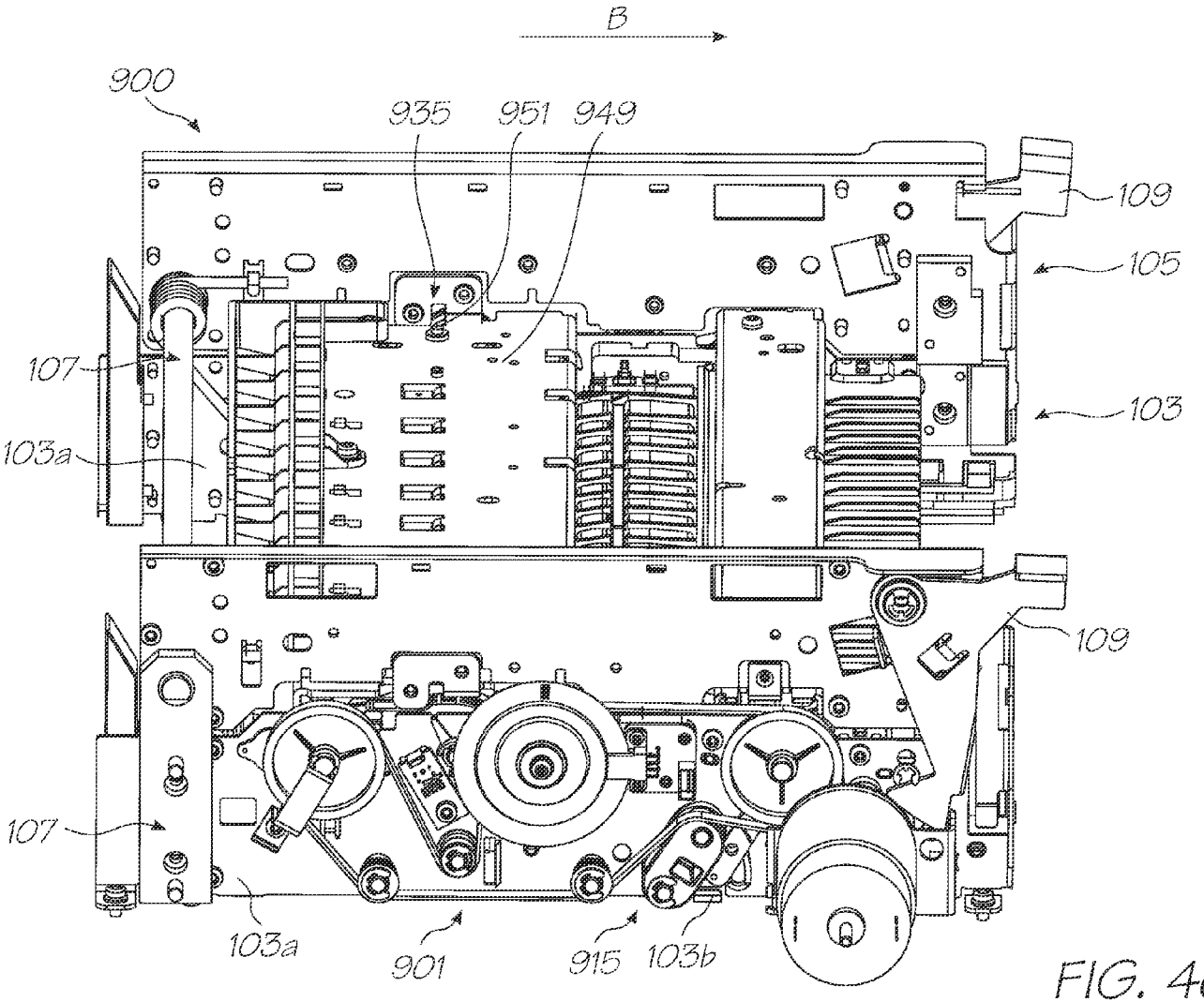
FIG. 40 illustrates upper and lower sections of an exemplary embodiment of the media handling system.

The media handling system 900 is defined within the printer 100 to transport and guide media past the printhead 200 along the direction of arrow B illustrated in FIG. 40 (i.e., the media transport direction) between the lower housing section 103 and an upper (second) housing section 105 of the printer housing 101. The upper housing section 105 is hingedly attached to the lower housing section 103 at hinge elements 107 and is latched to the lower housing section 103 at latch elements 109. In the illustrated embodiment, the hinge elements 107 are linked by a sprung shaft 107*a*, however other arrangements are possible. This hinged engagement of the lower and upper housing sections 103,105 allows access to the media handling system 900 so as to easily clear media jams and the like during printing.

The media handling system 900 has a driven roller assembly 901 defined in the lower housing section 103. The driven roller assembly 901 has a series of driven media transport rollers rotationally mounted to the sidewalls 103*a* of the lower housing section 103, as illustrated most clearly in FIG. 41. The series of driven media transport rollers include an entry roller 903 and an input roller 905 disposed on the upstream side of the printhead 200 with respect to the media transport direction and an exit roller 907 disposed on the downstream side of the printhead 200 with respect to the media transport direction.

The entry roller 903 receives media which is supplied either manually or automatically and is rotated to feed the received media to the input roller 905. The media handling system 900 of the present exemplary embodiment is provided for handling web media, preferably label web media on which label information is printed by the printhead 200, from a media roll which is either externally provided to the printer 100 or received within the housing 101 of the printer 100. Having said this, the media handling system 900 of the present exemplary embodiment is also applicable to handling discrete sheet media. Mechanisms and arrangements for supplying such web or sheet media are well understood by one of ordinary skill in the art.

The input roller 905 receives the media fed from the entry roller 903 and is rotated to feed the received media to the printhead 200 for printing. The exit roller 907 receives the media fed from the input roller 905 via the printhead 200 and is rotated to transport the media received from the printhead 200. In relation to web media, the exit roller 907 transports the web media to a cutter mechanism or the like which is either externally provided to the printer 100 or received within the housing 101 of the printer 100 and which separates the printed portion of the web media from the unprinted portion of the web media. The arrangement and operation of such a cutter mechanism is well understood by one of ordinary skill in the art.

The rotation of the driven rollers 903-907 is driven by a drive mechanism 909 of the driven roller assembly 901 located at one of the sidewalls 103*a* of the lower housing section 103. The drive mechanism 909 has a drive motor 911 and a drive belt 913 which is looped about a drive shaft of the motor 911 and each of the driven rollers 903-907 so as to impart the rotational driving force of the motor 911 to each of the rollers 903-907 in a manner well understood by one of ordinary skill in the art. In this way, each of the driven rollers 903-907 is driven at the same rotational speed which ensures smooth movement of the media past the printhead 200. In the illustrated embodiment all of the driven rollers are driven using a single drive belt, however other arrangements are possible in which one driven roller is driven by the drive belt, or multiple drive belts are provided for the respective driven rollers.

The motor 911 is preferably a bi-directional motor so that upon cessation of printing and separation of the printed media from the web by the cutting mechanism, the unprinted web media is able to be retracted to a position upstream of the printhead 200. This enables the wiper and capper modules 605,608 of the maintenance system 600 to be brought into operational position relative to the printhead 200 in the manner described earlier herein and in the incorporated description of the Applicant's US Provisional Patent Application No. 61/345,559.

Suitable tension in the flexible drive belt 913 which ensures that the driven rollers 903-907 are reliably driven at the same rotational speed, is maintained by a tensioning assembly 915 located between the motor 911 and one of bushings 917 about which the drive belt 913 is run. As illustrated in the cut-away partial detailed view of FIG. 41, the tensioning assembly 915 has a tensioning member 919 which is pivotally mounted to the sidewall 103*a* at a pivot pin 921. A helical torsion spring 923 is disposed about the pivot pin 921 so that an arm 923*a* of the spring 923 exerts torsional force against a tab 103*b* projecting from the sidewall 103*a*. This sprung arrangement biases the tensioning member 919 in the direction of the drive belt 913. The drive belt 913 is dimensioned so that this biased contact of the tensioning member 919 causes any slack in the drive belt 913 about the motor shaft, driven rollers 903-907 and bushings 917 to be removed. In the illustrated embodiment, the spring is a helical torsion spring, however other types of springs, such as a compression spring, or other biasing means can be used so long as the tensioning member is biased toward the drive belt.

Figure 42:
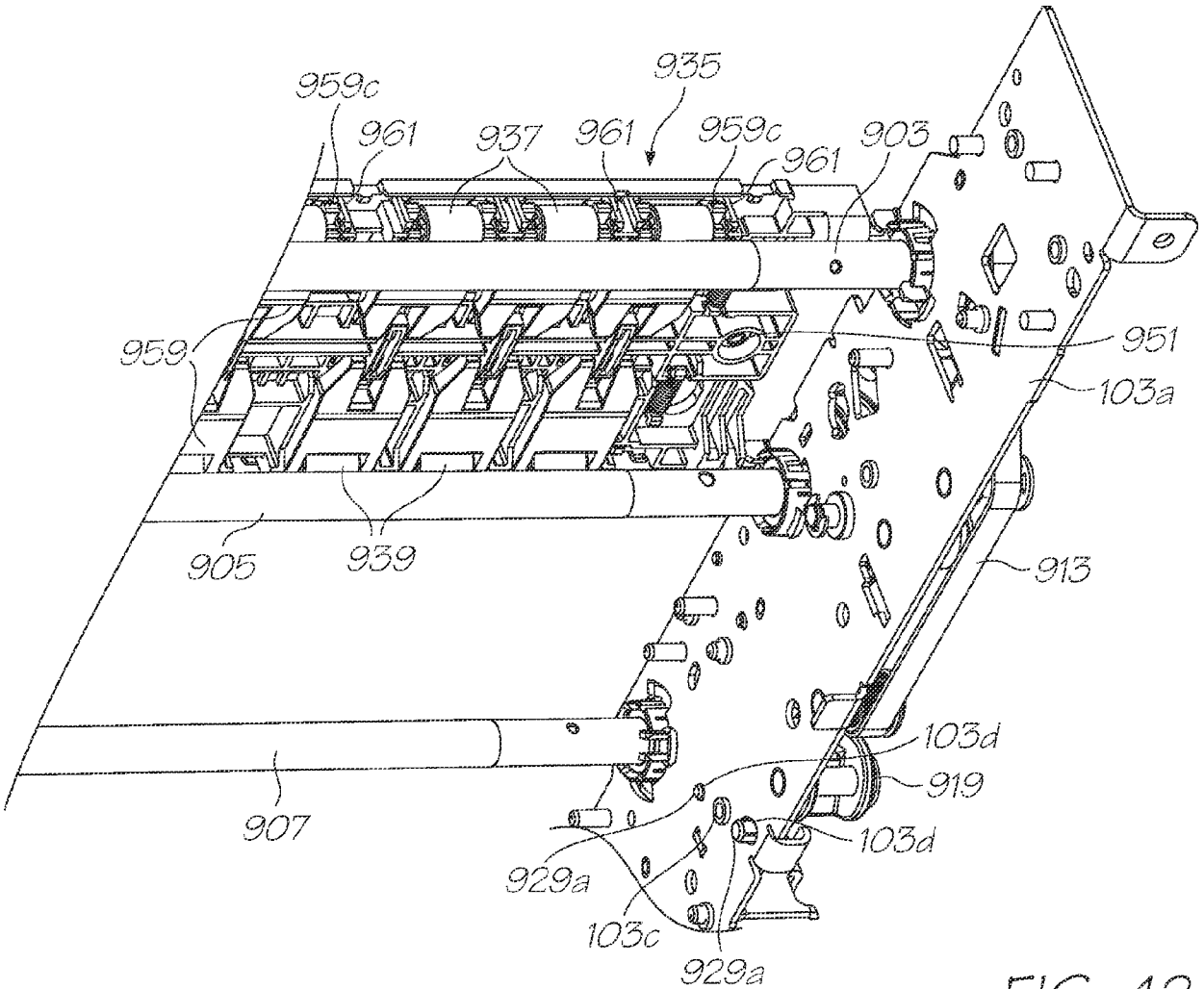
FIG. 42 illustrates engagement of drive and pinch elements of the drive and pinch assemblies.

The tensioning member 919 has a slotted arm 925 through which a locking screw 927 is screwed into a hole 103*c* in the sidewall 103*a*, as illustrated in FIG. 42. The slot within the slotted arm 925 is curved so as to form a lunette, such that the hole 103*c* in the sidewall 103*a* is exposed through the curved slot throughout rotation of the tensioning member 919 about its pivot point. Accordingly, the locking screw 927 can be fixed within the hole 103*c* in any rotated position of the tensioning member 919 so as to lock the tensioning member 919 in that rotated position.

This arrangement of the tensioning member allows the amount of tension in the drive belt to be selected by selectively locking the rotated position of the tensioning member. This selection provides tolerance of stretching in the drive belt over time, which would otherwise cause slackening of the drive belt, since the rotated position of the tensioning member can be changed as desired. In the illustrated embodiment, a locking screw is used, however other locking means are possible so long as the rotated position of the tensioning member can be dynamically selected.

The Applicant has found that when the locking screw 927 is fastened against the slotted arm 925 of the tensioning member 919, the rotational force of the locking screw 927 can be imparted to the tensioning member 919 causing undesired rotation of the tensioning member 919. This rotation is undesired because the ultimate locked rotated position of the tensioning member ends up being different than the desired rotated position. In order to prevent this over-rotation of the tensioning member 919, a brace member 929 is provided between the slotted arm 925 and locking screw 927, as illustrated in the cut-away partial detailed view of FIG. 41.

The brace member 929 is elongate and has pins 929*a* at either end which are snugly received within respective holes 103*d* of the sidewall 103*a*, as illustrated in FIG. 42, such that the brace member 929 is unable to rotate relative to the sidewall 103*a*. Thus, as the locking screw 927 is screwed into position the brace member 929 is forced against the slotted arm 925 of the tensioning member 919, however the rotational force of the locking screw 927 is not imparted to the slotted arm 925.

The media handling system 900 further has a media guide assembly 931 defined in the lower housing section 103. The media guide assembly 931 has a series of guide members 933 which each extend along the media width direction of the printhead 200. The individual guide members 933 are located between the driven media transport rollers 903-907 both upstream and downstream of the printhead 200 with respect to the media transport direction, as illustrated most clearly in FIG. 41. The guide members 933 provide platens along which the fed media is guided.

Figure 41:
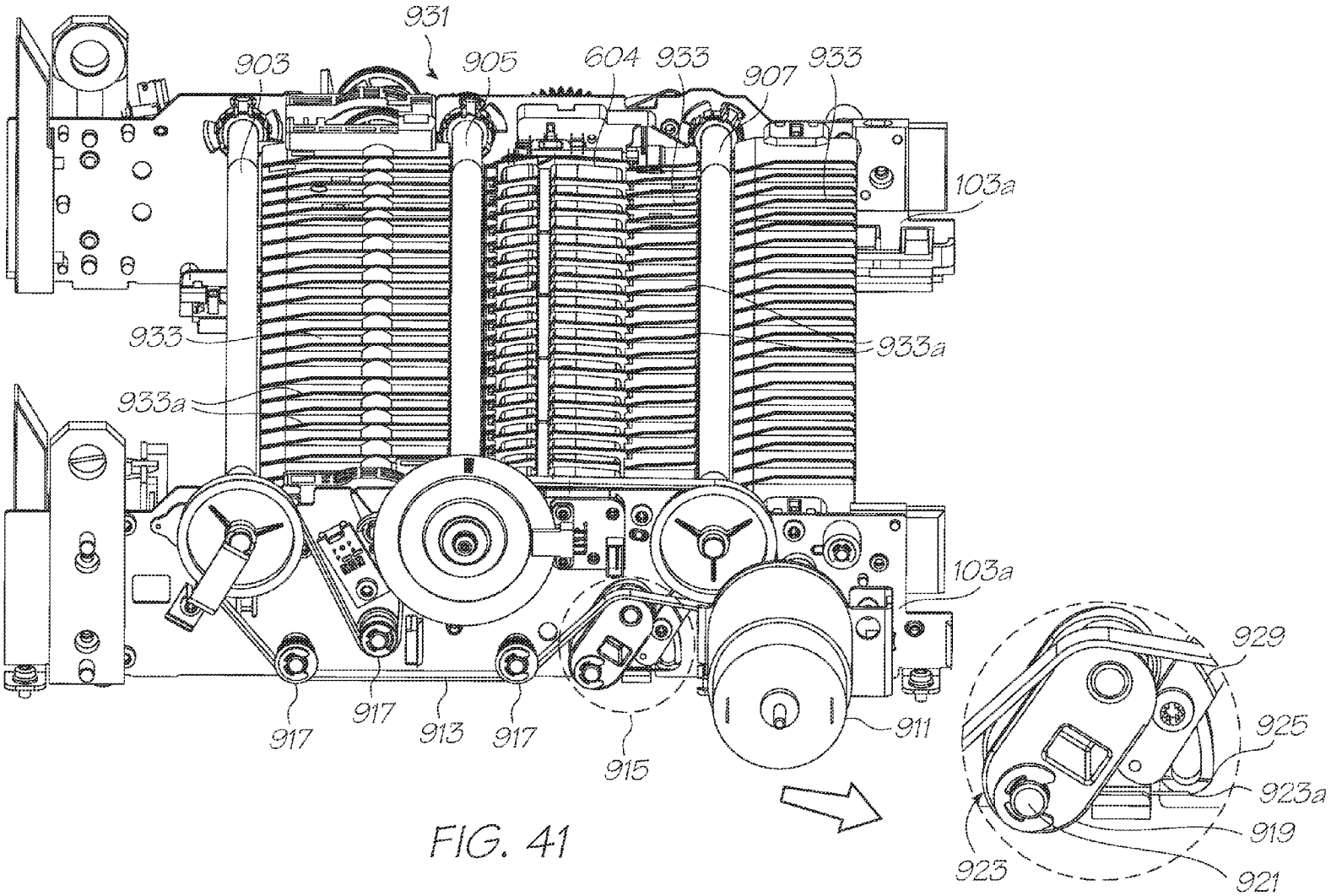
FIG. 41 illustrates media guide and drive assemblies of the lower section of the media handling system.

In FIG. 41, the platen module 604 of the maintenance system 600 is illustrated in its operational (lifted position). As can be seen, each guide member 933 has a series of ribs 933*a* which align and interlock with the ribs 626,628 of the platen module 604. To this end, the ribs 626,628 of the platen module 604 of the present embodiment are formed to extend about the edges of the platen module 604 (see FIGS. 29 and 30), which is a slight difference from the ribs of the platen module described in the incorporated description of the Applicant's US Provisional Patent Application No. 61/345,559. This interlocked arrangement of the media guiding ribs ensures that the media is smoothly transported past the printhead 200.

The media handling system 900 further has a pinch roller assembly 935 defined in the upper housing section 105 so as to extend across the media width direction of the printhead 200. As illustrated in FIG. 42, the pinch roller assembly 935 has a (first) series of entry pinch rollers 937 which engage with, and provide a pinched nip for the media along, the entry roller 903 and a (second) series of input pinch rollers 939 which engage with, and provide a pinched nip for the media along, the input roller 905 when the lower and upper housing sections 103,105 are hinged into the closed position, illustrated in FIG. 40. Each series of pinch rollers 937,939 therefore defines an idler roller for the corresponding driven roller.

Each pinch roller 937,939 is part of a pinch element 941 of the pinch roller assembly 935. The pinch elements 941 are held between an elongate support plate 943 and either an elongate entry (first) pinch housing 945 or an elongate input (second) pinch housing 947 of the pinch roller assembly 935 so as to serially extend across the media width direction of the printhead 200. The support plate 943 is fastened to an elongate mounting plate 949 by fasteners 951. The mounting plate 949 securely mounts the pinch roller assembly 935 to sidewalls 105*a* of the upper housing section 105, as illustrated in FIG. 40.

Figure 43:
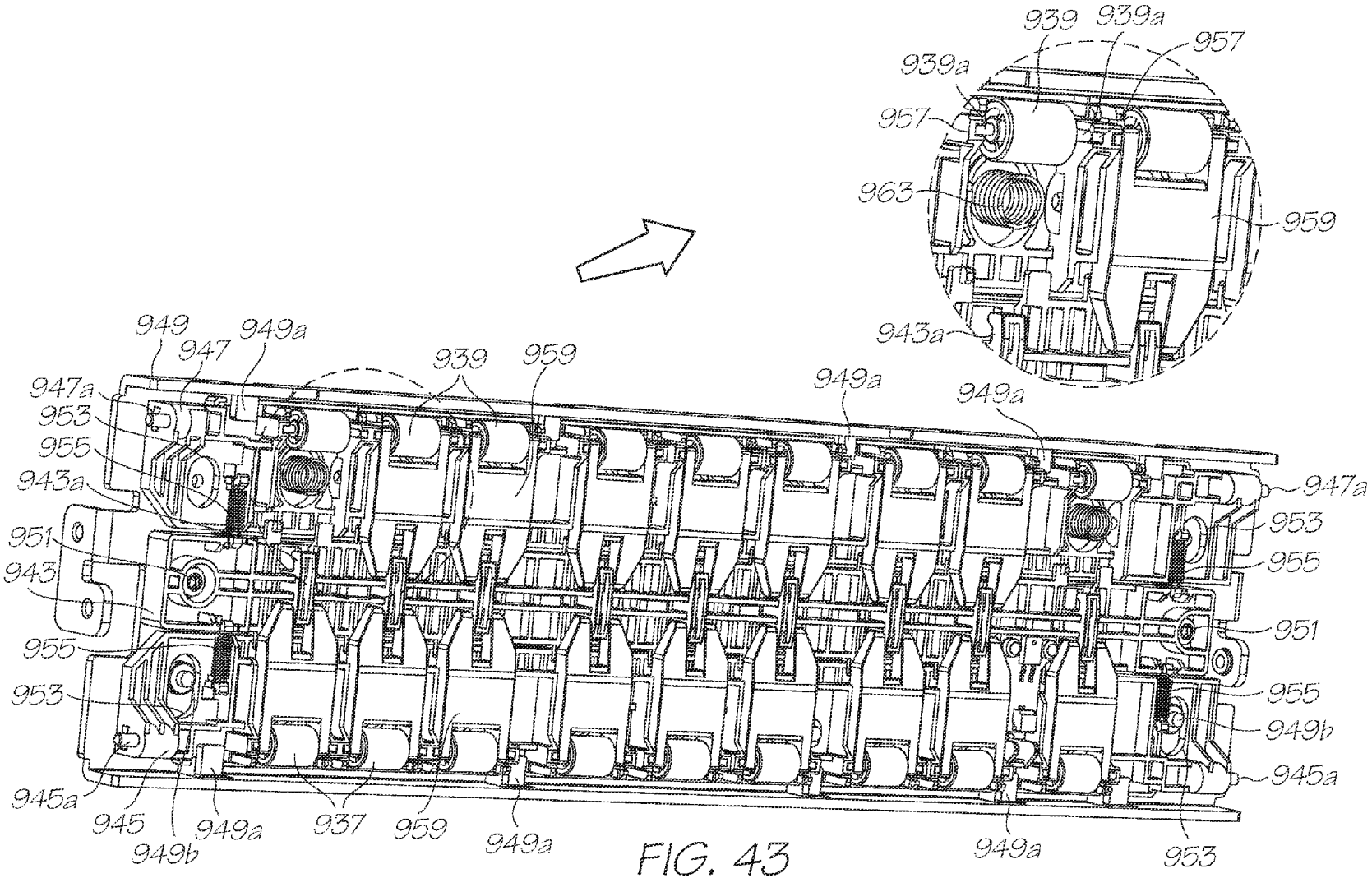
FIG. 43 is a perspective view of the pinch assembly with a plate of one of the pinch elements omitted.

As illustrated in FIG. 43, the pinch housings 945,947 are held to the mounting plate 949 by tabs 949*a* so that bushes 949*b* of the mounting plate 949 ride within slots 953 in the pinch housings 945,947 (as is particularly illustrated for the entry pinch housing 945 in FIG. 43). Further, the pinch housings 945,947 are linked to the support plate 943 by springs 955 at either longitudinal end of the pinch housings 945,947 and the support plate 943. By this arrangement, the pinch housings 945,947 are constrained by the stationary support plate 943 so as to be movable with respect to the mounting plate 949. The advantages of this relative movement of the pinch housings is described later. Whilst the springs 955 are illustrated as compression springs, other types of springs, such as leaf springs, or other types of biasing means can be used so long as the pinch housings are able to move relative to the mounting and support plates.

An axle 937*a* of each of the pinch rollers 937 is rotatably held within a corresponding slot 957 of the pinch housing 945 by a lever member 959 of the respective pinch element 941. This is illustrated most clearly in FIG. 43 in which one of the lever members 959 is omitted. Similarly, an axle 939*a* of each of the pinch rollers 939 is rotationally held within a corresponding slot 957 of the pinch housing 947 by a lever member 959 of the respective pinch element 941.

Figure 44:
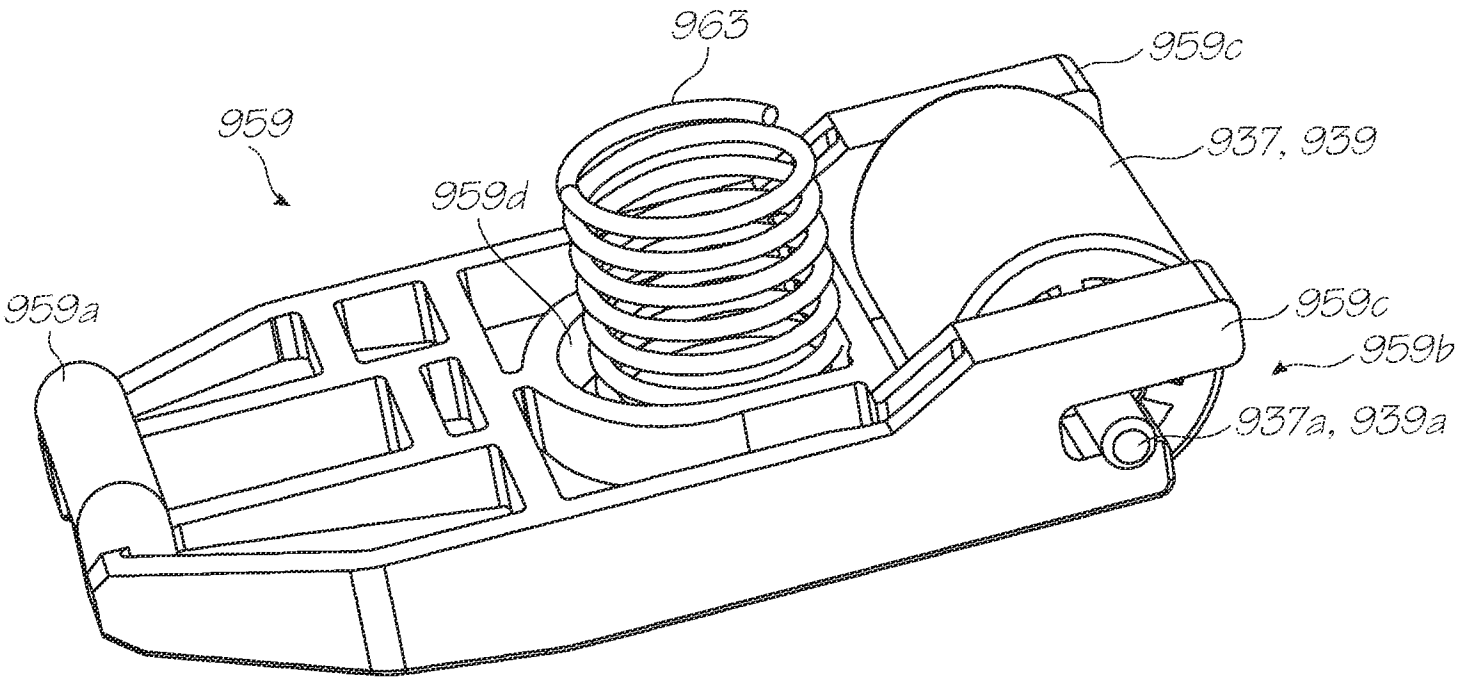
FIG. 44 illustrates one of the pinch elements in isolation.

As illustrated in FIG. 44, each lever member 959 has a rod 959*a* at one end, which is pivotally supported by a corresponding hook 943*a* of the support plate 943, a yoke 959*b* at the other end, which receives the axle 937*a*,939*a* of the corresponding pinch roller 937,939 and which has a longer arm 959*c* held within the corresponding pinch housing 945,947 by a hook 961 (see FIG. 42), and an aperture 959*d* between those ends, in which a corresponding spring 963 is received to be compressed between the lever member 959 and the mounting plate 949.

By this arrangement, the pinch rollers 937,939 are biased by the springs 963 into contact with the respective entry and input rollers 903,905 whilst being able to allow media to pass therebetween, within the constraint of the relative dimensions of the yoke arms 959*c* of the lever members 959 and the hooks 961 of the pinch housings 945,947.

In the illustrated embodiment, the springs of the lever members are compression springs, however other types of springs, such as leaf springs, or other types of biasing means can be used so long as the pinch rollers are biased into contact with the entry and input rollers. Further, in the exemplary embodiment the entry and input rollers (and exit rollers) are preferably grit rollers and the pinch rollers are preferably formed of a material, such as hard rubber, which is resistant to wear from the grit entry and input rollers whilst providing sufficient grip for the media. However, one of ordinary skill in the art understands that other materials are possible for the driven and pinch rollers, so long as sufficient nip and grip for the media is provided.

Since the lever members are securely held by the support plate but are not fastened to either the pinch rollers or the pinch housings, and since the pinch rollers are supported within the slots of the pinch housings without being fixed thereto, the pinch rollers effectively "float" within the lever members such that the pinch rollers are able to move with the pinch housings relative to the support plate. The advantages of this "floating" of the pinch rollers and the relative sliding of the pinch housings are now described.

As the upper housing section 105 is hinged between the open and closed positions relative to the lower housing section 103 throughout operation of the printer 100, it is possible that the required alignment of the driven and pinch rollers may be unreliably maintained which may cause media transport problems, such as misfeeds and media jams. In order to maintain correct alignment throughout operation the pinch roller assembly 935 must be consistently aligned with the driven roller assembly 901 each time the upper housing section 105 is returned to the closed position with the lower housing section 103.

Figure 45A:
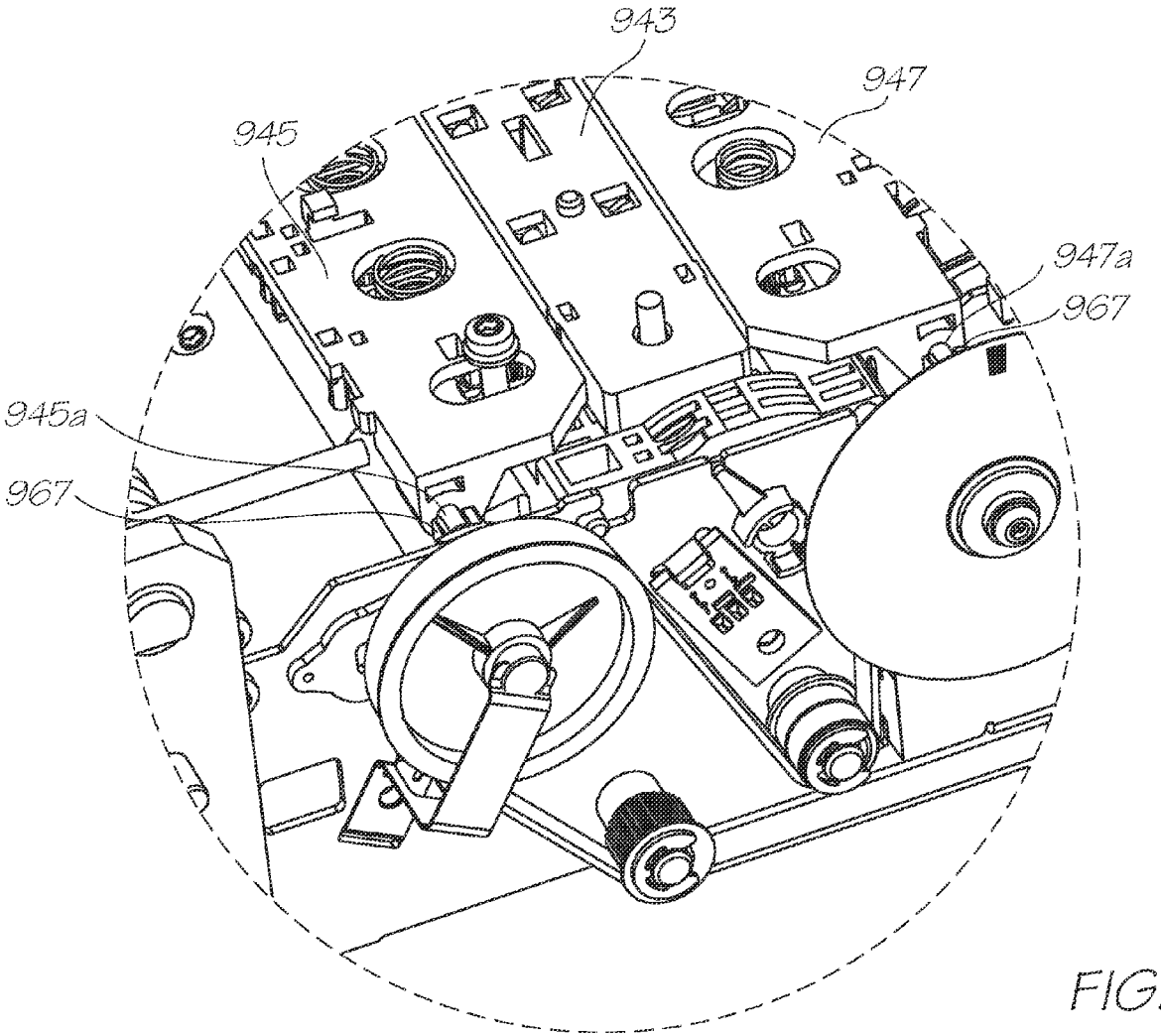
FIG. 45A illustrates an alignment mechanism of the drive assembly and a pinch assembly of the upper section of the media handling system.
Figure 45B:
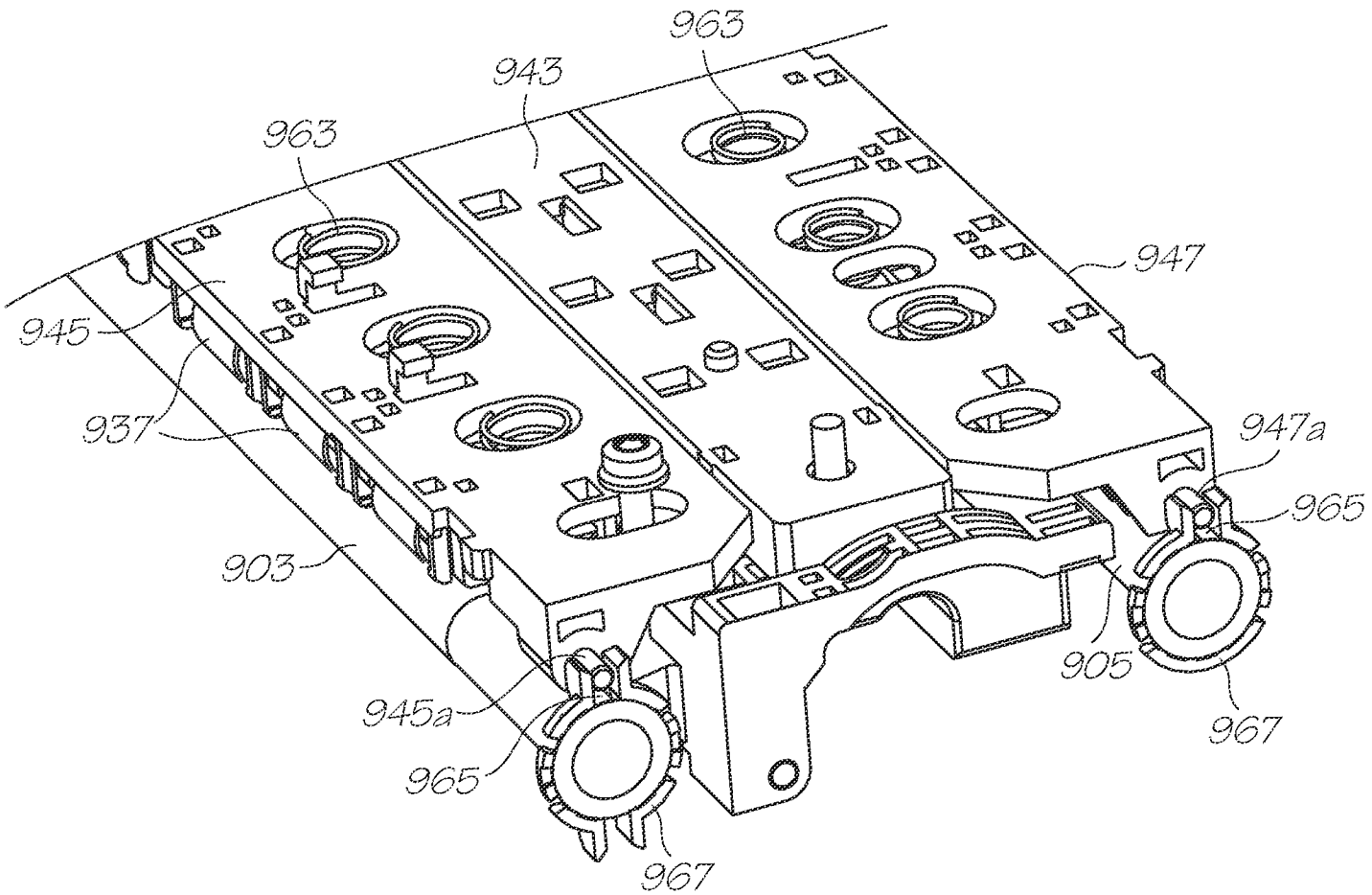
FIG. 45B is a cross-sectional view of the alignment mechanism illustrated in FIG. 45A.

This is achieved by engaging the pinch housings 945,947 with bearing members 967 which rotationally mount the entry and input rollers 903,905 to the sidewalls 103*a* of the lower housing section 103. In particular, as illustrated in FIGS. 45A and 45B, alignment pins 945*a*,947*a* are provided at each longitudinal end of the pinch housings 945,947 which engage with slots 965 in the bearing members 967. The bearing members 967 are configured to be fixedly mounted to the sidewalls 103*a* so that once the alignment pins 945*a*,947*a* and the bearing slots 965 are engaged the pinch rollers 937,939 are immovable with respect to the entry and input rollers 903,905. By this arrangement, the alignment pins of the pinch housings can be effectively engaged with the lower housing section of the printer.

The slots 965 of the bearing members 967 have sloped outer surfaces 965*a* which funnel the alignment pins 945*a*, 947*a* into the slots 965 as the upper housing section 105 is rotated into its closed position on the lower housing section 103. This engagement of the pins and the bearing slots is facilitated by the floating arrangement of the pinch housings, since the pinch housings slide relative to the fixedly mounted support plate as the pins are funnelled into the slots. Accordingly, the sliding movement of the pinch housings relative to the support plate and the yoked engagement of the lever members and pinch rollers provide an alignment adjustment mechanism for maintaining alignment between the driven and pinch rollers.

While the present invention has been illustrated and described with reference to exemplary embodiments thereof, various modifications will be apparent to and might readily be made by those skilled in the art without departing from the scope and spirit of the present invention. Accordingly, it is not intended that the scope of the claims appended hereto be limited to the description as set forth herein, but, rather, that the claims be broadly construed.

What is claimed is:

1. A pinch roller apparatus for a printer, the apparatus comprising:

a support plate securely mounted to a housing of the printer;

a pinch housing movably supported by the support plate; and a series of pinch rollers rotatably held within the pinch housing, wherein the pinch housing has alignment pins for engagement with the housing of the printer through said movement of the pinch housing relative to the support plate, said engagement aligning the pinch rollers with a driven roller rotatably mounted to the housing to provide pinched contact for media being transported through the printer, and wherein the pinch housing is linked to the support plate by springs at either end of the pinch housing and support plate.

2. An apparatus according to claim 1, wherein the printer comprises a media width printhead, and the support plate and pinch housing are elongate with a longitudinal length of at least the media width such that the series of pinch rollers extends along the media width.

3. An apparatus according to claim 1, further comprising a mounting plate securely mounted to the housing of the printer, the support plate being securely mounted to the mounting plate, the mounting plate having tabs on which the pinch housing is held.

4. An apparatus according to claim 3, wherein an axle of each pinch roller is rotatably held within a corresponding slot of the pinch housing by a respective lever member, the lever members being pivotally supported by the support plate and movably supported by the pinch housing.

5. An apparatus according to claim 4, further comprising springs between the lever members and the mounting plate, the springs being configured so that the lever members are biased away from the mounting plate thereby urging the pinch rollers toward the driven roller.

6. An apparatus according to claim 1, wherein the housing of the printer has a first housing portion hingedly mounted to a second housing portion, the support plate being securely mounted to the second housing portion and the driven roller being rotatably mounted to the first housing portion.

7. An apparatus according to claim 6, wherein the alignment pins of the pinch housing engage with the housing of the printer as the second housing portion is hinged into a closed position with the first housing portion.

8. An apparatus according to claim 6, wherein the driven roller is rotatably mounted to the first housing portion by bearing members which are fixedly mounted to the first housing portion, the alignment pins being configured to engage with slots in the bearing members as the second housing portion is hinged to the closed position with the first housing portion, said engagement causing said movement of the pinch housing relative to the second housing portion thereby aligning the pinch and driven rollers.

9. A pinch roller apparatus for a printer, the apparatus comprising:

a support plate securely mounted to a housing of the printer;

a pinch housing movably supported by the support plate; and a series of pinch rollers rotatably held within the pinch housing, wherein the pinch housing has alignment pins for engagement with the housing of the printer through said movement of the pinch housing relative to the support plate, said engagement aligning the pinch rollers with a driven roller rotatably mounted to the housing to provide pinched contact for media being transported through the printer, and wherein the housing of the printer has a first housing portion hingedly mounted to a second housing portion, the support plate being securely mounted to the second housing portion and the driven roller being rotatably mounted to the first housing portion.

10. An apparatus according to claim 9, wherein the alignment pins of the pinch housing engage with the housing of the printer as the second housing portion is hinged into a closed position with the first housing portion.

11. An apparatus according to claim 10, wherein the driven roller is rotatably mounted to the first housing portion by bearing members which are fixedly mounted to the first housing portion, the alignment pins being configured to engage with slots in the bearing members as the second housing portion is hinged to the closed position with the first housing portion, said engagement causing said movement of the pinch housing relative to the second housing portion thereby aligning the pinch and driven rollers.

* * * * *